US005541050A

United States Patent [19]

Mihayashi et al.

[11] Patent Number: 5,541,050

[45] Date of Patent: Jul. 30, 1996

[54] SILVER HALIDE COLOR PHOTOGRAPHIC LIGHT-SENSITIVE MATERIAL

[75] Inventors: Keiji Mihayashi; Mikio Ihama, both of Kanagawa, Japan

[73] Assignee: Fuji Photo Film Co., Ltd., Kanagawa, Japan

[21] Appl. No.: 288,877

[22] Filed: Aug. 10, 1994

Related U.S. Application Data

[63] Continuation of Ser. No. 933,233, Aug. 21, 1992, abandoned.

[30] Foreign Application Priority Data

Aug. 29, 1991 [JP] Japan ..... 3-242464
Dec. 25, 1991 [JP] Japan ..... 3-356643

[51] Int. Cl.[6] ..... G03C 1/08; G03C 7/26; G03C 7/32; G03C 1/06

[52] U.S. Cl. ..... 430/550; 430/603; 430/605; 430/955; 430/957; 430/544; 430/567; 430/505

[58] Field of Search ..... 430/544, 223, 430/567, 551, 505, 550, 603, 605, 543, 549, 955, 957

[56] References Cited

U.S. PATENT DOCUMENTS

| | | | |
|---|---|---|---|
| 4,861,701 | 8/1989 | Burns et al. | 430/543 |
| 4,987,064 | 1/1991 | Saitou et al. | 430/567 |
| 4,996,137 | 2/1991 | Inoue et al. | 430/567 |
| 5,118,597 | 6/1992 | Mihayashi | 430/567 |
| 5,350,666 | 9/1994 | Motoki et al. | 430/544 |

FOREIGN PATENT DOCUMENTS

| | | |
|---|---|---|
| 0318001 | 5/1989 | European Pat. Off. . |
| 0403019 | 12/1990 | European Pat. Off. . |
| 0438129 | 7/1991 | European Pat. Off. . |
| 0443453 | 8/1991 | European Pat. Off. . |
| 0454149 | 10/1991 | European Pat. Off. . |
| 0464612 | 1/1992 | European Pat. Off. . |
| 60-218645 | 11/1985 | Japan . |
| 1531927 | 11/1978 | United Kingdom . |

OTHER PUBLICATIONS

Patent Abstracts of Japan, vol. 13, No. 422 (P–933)(3770), Sep. 20, 1989.

*Primary Examiner*—Charles L. Bowers, Jr.
*Assistant Examiner*—J. Pasterczyk
*Attorney, Agent, or Firm*—Sughrue, Mion, Zinn, Macpeak & Seas

[57] ABSTRACT

A silver halide color photographic light-sensitive material having at least one light-sensitive silver halide emulsion layer formed on a support containing light-sensitive silver halide grains which have been chemically sensitized by at least one of a selenium sensitizer, a gold sensitizer and a sulfur sensitizer and at least one of the layers of the material contains a compound represented by the following formula (I) and/or a compound represented by the following formula (II) in which A is a coupler residue or a redox group, $L_1$ and $L_3$ are divalent timing groups, $L_2$ is a timing group with a valency of 3 or more, PUG is a photographically useful group, j and n are integers, each of 0 to 2, m is 1 or 2, s is 2 or a greater integer obtained by subtracting 1 from the valence of $L_2$, $L_4$ is —OCO— group, and $L_5$ is a group which releases PUG by electron transfer along a conjugated system.

Formula (I)

$$A'—(L_1)_j—(L_2)_m—[(L_3)_n—PUG]_s$$

Formula (II)

$$A—L_4—L_5—PUG$$

12 Claims, No Drawings

SILVER HALIDE COLOR PHOTOGRAPHIC LIGHT-SENSITIVE MATERIAL

This is a continuation of application Ser. No. 07/933,233, filed Aug. 21, 1992, now abandoned.

BACKGROUND OF THE INVENTION

1. Field of the Invention

The present invention relates to a silver halide color photographic light-sensitive material which contains an emulsion chemically sensitized with at lease one of a selenium sensitizer, a gold sensitizer and a sulfur sensitizer, and also containing a novel compound which releases a development inhibitor, and which has high sensitivity and excels in image-quality.

2. Description of the Related Art

There is a demand for a silver halide color photographic light-sensitive material (hereinafter called light-sensitive material), particularly one for photography use, which has a high light-sensitivity and stable photographic properties and which excels in image quality (color reproduction, graininess, and sharpness).

Known as means for improving the color reproduction and sharpness of such a light-sensitive material is a timing DIR coupler which releases a development-inhibiting compound through two timing groups. DIR couplers of this type are disclosed in, for example, JP-A-51-146828 ("JP-A" means Published Unexamined Japanese Patent Application), JP-A-60-218645, JP-A-61-156127, JP-A-63-37346, JP-A-1-280755, JP-A-1-219747, JP-A-2-230139, and Laid-open European Patent Applications 348139, 354532 and 403019. The use of a timing DIR coupler indeed enhances inter-layer effect or edge effect, thereby improving the sharpness and color reproduction to some extent. However, neither the inter-layer effect nor the edge effect can be sufficient since the development inhibitor is released substantially in a single step at an improper timing. Further, the light-sensitive material is disadvantageous in its stability, e.g., the stability during storage or the stability of its photographic properties during processing.

In general, a silver halide emulsion for use in light-sensitive materials is subjected to chemical sensitization using various chemicals, in order to have a desired sensitivity or a desired gradation. Known as typical examples of chemical sensitization are sulfur sensitization, selenium sensitization, gold sensitization, reduction sensitization, and any combination of these sensitizations.

These sensitizations have been improved in various respects in order to enhance sensitivity and graininess.

Of the sensitization methods described above, selenium sensitization is disclosed in, for example, U.S. Pat. Nos. 1,574,944, 1,602,592, 1,623,499, 3,297,446, 3,297,447, 3,320,069, 3,408,196, 3,408,197, 3,442,653, 3,420,670 and 3,591,385, French Patents 2,693,038 and 2,093,209, JP-B-52-34491 ("JP-B" means Published Examined Japanese Patent Application), JP-B-44-15748, JP-B-52-34492, JP-B-53-295, JP-B-57-22090, JP-A-59-180536, JP-A-59-185330, JP-A-181337, JP-A-59-187338, JP-A-59-192241, JP-A-60-150046, JP-A-60-151637, JP-A-61-246738, British Patents 255,846 and 861,984, and H. E. Spencer et al., "Journal of Photographic Science," Vol. 31, pp. 158–169 (1963).

Generally, selenium sensitization can sensitize an emulsion more effectively than sulfur sensitization which is usually performed in this field of industry, but there is a problem that it leads a light sensitive material to fog and soft gradation. Further, it may result in a decrease in the stability of the light-sensitive material during storage or processing, depending on the compound used as selenium sensitizer.

SUMMARY OF THE INVENTION

Accordingly, an object of the present invention is to provide a light-sensitive material which has high light-sensitivity and high image quality, and another object of the invention is to provide a light-sensitive material which excels in storage stability and process stability.

These objects are attained by a silver halide color photographic light-sensitive material comprising at least one light-sensitive silver halide emulsion layer formed on a support containing silver halide grains, characterized in that the silver halide grains which have been chemically sensitized by at least one of a selenium sensitizer, a gold sensitizer and a sulfur sensitizer, and that at least one of the layers of the material contains a compound represented by the following formula (I) and/or a compound represented by the following formula (II):

Formula (I)

$$A—(L_1)_j—(L_2)_m—[(L_3)_n—PUG]_s$$

where A is a coupler residue or a redox group, $L_1$ and $L_3$ are divalent timing groups, $L_2$ is a timing group with a valency of 3 or more, PUG is a photographically useful group, j and n are integers of 0 to 2, m is 1 or 2, s is an integer of 2 or greater, and is determined by subtracting 1 from the valence of $L_2$. If there are two or more $L_1$, $L_2$ or $L_3$ in the molecule, they can either be the same or different. If there are two or more PUGs in the molecule, they can either be the same or different.

Formula (II)

$$A—L_4—L_5—PUG$$

where A and PUG are of the same definition as made in conjunction with formula (I). $L_4$ is —OCO— group, —OSO group, —$OSO_2$— group, —OCS— group, —SCO— group, —SCS— group, or —$WCR_{11}R_{12}$— group, where W is an oxygen atom, a sulfur atom or tertiary amino group (—$NR_{13}$—), $R_{11}$ and $R_{12}$ are independently a hydrogen atom or a substituent, $R_{13}$ is a substituent, $R_{11}$, $R_{12}$ and $R_{13}$ can be divalent groups and combine, forming a ring, in some cases. $L_5$ is a group which releases PUG by electron transfer along a conjugated system and can bond to $L_4$ through a nitrogen atom.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

DETAILED DESCRIPTION OF THE PREFERRED EMBODIMENTS

The compounds represented by the general formulas (I) and (II) will now be described in detail.

As has been pointed out, A in the formula (I) is a coupler residue or a redox group.

Examples of the coupler residue are: a yellow coupler residue (e.g., an open-chain ketomethylene-type coupler residue such as acylacetoanilide or malondianilide); a magenta coupler residue (e.g., a coupler residue of such as 5-pyrazolone-type, pyrazoloazole-type, or imidazopyrazole-type); a cyan coupler residue (e.g., a coupler residue of phenol-type, naphthol-type, or imidazole-type disclosed in Laid-open European Patent Application 249,453, and a pyrazolopyridine-type coupler residue disclosed in Laid-open European Patent Application 304,001); and a colorless compound forming coupler residue (e.g., a coupler residue of indanone-type or acetophenone-type). Other examples of the coupler residue are the heterocyclic coupler residues which are disclosed in U.S. Pat. Nos. 4,315,070, 4,183,752, 4,174,969, 3,961,959 and 4,171,223, and JP-A-52-82423.

If A is a redox group, this is a group that can be oxidized by an oxidized form of a developing agent. Examples of the redox group are: hydroquinones, catechols, pyrogallols, 1,4-naphthohydroquinones, 1,2-naphthohydroquinones, sulfonamidephenols, hydrazides and sulfonamidenaphthols. These groups can be those disclosed in JP-A-61-230135, JP-A-62-251746, JP-A-61-278852, U.S. Pat. Nos. 3,364,022, 3,379,529, 3,639,417 and 4,684,604, and J. Org. Chem., 29,588 (1964).

Preferable examples of A are coupler residues represented by the following formulas (Cp-1), (Cp-2), (Cp-3), (Cp-4), (Cp-5), (Cp-6), (Cp-7), (Cp-8), (Cp-9), (Cp-10), and (Cp-11), since these couplers have high coupling rates.

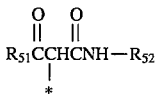
Formula (Cp-1)

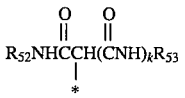
Formula (Cp-2)

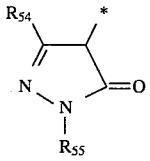
Formula (Cp-3)

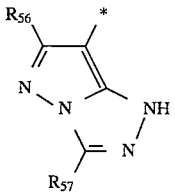
Formula (Cp-4)

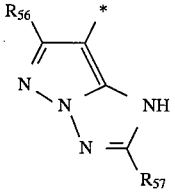
Formula (Cp-5)

-continued

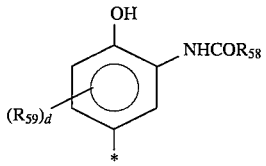
Formula (Cp-6)

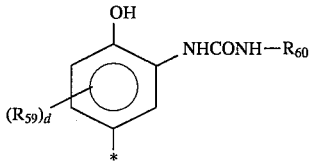
Formula (Cp-7)

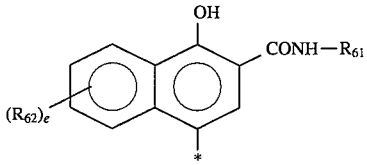
Formula (Cp-8)

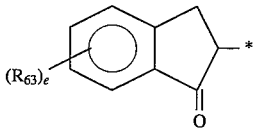
Formula (Cp-9)

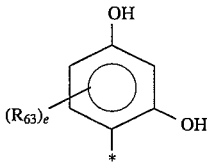
Formula (Cp-10)

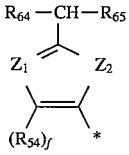
Formula (Cp-11)

In the formulas (Cp-1) to (Cp-11), the mark * deriving from a coupling position represents a position to be bonded to groups $L_1$ et seq. in the formula (I), and groups $L_4$ et seq. in the formula (II).

In the formulas (Cp-1) to (Cp-11), if $R_{51}$, $R_{52}$, $R_{53}$, $R_{54}$, $R_{55}$, $R_{56}$, $R_{57}$, $R_{58}$, $R_{59}$, $R_{60}$, $R_{61}$, $R_{62}$, $R_{63}$, $R_{64}$, or $R_{65}$ contains a nondiffusing group, the group is so selected as to have 8 to 40 carbon atoms in total, preferably 10 to 30 carbon atoms. Otherwise, the total number of carbon atoms is preferably 15 or less.

$R_{51}$ to $R_{65}$, k, d, e, and f will be explained in detail. In the following explanation, $R_{41}$ is an aliphatic group, an aromatic group or a heterocyclic group; $R_{42}$ is an aromatic group or a heterocyclic group; and $R_{43}$, $R_{44}$, and $R_{45}$ are hydrogen atoms, aliphatic groups, aromatic groups, or heterocyclic groups.

$R_{51}$ is equal to $R_{41}$. $R_{52}$ and $R_{53}$ are equal to $R_{42}$. The notation of k is 0 or 1. $R_{54}$ is equal to $R_{41}$ or is $R_{41}CON(R_{43})$— group, $R_{41}R_{43}N$— group, $R_{41}SO_2N(R_{43})$— group, $R_{41}S$— group, $R_{43}O$— group, $R_{45}N(R_{43})CON(R_{44})$— group, or NC— group. $R_{55}$ is equal to $R_{41}$. $R_{56}$ and $R_{57}$ are equal to $R_{43}$, $R_{41}S$— groups, $R_{43}O$— groups, $R_{41}CON(R_{43})$— groups, or $R_{41}SO_2N(R_{43})$— groups. $R_{58}$ is equal to $R_{41}$. $R_{59}$ is equal to $R_{41}$, or it represents $R_{41}CON(R_{43})$— group, $R_{41}OCON(R_{43})$— group, $R_{41}SO_2N(R_{43})$— group, $R_{43}R_{44}NCON(R_{45})$— group, $R_{41}O$— group, $R_{41}S$— group, a halogen atom, or $R_{41}R_{43}N$— group. The notation of "d" is an integer of 0 to 3. If d is plural, the plural $R_{59}$ groups are substituents which are the same or different, or can be divalent groups combining together, forming a ring such as pyridine ring or a pyrrole ring. $R_{60}$ is equal to $R_{41}$. $R_{61}$ is also equal to $R_{41}$. $R_{62}$ is equal to $R_{41}$, or $R_{41}OCONH$— group, $R_{41}SO_2NH$— group, $R_{43}R_{44}NCON(R_{45})$— group, $R_{43}R_{44}NSO2(R_{45})$— group, $R_{43}O$— group, $R_{41}S$— group, a halogen atom, or $R_{41}R_{43}N$— group. $R_{63}$ is equal to $R_{41}$, or $R_{43}CON(R_{45})$— group, $R_{43}R_{44}NCO$— group, $R_{41}SO_2N(R_{44})$— group, $R_{43}R_{44}NSO_2$— group, $R_{41}SO_2$— group, $R_{43}OCO$— group, $R_{43}O$—$SO_2$— group, a halogen atom, nitro, cyano, or $R_{43}CO$— group. The notation of "e" is an integer of 0 to 4. If there are plural $R_{62}$ or $R_{63}$, these groups are either same or different. $R_{64}$ and $R_{65}$ are $R_{43}R_{44}NCO$— groups, $R_{41}CO$— groups, $R_{43}R_{44}NSO_2$— groups, $R_{41}OCO$— groups, $R_{41}SO_2$— groups, nitro, or cyano. $Z_1$ is a nitrogen atom or $=C(R_{66})$— group, where $R_{66}$ is a hydrogen atom or a group of the same meaning as $R_{63}$. $Z_2$ is a sulfur atom or an oxygen atom. The notation of "f" is 0 or 1.

The aliphatic groups, mentioned above, are saturated or unsaturated, chained or cyclic, straight-chains or branched, and substituted or unsubstituted aliphatic hydrocarbon groups which have 1 to 32 carbon atoms, preferably 1 to 22 carbon atoms. Typical examples of the aliphatic groups are: methyl, ethyl, propyl, isopropyl, butyl, (t)-butyl, (i)-butyl, (t)-amyl, hexyl, cyclohexyl, 2-ethylhexyl, octyl, 1,1,3,3-tetramethylbutyl, decyl, dodecyl, hexadecyl, and octadecyl.

The aromatic groups, also mentioned above, are those having 6 to 20 carbon atoms, preferably substituted or unsubstituted phenyl groups or substituted or unsubstituted naphthyl groups.

The heterocyclic groups, mentioned above, are preferably 3- to 8-membered substituted or unsubstituted heterocyclic groups having 1 to 20 carbon atoms, more preferably 1 to 7 carbon atoms, and containing at least one hetero atom selected from a nitrogen atom, an oxygen atom or a sulfur atom. Typical examples of the heterocyclic groups are: 2-pyridyl, 2-furyl, 2-imidazolyl, 1-indolyl, 2,4-dioxo-1,3-imdazolidin-5-yl, 2-benzoxazolyl, 1,2,4-triazol-3-yl or 4-pyrazolyl.

Typical examples of the substitutent, which the aliphatic hydrocarbon groups, the aromatic groups and the heterocyclic groups—all described above—have, are: a halogen atom, $R_{47}O$— group, $R_{46}S$— group, $R_{47}CON(R_{48})$— group, $R_{47}N(R_{48})CO$— group, $R_{46}OCON(R_{47})$— group, $R_{46}SO2N(R_{47})$— group, $R_{47}R_{48}NSO_2$— group, $R_{46}SO_2$— group, $R_{47}OCO$— group, $R_{47}R_{48}NCON(R_{49})$— group, group of the same meaning as $R_{46}$, $R_{46}COO$— group, $R_{47}OSO_2$— group, cyano, or nitro. $R_{46}$ is an aliphatic group, an aromatic group, or a heterocyclic group. Each of $R_{47}$, $R_{48}$, and $R_{49}$ is an aliphatic group, an aromatic group, a heterocyclic group, or a hydrogen atom. The aliphatic group, the aromatic group, and the heterocyclic group are of the meanings defined above.

Preferable ranges for $R_{51}$ to $R_{65}$, k, d, e, and f will be described.

Preferably, $R_{51}$ is an aliphatic group or an aromatic group, $R_{52}$ and $R_{55}$ are preferably aromatic groups, and $R_{53}$ is an aromatic group or a heterocyclic group.

In the formula (Cp-3), $R_{54}$ is preferably $R_{41}CONH$— group or $R_{41}R_{43}N$— group; $R_{56}$ and $R_{57}$ are desirably aliphatic groups, aromatic groups; $R_{41}O$— groups, or $R_{41}S$— groups; and $R_{58}$ is preferably an aliphatic group or an aromatic group. In the formula (Cp-6), $R_{59}$ is desirably a chlorine atom, an aliphatic group, or $R_{41}CONH$— group; d is preferably 1 or 2; and $R_{60}$ is desirably an aromatic group. In the formula (Cp-7), $R_{59}$ is desirably $R_{41}CONH$— group; d is preferably 1; and $R_{61}$ is preferably an aliphatic group or an aromatic group. In the formula (Cp-8), e is preferably 0 or 1; and $R_{62}$ is desirably $R_{41}OCONH$— group, $R_{41}CONH$— group or $R_{41}SO_2NH$— group, the substitution position of which is preferably 5-position of a naphthol ring. In the formula (Cp-9), $R_{63}$ is preferably $R_{41}CONH$— group, $R_{41}SO_2NH$— group, $R_{41}R_{43}NSO_2$group, $R_{41}SO_2$— group, $R_{41}R_{43}NCO$—group, nitro, or cyano; and e is preferably 1 or 2. In the formula (Cp-10), $R_{63}$ is desirably $(R_{43})_2NCO$— group, $R_{43}OCO$— group or $R_{43}CO$— group; and e is preferably 1 or 2. In the formula (Cp-11), $R_{54}$ is preferably an aliphatic group, an aromatic group, or $R_{41}CONH$— group, and f is preferably 1.

It is desirable that A has a nondiffusing group.

In the formula (I), preferable example of $L_1$ are the groups specified below:

(1) Groups Utilizing a Cleavage Reaction of Hemiacetal

Example of this group are disclosed in, for example, U.S. Pat. No. 4,146,396, JP-A-60-249148, and JP-A-60-249149. This group is represented by the following formula (T-1), wherein mark * indicates the position where the group bonds to A or $L_1$ of the compound re presented by the formula (I), and mark ** indicates the position where the group bonds to $L_1$ or $L_2$ of the compound.

Formula (T-1)

$$*—(W—CR_{11}(R_{12}))_t—**$$

In this formula, W is an oxygen atom, a sulfur atom, or $—NR_{13}$— group, $R_{11}$ and $R_{12}$ are hydrogen atoms or substituents, $R_{13}$ is a substituent, t is 1 or 2. If t is 2, the two $—W—CR_{11}(R_{12})$— groups are either same or different. If $R_{11}$ and $R_{12}$ are substituents, typical examples of these and $R_{13}$ are $R_{15}$ group, $R_{15}CO$— group, $R_{15}SO_2$— group, $R_{15}(R_{16})NCO$— group, and $R_{15}(R_{16})NSO_2$— group. Herein, $R_{15}$ is an aliphatic group, an aromatic group, or a heterocyclic group, and $R_{16}$ is a hydrogen atom, an aliphatic group, an aromatic group, or a heterocyclic group. In the some cases, $R_{11}$, $R_{12}$, and $R_{13}$ may be divalent groups, and combine together, forming a ring. Specific examples of the group represented in the formula (T-1) are as follows:

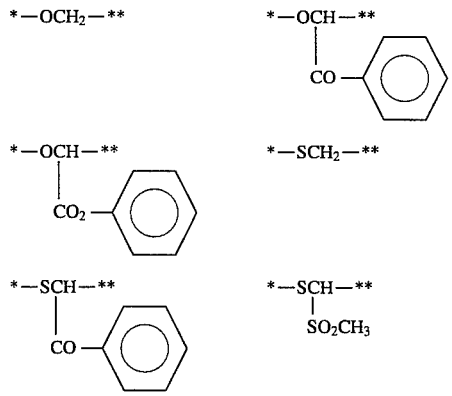

-continued

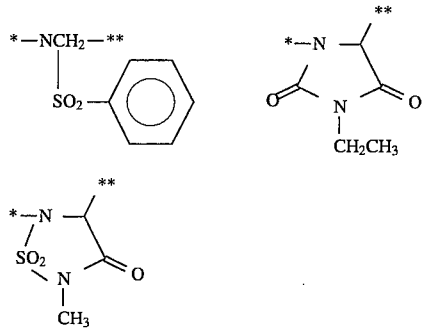

(2) Groups Causing a Cleavage Reaction by Using Intramolcular Nucleophilic Substitution Reaction An example of this group is the timing group disclosed in U.S. Pat. No. 4,248,292. This group is represented by the following formula (T-2):

Formula (T-2)

*—Nu—Link—E—**

In the formula (T-2), Nu is a nucleophilic group, e.g., an oxygen atom or a sulfur atom, E is an electrophilic group which can cleave the bond at the position ** by a nucleophilic attack of Nu, and Link is a linking group which links Nu and E in such a steric relation that Nu and E undergo an intramolecular nucleophilic substitution reaction. Specific examples of the group represented by the formula (T-2) are as follows:

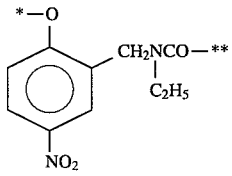

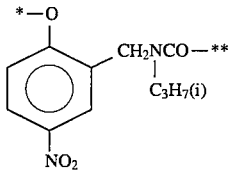

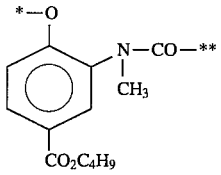

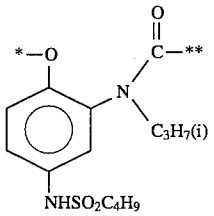

-continued

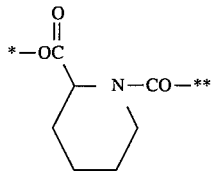

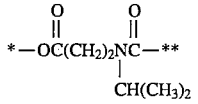

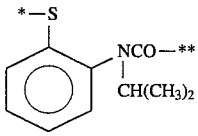

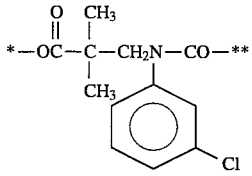

(3) Groups Causing a Cleavage Reaction by Using Electron Transfer along Conjugated System Example of this group are disclosed in, for example, U.S. Pat. Nos. 4,409,323 and 4,421,845, JP-A-57-188035, JP-A-58-98728, JP-A-58-209736, and JP-A-58-209738. This group is represented by the following formula (T-3):

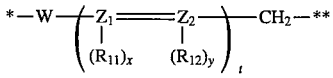

Formula (T-3)

In the formula (T-3), marks * and , W, $R_{11}$, $R_{12}$ and t are of the same meaning as explained in connection with the formula (T-1). However, $R_{11}$ and $R_{12}$ can bond together to form a benzene ring or a heterocyclic ring. $Z_1$ and $Z_2$ are independently a carbon atom or a nitrogen atom, and x and y are 0 or 1. If $Z_1$ is a carbon atom, x is 1. If $Z_1$ is a nitrogen atom, x is 0. $Z_2$ has the same relationship with y as $Z_1$ with x. In the formula (T-3), t is 1 or 2; if t is 2, the two $—[Z_1(R_{11})_x{=}Z_2(R_{12})_y]—$ groups can either be same or different. The $—CH_2—$ group, which is adjacent to the position , can be substituted by alkyl group having 1 to 6 carbon atoms or by phenyl group.

Specific examples of the group represented by the formula (T-3) are as follows:

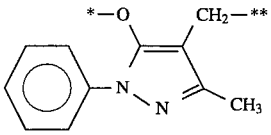

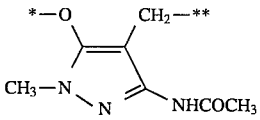

-continued

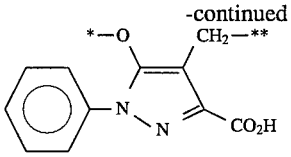

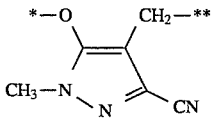

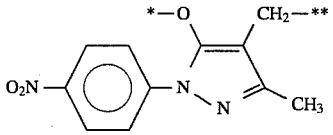

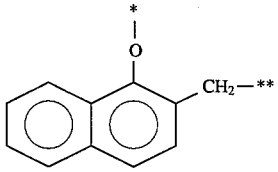

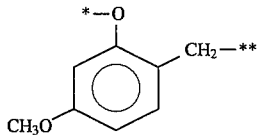

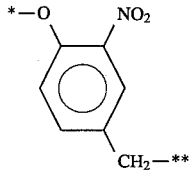

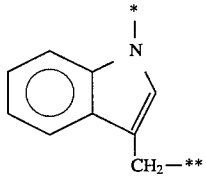

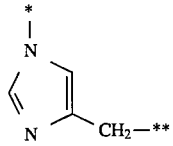

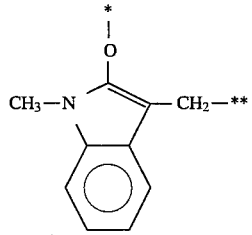

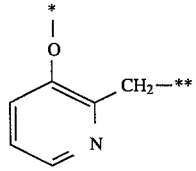

-continued

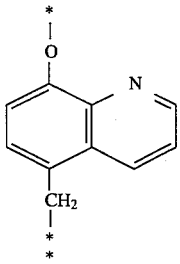

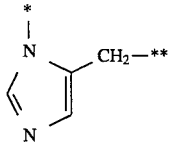

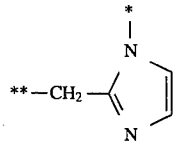

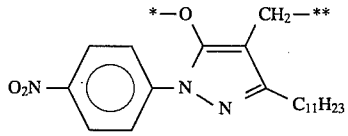

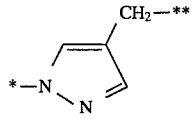

(4) Groups Utilizing a Cleavage Reaction Achieved by Hydrolysis of an Ester

An example of this group is the linking group disclosed in, for example, West German Laid-Open Patent Application 2,626,315. This group is represented by the following formulas (T-4) and (T-5), in which the marks * and ** are of the same meaning as explained in connection with the formula (T-1):

Formula (T-4)

*—OCO—**

Formula (T-5)

*—SCS—**

(5) Groups Utilizing a Cleavage Reaction of Iminoketal

An example of this group is the linking group disclosed in U.S. Pat. No. 4,546,073. This group is represented by the following formula (T-6):

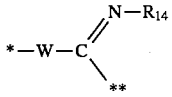

Formula (T-6)

In the formula (T-6), marks * and **, and W are of the same meaning as explained in connection with the formula (T-1). $R_{14}$ is equal to $R_{13}$. Specific examples of the group represented by the formula (T-6) are as follows:

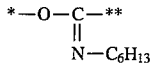

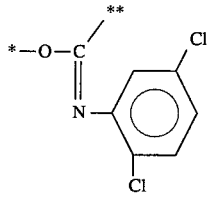

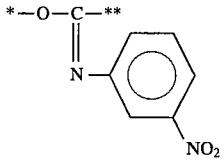

Preferable examples of $L_1$ are the groups of the formulas (T-1) to (T-5). Particularly preferable are the groups of the formulas (T-1), (T-3) and (T-4).

Preferably, j is 0 or 1.

In the formula (I), the group $L_2$ is a timing group with a valency of 3 or more. Preferable examples of $L_2$ are the groups represented by the following formulas (T-$L_1$) or (T-$L_2$):

Formula (T-$L_1$)

$$*—W—[Z_1—(R_{11})_x=Z_2(R_{12})_y]_t—CH_2—**$$

In the formula (T-$L_1$), W, $Z_1$, $Z_2$, $R_{11}$, $R_{12}$, x, y and t are of the same meaning as explained in connection with the formula (T-3). Mark * indicates the position where the group bonds to the $A—(L_1)_j—$ shown in the formula (I), and the mark ** indicates the position where the group bonds to the $—(L_3)_n—$PUG shown in the formula (I). When $R_{11}$ or $R_{12}$ is plural, at least one of $R_{11}$ and $R_{12}$ is a substituted or unsubstituted methylene group which bonds to $—(L_3)_n—$PUG.

A preferable examples of formula (T-$L_1$) is one wherein W is a nitrogen atom. An example more preferable is one wherein W and $Z_2$ bonds, forming a 5-membered ring. Particularly preferable is one in which W and $Z_2$ form an imidazole ring or a pyrazole ring.

Formula (T-$L_2$)

$$*—N—(Z_3—**)_2$$

In the formula (T-$L_2$), marks * and ** are of the same meaning as in the formula (T-$L_1$), $Z_3$ is a substituted or unsubstituted methylene group, and two $Z_3$ groups can be either same or different, and can bond with each other to form a ring.

Specific examples of the timing groups represented by the formulas (T-$L_1$) and (T-$L_2$) are as follows. Nonetheless, the timing groups used in the invention are not limited to these examples.

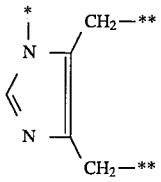

-continued

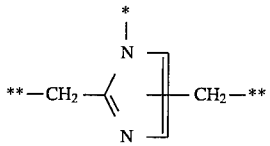

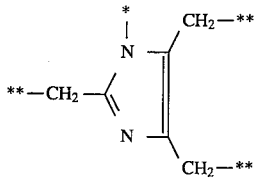

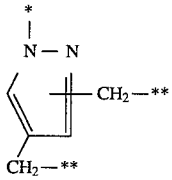

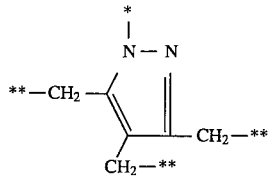

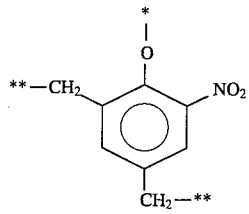

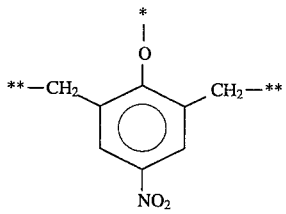

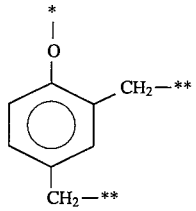

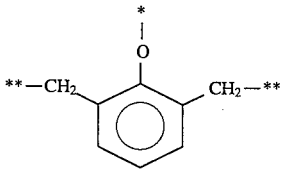

-continued

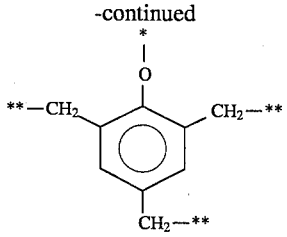

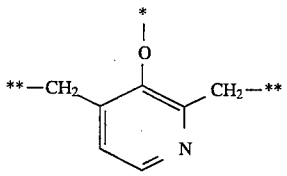

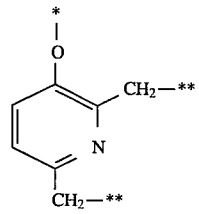

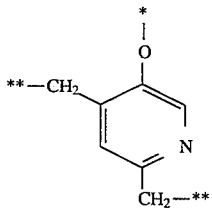

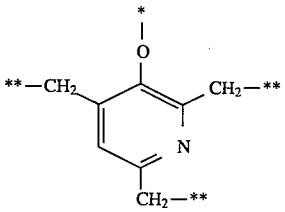

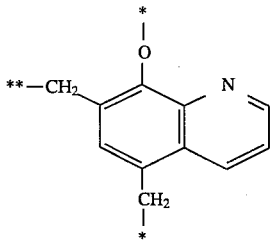

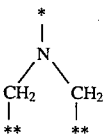

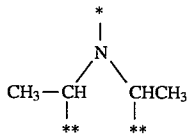

-continued

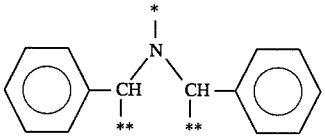

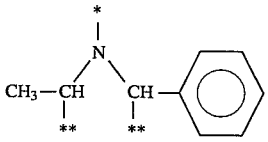

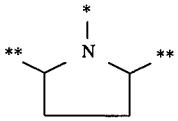

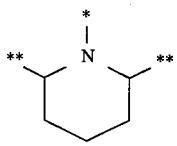

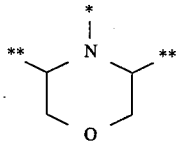

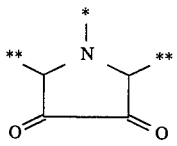

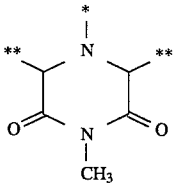

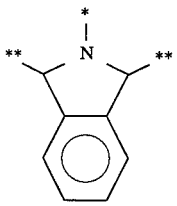

The specific examples of the timing groups, described above, can have a substituent. Examples of this substituent are: an alkyl group (e.g., methyl, ethyl, isopropyl, t-butyl, hexyl, methoxymethyl, methoxyethyl, chloroethyl, cyanoethyl, nitroethyl, hydroxypropyl, carboxyethyl, dimethylaminoethyl, benzyl, or phenetyl); an aryl group (e.g., phenyl, naphthyl, 4-hydroxyphenyl, 4-cyanophenyl, 4-nitrophenyl, 2-methoxyphenyl, 2,6-dimethylphenyl, 4-carboxyphenyl, or 4-sulfophenyl); a heterocyclic group (e.g., 2-pyridyl, 4-pyridyl, 2-furyl, 2-thienyl or 2-pyrrolyl; a halogen atom (e.g., chloro or bromo); a nitro group; an alkoxy group (e.g., ethoxy, methoxy, or isopropoxy); an aryloxy group (e.g., phenoxy); an alkylthio group (e.g., methylthio, isopropylthio, or t-butylthio); an arylthio group (e.g., phenylthio); an amino group (e.g., amino, dimethylamino, or diisopropylamino); an acylamino group (e.g., acetylamino or benzoylamino); a sulfonamide group (e.g., methanesulfonamide or benzenesulfonamide); a cyano group; a carboxyl group; an alkoxycarbonyl group (e.g., methoxycarbonyl or ethoxycarbonyl); an aryloxycarbonyl group (e.g., phenoxycarbonyl); and a carbamoyl group (e.g., N-ethylcarbamoyl or N-phenylcarbamoyl).

Of these substituents, preferable are an alkyl group, a nitro group, an alkoxy group, an alkylthio group, an amino group, an acylamino group, a sulfonamide group, an alkoxycarbonyl group, and a carbamoyl group.

In the formula ($T\text{-}L_1$), the —$CH_2$— group, which is adjacent to the position **, can be substituted by an alkyl group having 1 to 6 carbon atoms or a phenyl group.

In the formula (I), m is preferably 1.

The group represented by $L_3$ is equal to $L_1$.

n is 0 or 1, preferably 0.

The photographically useful group, represented by PUG in the formula (I), is, for example, an development inhibitor, a dye, a fogging agent, a developing agent, a coupler, a breaching accelerator, or a fixing accelerator. Preferable examples of the photographically useful group are the photographically useful group disclosed in U.S. Pat. No. 4,248,962 (i.e., the group represented by the formula PUG in the patent specification), the dye disclosed in JP-A-62-49353 (i.e., a portion of a split-off group released from a coupler in the specification), the development inhibitor described in U.S. Pat. No. 4,477,563, and the breaching accelerators disclosed in JP-A-61-201247 and JP-A-2-55 (i.e., a portion of a split-off group released from couplers in the specification). In the present invention, particularly preferable as photographically useful group is a development inhibitor.

Preferable examples of the development inhibitor are the groups represented by the following formulas (INH-1), (INH-2) and (INH-4) to (INH-13):

(INH-1)

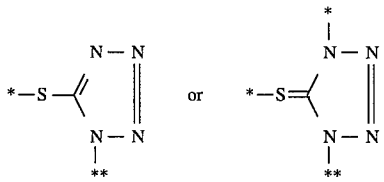

(INH-2)

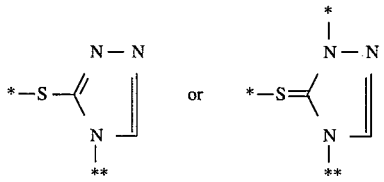

(INH-4)

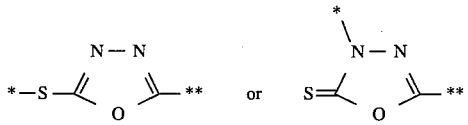

(INH-5)

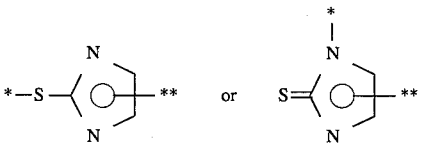

(INH-6)

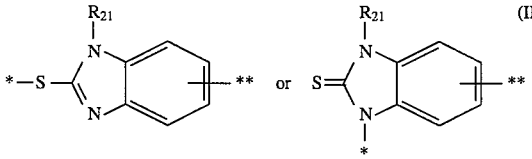

(INH-7)

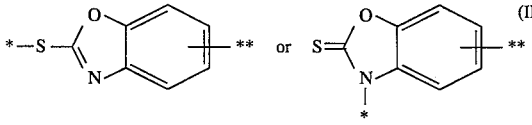

(INH-8)

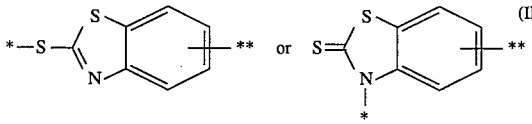

-continued (INH-9)

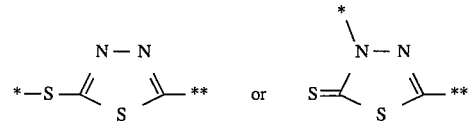

(INH-10)

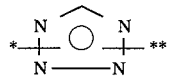

(INH-11)

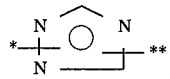

(INH-12)

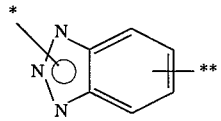

(INH-13)

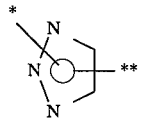

$R_{21}$ shown in the formula (INH-6) is a hydrogen atom or a substituted or unsubstituted hydrocarbon group (e.g., methyl, ethyl, propyl, or phenyl).

In the formulas (INH-1) to (INH-13), the mark * indicates a position to be bonded to a group represented by $L_2$ or $L_3$ of a compound represented by the formula (I), and the mark ** indicates a position to be bonded to a substituent. Examples of the substituent can be a substituted or unsubstituted alkyl group, aryl group, heterocyclic group, alkylthio group, alkyloxycarbonyl group, or aryloxycarbonyl group. These substituents preferably comprise the group which can be decomposed in a process solution during photographic processing.

More specifically, examples of the substituted or unsubstituted alkyl group are: methyl, ethyl, propyl, butyl, hexyl, decyl, isobutyl, t-butyl, 2-ethylhexyl, 2-methylthioethyl, benzyl, 4-methoxybenzyl, phenetyl, 1-methoxycarbonylethyl, propyloxycarbonylmethyl, 2-(propyloxycarbonyl-)ethyl, butyloxycarbonylmethyl, pentyloxycarbonylmethyl, 2-cyanoethyloxycarbonylmethyl, 2,2-dichloroethyloxycarbonylmethyl, 3-nitropropyloxy carbonylmethyl, 4-nitrobenzyloxycarbonylmethyl, 2,5-dioxo-3,6-dioxadecyl.

Specific examples of the substituted or unsubstituted aryl group are: phenyl, naphthyl, 4-methoxycarbonylphenyl, 4-ethoxycarbonylphenyl, 2-methylthiophenyl, 3-methoxycarbonylphenyl, and 4-(2-cyanoethyloxycarbonyl)-phenyl.

Examples of the substituted or unsubstituted heterocyclic group are: 4-pyridyl, 3-pyridyl, 2-pyridyl, 2-furyl, and 2-tetrahydropyranyl.

Examples of the substituted or unsubstituted alkylthio group are: methylthio, t-butylthio, 1-methoxycaronylethylthio.

Examples of the substituted or unsubstituted alkyloxycarbonyl or aryloxycarbonyl group are: methoxycarbonyl, butoxycarbonylmethoxycarbonyl, isopentyloxycarbonylmethoxycarbonyl, N-hexylcarbamoylmethoxycarbonyl, phenoxycarbonyl.

Of the development inhibitors exemplified above, preferable are (INH-1), (INH-2), (INH-3), (INH-4), (INH-9) and (INH-12). Particularly desirable are (INH-1), (INH-2), and (INH-3).

Preferable as the substituent which bonds to the INH is an alkyl group, a substituted or unsubstituted phenyl group, an alkyl- or aryloxycarbonyl group.

Particularly preferred as the compound represented by the formula (I) are those which are represented by the following formulas (Ia) and (Ib):

Formula (Ia)

$$A—(L_1)_j—W—[Z_1—(R_{11})_x=Z_2(R_{12})_y]_t—CH_2—PUG$$

Formula (Ib)

$$A—(L_1)—N—(Z_3—PUG)_2$$

All notations in the formulas (Ia) and (Ib) are of the same meaning as has been explained in conjunction with the formulas (I), (T-$L_1$), and (T-$L_2$). In the formula (Ia), j is preferably 0 or 1. In the formulas (Ia) and (Ib), preferable as $L_1$ is —OC(=O)— group, and preferable as PUG is a development inhibitor.

If photographically useful groups used have different functions, the timing group is not one which utilizes intramolecular nucleophilic substitution.

The "function of a photographically useful group" means a function exhibited by, e.g., a development inhibitor, a dye, a fogging agent, a developing agent, a coupler, a bleach accelerator, or a fixing agent.

It is particularly desirable that two or more PUGs released from the same compound be same development inhibitors.

The compound represented by the formula (II) will now be described. In the formula (II), A and PUG are of the same meaning as defined in conjunction with the formula (I). $L_4$ is —OCO— group, —OSO— group, —$OSO_2$— group, —OCS— group, —SCO— group, —SCS— group, or —$WCR_{11}R_{12}$— group. W, $R_{11}$, and $R_{12}$ are of the same meaning as defined in connection with the formula (T-1) which is described as an example of $L_1$ in the formula (I).

If $L_4$ is —$WCR_{11}R_{12}$— group, it is desirable that W be an oxygen atom or a tertiary amino group. More preferably, $L_4$ is an —$OCH_2$— group, or the group where W and $R_{11}$ or $R_{12}$ forms a ring. If $L_4$ is a group other than —$WCR_{11}R_{12}$—, it is preferably —OCO— group, —OSO— group, or —$OSO_2$— group, of which the most preferred is —OCO— group.

The group represented by $L_5$ is a group which releases PUG by electron transfer along a conjugated system and can bond to $L_4$ through a nitrogen atom. The group releasing PUG by electron transfer along the conjugated system is equal to the group represented by the formula (T-3), which has been explained in conjunction with $L_1$ in the formula (I).

Preferable examples of the compounds represented by the formula (II) are those which are represented by the following formulas (III) or (IV):

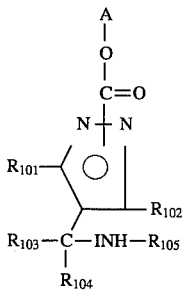

Formula (III)

The formula (III) represents either one of the following two formulas:

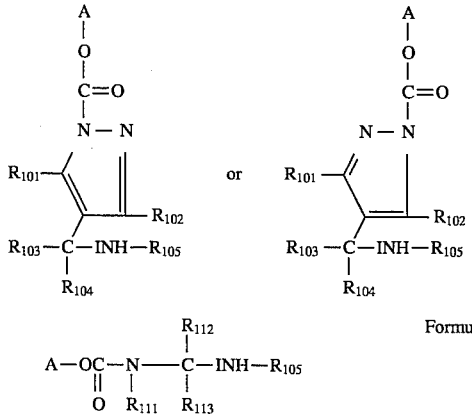

Formula (IV)

In the formula (III), A has the same meaning as in the formula (I). $R_{101}$ and $R_{102}$ are independently a hydrogen atom or a substituent. $R_{103}$ and $R_{104}$ are independently a hydrogen atom or a substituent. INH is a group which can inhibit development. $R_{105}$ is an unsubstituted phenyl, primary alkyl group or alkythio group, a primary alkyl group substituted by a group other than an aryl group, or the group represented by —$CO_2C(R_{107})R_{108}CO_2R_{106}$. At least one of groups $R_{101}$ to $R_{104}$ is a substituent other than a hydrogen atom. $R_{106}$ represents an alkyl group. $R_{107}$ and $R_{108}$ are hydrogen atoms or alkyl groups.

The compounds of the formula (IV) will be described in detail. In the formula (IV), A, INH, and $R_{105}$ are equal to those defined in the formula (III), and $R_{111}$, $R_{112}$, and $R_{113}$ are independently a hydrogen atom or an organic residue. Any two of $R_{111}$, $R_{112}$, and $R_{113}$ can be divalent groups bonding together, forming a ring.

The compound of the formula (III) will be described in greater detail.

In the formula (III), A is of the same meaning as in the formula (I). $R_{101}$ and $R_{102}$ are independently a hydrogen atom or a substituent. Specific examples of the substituent are: an aryl group (e.g., phenyl, naphthyl, p-methoxyphenyl, p-hydroxyphenyl, p-nitrophenyl, or o-chlorophenyl); an alkyl group (e.g., methyl, ethyl, isopropyl, propyl, tert-butyl, tert-amyl, isobutyl, sec-butyl, octyl, methoxymethyl, 2-methoxyethyl, 2-chloroethyl, nitromethyl, 2-cyanoethyl, 2-carbamoylethyl, or 2-dimethylcarbamoylethyl); a halogen atom (e.g., fluoro, chloro, bromo, or iodo); an alkoxy group (e.g., methoxy, ethoxy, isopropyloxy, propyloxy, tert-butyloxy, isobutyloxy, butyloxy, octyloxy, 2-methoxyethoxy, or 2-chloroethoxy); an aryloxy group (e.g., phenoxy, naphthoxy, or p-methoxyphenoxy); an alkylthio group (e.g., methylthio, ethylthio, isopropylthio, propylthio, tert-butylthio, isobutylthio, secbutylthio, octylthio, or 2-methoxyethylthio); an arylthio group (e.g., phenylthio, naphthylthio, or p-methoxyphenylthio); an amino group (e.g., amino, methylamino, phenylamino, dimethylamino, diethylamino, diisopropylamino, or phenylmethylamino); a carbamoyl group (e.g., carbamoyl, methylcarbamoyl, dimethylcarbamoyl, diethylcarbamoyl, diisopropylcarbamoyl, ethylcarbamoyl, isopropylcarbamoyl, tert-butylcarbamoyl, phenylcarbamoyl, or phenylmethylcarbamoyl); a sulfamoyl group (e.g., sulfamoyl, methylsulfamoyl, ethylsulfamoyl, isopropylsulfamoyl, phenylsulfamoyl, octylsulfamoyl, dimethylsulfamoyl, diethylsulfamoyl, diisopropylsulfamoyl, dihexylsulfamoyl, or phenylmethylsulfamoyl); an alkoxycarbonyl group (e.g., methoxycarbonyl, propyloxycarbonyl, isopropyloxycarbonyl, tert-butyloxycarbonyl, tert-amyloxycarbonyl, or octyloxycarbonyl); an aryloxycarbonyl group (e.g., phenoxycarbonyl or p-methoxyphenoxycarbonyl); an acylamino group (e.g., acetylamino, propanoylamino, pentanoylamino, N-methylacetylamino, or benzoylamino); a sulfonamido group (e.g., methanesulfonamido, ethanesulfonamido, pentanesulfonamido, benzenesulfonamido, or p-toluenesulfonamido); an alkoxycarbonylamino group (e.g., methoxycarbonylamino, isopropyloxycarbonylamino, tert-butoxycarbonylamino, or hexyloxycarbonylamino); an aryloxycarbonylamino group (e.g., phenoxycarbonylamino); an ureido group (e.g., 3-methylureido or 3-phenylureido); a cyano group, and a nitro group.

$R_{101}$ and $R_{102}$ can be same or different. However, it is desirable that the sum of their formula weights be less than 120. Preferable as substituents are an alkyl group, a halogen atom, or an alkoxy group. An alkyl group is preferred in particular.

In the formula (III), the groups represented by $R_{103}$ and $R_{104}$ are independently a hydrogen atom or an alkyl group. Examples of the alkyl group are methyl, ethyl, isopropyl, tert-butyl, isobutyl, hexyl, and 2-methoxyethyl. Preferable as $R_{103}$ and $R_{104}$ are a hydrogen atom, a methyl group, or an ethyl group. A hydrogen atom is particularly preferred.

In the formula (III), the group represented by $R_{105}$ is an unsubstituted phenyl, primary alkyl group or alkylthio group, a primary alkyl group substituted by a group other than an aryl group, or the group represented by $—CO_2C(R_{107})R_{108}CO_2R_{106}$. Examples of the alkyl group are: ethyl, propyl, butyl, isobutyl, pentyl, isopentyl, 2-methylbutyl, hexyl, 2-methylpentyl, 3-methylpentyl, 4-methylpentyl, 2-ethylbutyl, heptyl, and octyl. Examples of the substituent are: a halogen atom, an alkoxy group, an alkylthio group, an amino group, a carbamoyl group, a sulfamoyl group, an alkoxycarbonyl group, an acylamino group, a sulfonamido group, an alkoxycarbonylamino group, an ureido group, a cyano group, and a nitro group. Specific examples of each of these groups are all groups exemplified as $R_{101}$ and $R_{102}$, except for groups containing aryl groups.

$R_{106}$ is an unsubstituted alkyl group having 3 to 6 carbon atoms (e.g., propyl, butyl, isobutyl, pentyl, isopentyl, or hexyl).

$R_{107}$ and $R_{108}$ are hydrogen atoms, or unsubstituted alkyl groups having 1 to 8 carbon atoms (e.g., methyl, ethyl, propyl, isopropyl, butyl, pentyl, isopentyl, hexyl, octyl), and $R_{107}$ and $R_{108}$ can be same or different.

$R_{105}$ may be substituted by two or more types of substituents. Substituents preferable for $R_{105}$ are: fluoro, chloro, an alkoxy group, a carbamoyl group, an alkoxycarbonyl group, a cyano group, or a nitro group. Of these, particularly preferable is an alkoxycarbonyl group.

Preferable as $R_{105}$ are: a phenyl group, an unsubstituted primary alkyl group having 2 to 6 carbon atoms, the group $—CO_2C(R_{107})R_{108}CO_2R_{106}$ wherein $R_{106}$ is an unsubstituted alkyl group having 3 to 6 carbon atoms and both of $R_{107}$ and $R_{108}$ are hydrogen, or a primary alkyl group substituted by a group exemplified as a preferable substituent of $R_{105}$.

More preferably, $R_{105}$ is an unsubstituted primary alkyl group having 3 to 5 carbon atoms, or a primary alkyl group substituted by an alkoxycarbonyl group.

In the formula (III), the group represented by INH is a group which can effect development inhibition. Specific examples of this group are the inhibitors (INH-1) to (INH-13) which have been specified in connection with the PUG shown in the formula (I). Other comments on the INH, including preferable scope thereof, is same as that described in connecion with formula (I).

The compound of the formula (IV) will now be described in greater detail.

First, the case where $R_{111}$, $R_{112}$, and $R_{113}$ are independently a hydrogen atom or a monovalent organic group will be described.

If $R_{112}$ and $R_{113}$ are monovalent organic groups, they are preferably alkyl groups (e.g., methyl or ethyl), or aryl groups (e.g., phenyl). preferable is the case where either $R_{112}$ or $R_{113}$, or both are hydrogen atoms. Particularly preferable is the case where both $R_{112}$ and $R_{113}$ are hydrogen atoms.

$R_{111}$ is an organic group. Preferable examples of this organic group are: an alkyl group (e.g., methyl, isopropyl, butyl, isobutyl, tert-butyl, sec-butyl, neopentyl, or hexyl); an aryl group (e.g., phenyl), an acyl group (e.g., acetyl or benzoyl); a sulfonyl group (e.g., methanesulfonyl or benzensulfonyl); a carbamoyl group (e.g., ethylcarbamoyl or phenylcarbamoyl); a sulfamoyl group (e.g., ethylsulfamoyl or phenylsulfamoyl); an alkoxycarbonyl group (e.g., ethoxycarbonyl or butoxycarbonyl); an aryloxycarbonyl group (e.g., phenoxycarbonyl or 4-methylphenoxycarbonyl); an alkoxysulfonyl group (e.g., butoxysulfonyl or ethoxysulfonyl); an aryloxysulfonyl group (e.g., phenoxysulfonyl or 4-methoxyphenoxysulfonyl); a cyano group; a nitro group; a nitroso group; a thioacyl group (e.g., thioacetyl or thiobenzoyl); a thiocarbamoyl group (e.g., ethylthiocar bamoyl); an imidoyl group (e.g., N-ethylimidoyl); an amino group (e.g., amino, dimethylamino, or methyl amino); an acylamino group (e.g., formylamino, acetyl amino, or N-methylacetylamino); an alkoxy group (e.g., methoxy or isopropyloxy); and an aryloxy group (e.g., phenoxy).

These groups may have a substituent. Examples of the substituent are those exemplified as $R_{111}$, a halogen atom (e.g., fluoro, chloro or bromo), a carboxyl group, and a sulfo group.

Preferably, $R_{111}$ has 15 or less atoms other than hydrogen atoms.

More preferable as $R_{111}$ is a substituted or unsubstituted alkyl or aryl group. Particularly preferred is a substituted or unsubstituted alkyl group.

The case, where two of the groups represented by $R_{111}$, $R_{112}$, and $R_{113}$ are divalent groups bonding together and form a ring, will now be explained.

The ring, thus formed, is preferably a 4- to 8-membered ring, more preferably a 4- to 6-membered ring.

Desirable as the divalent groups are: $—C(=O)—N(R_{114})—$, $—SO_2—N(R_{114})—$, $—(CH_2)_3—$, $—(CH_2)_4—$, $—(CH_2)_5—$, $—C(=O)—(CH_2)_2—$, $—C(=O)—N(R_{114})—C(=O)—$, $—SO_2—N(R_{114})—C(=O)—$, $—C(=O)—C(R_{114})(R_{115})—$, and $—(CH_2)_2—O—CH_2—$.

In these notations, $R_{114}$ and $R_{115}$ are independently a hydrogen atom, or equal to $R_{111}$ which represents a monovalent organic group. $R_{114}$ and $R_{115}$ can either be the same or different.

Of $R_{111}$, $R_{112}$, and $R_{113}$, any one which is other than the divalent group forming a ring mentioned above is a hydrogen atom or a monovalent organic group. Specific examples of the organic group are equal to those exemplified as $R_{111}$, $R_{112}$, and $R_{113}$ for the case where $R_{111}$, $R_{112}$, and $R_{113}$ form no rings.

If two of $R_{111}$, $R_{112}$, and $R_{113}$ bond together, forming a ring, it is desirable that one of $R_{112}$ and $R_{113}$ is a hydrogen atom, and the other bonds to $R_{111}$, thus forming a ring, and it is more preferable that the divalent group have their left ends bonded to the nitrogen atom of the compound represented by the formula (IV), and their right ends bonded to the carbon atom.

Also, preferable as $R_{111}$, $R_{112}$, and $R_{113}$ are groups which form no ring and which are independently a hydrogen atom or a monovalent organic group.

In the formulas (I) and (II), each of the formula weight of the residues which are obtained by removing two groups represented by A and PUG from the formula (I) or (II) respectively, is preferably 64 to 240, more preferably 70 to 200, and still more preferably 90 to 180.

Specific examples of the compounds represented by the formulas (I) to (IV) will be presented below. Nonetheless, compounds for use in the present invention are not limited to these examples.

Of the compounds exemplified below, those of the formula (I), in which A is a coupler residue, are labeled with "CA," those of the formulas (II) to (IV), in which A is a coupler residue, are labeled with "CB," and those of the formulas (I) to (IV), in which A is a redox group, are labeled with "SA."

(CA-1)

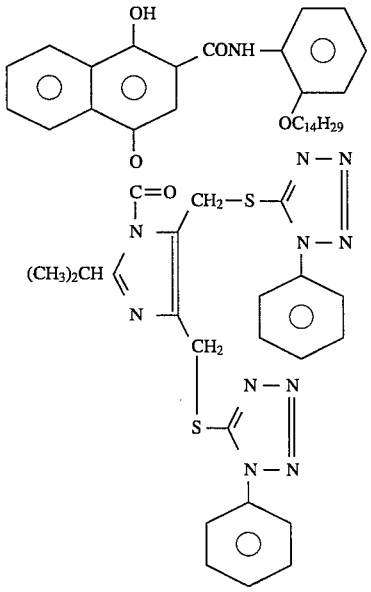

(CA-2)

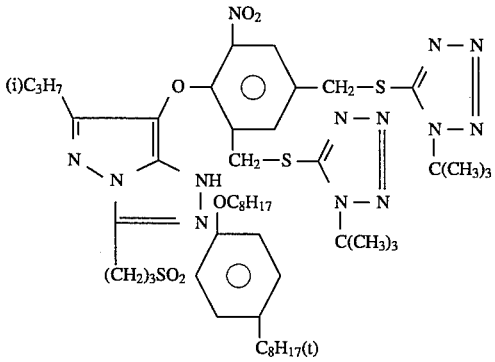

(CA-3)

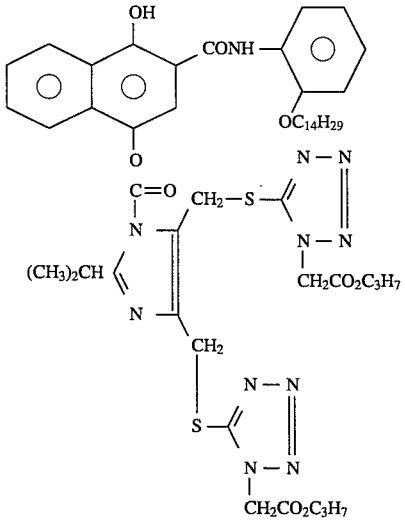

(CA-4)

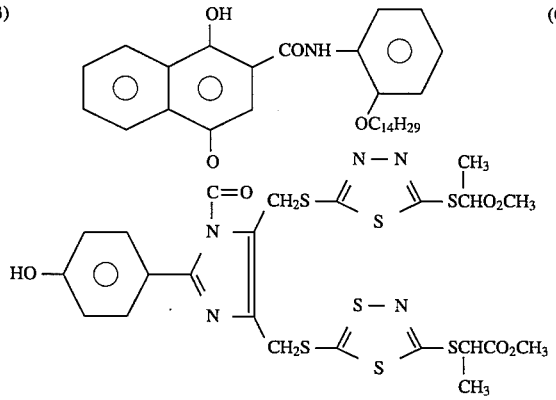

-continued
(CA-5)
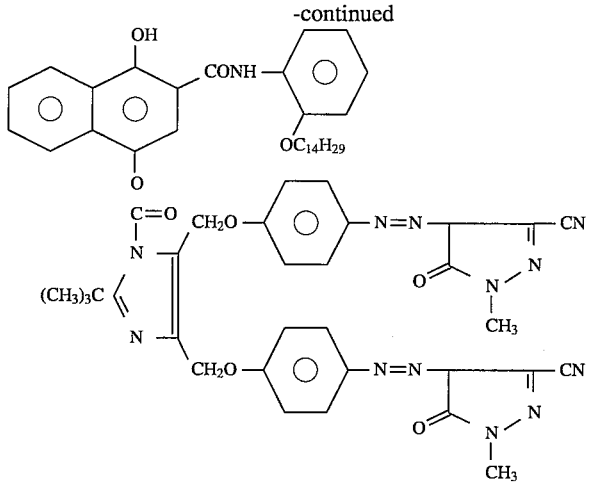
(CA-6)
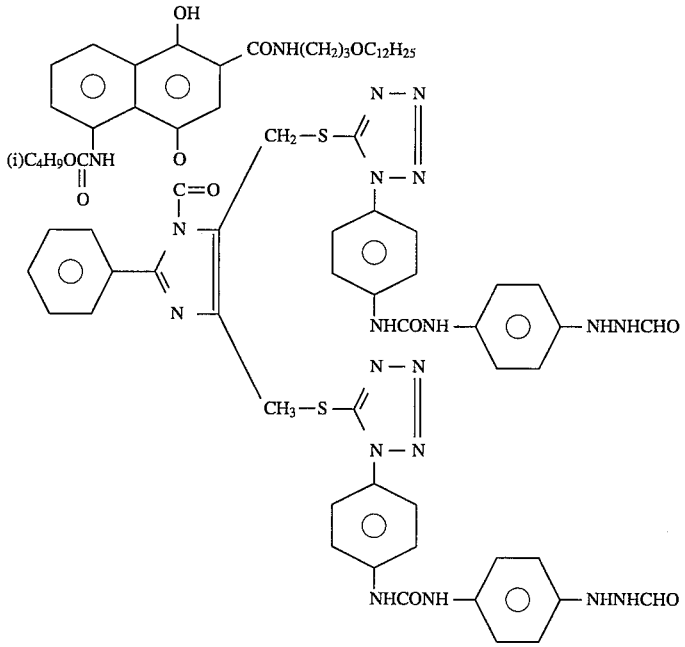
(CA-7)
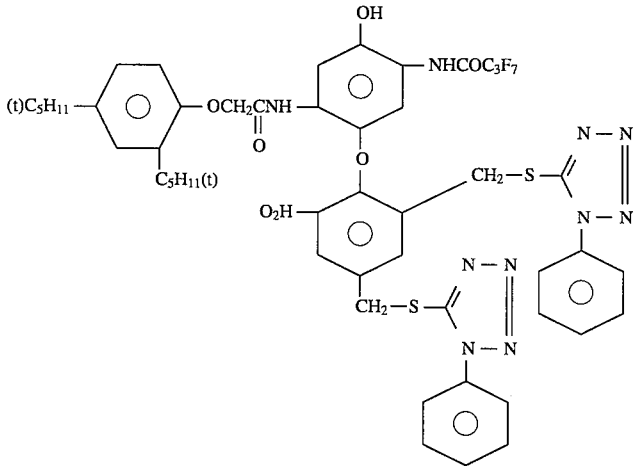

-continued
(CA-8)
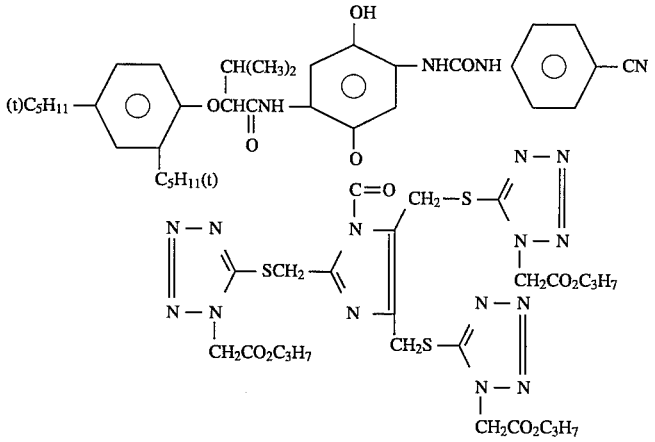
(CA-9)
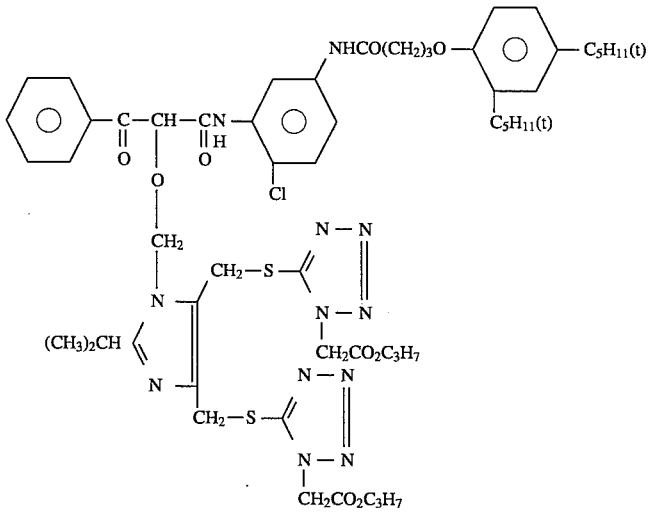
(CA-10)
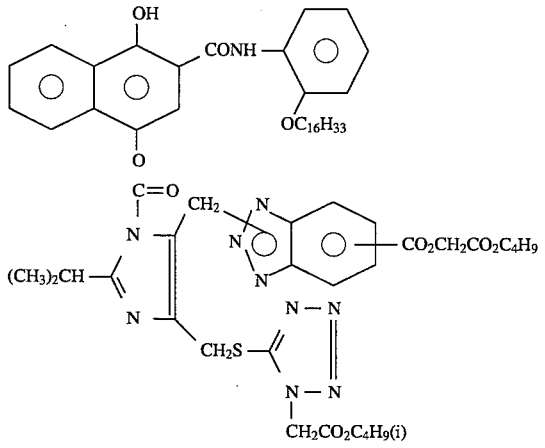

-continued
(CA-11)
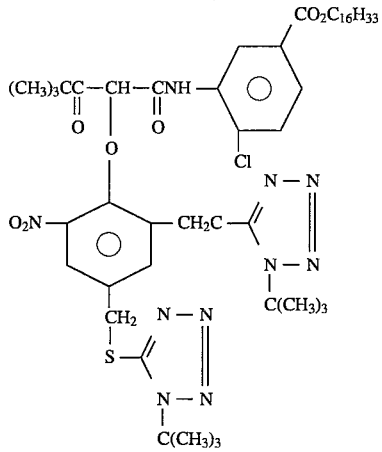
(CA-12)
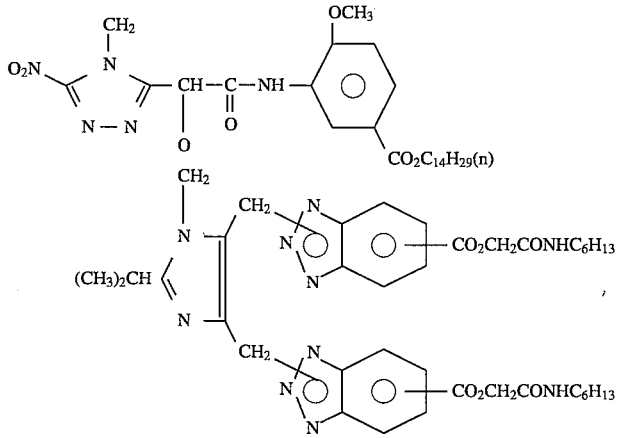
(CA-13)
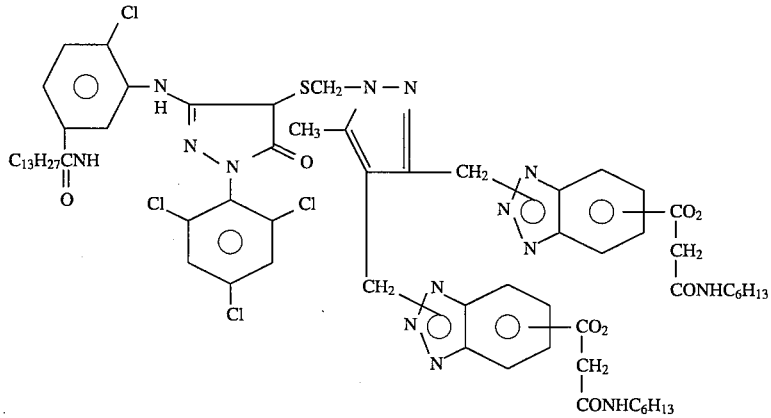
(CA-14)
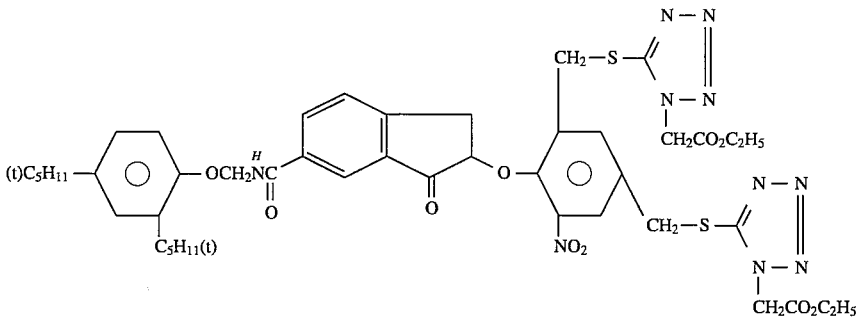

-continued
(CA-15)
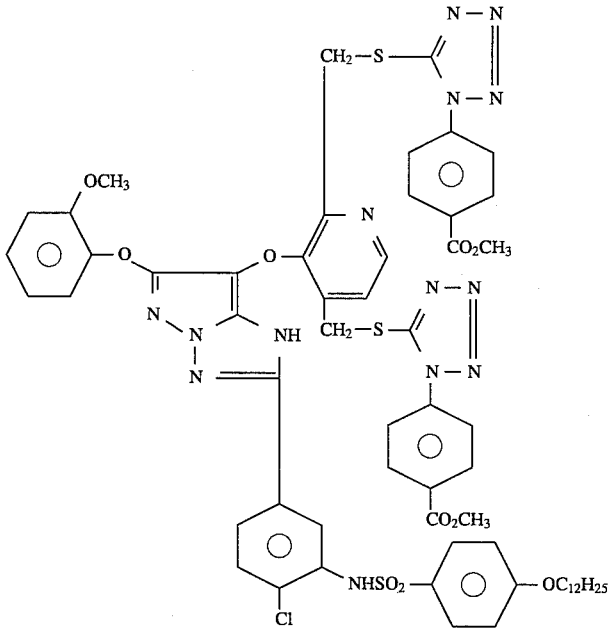
(CA-16)
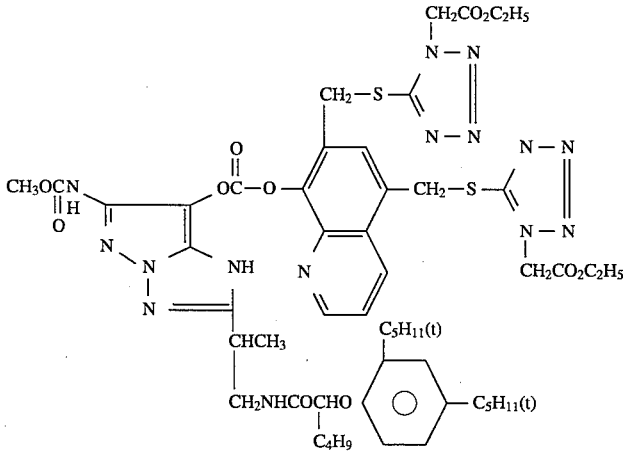
(CA-17)
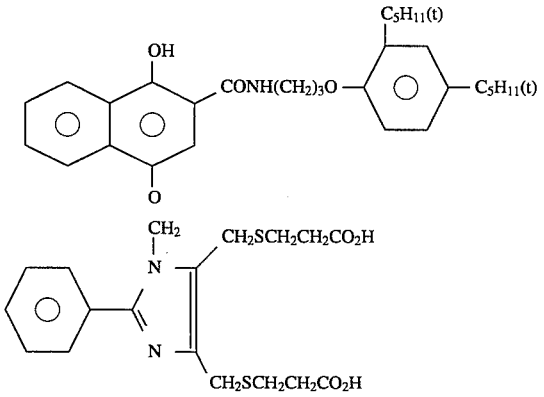

-continued
(CA-18)
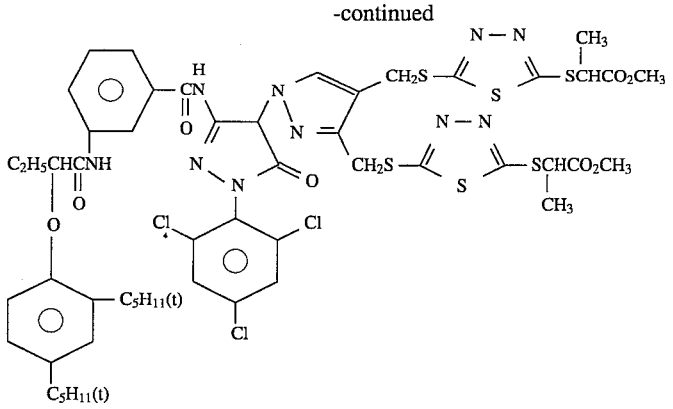
(CA-19)
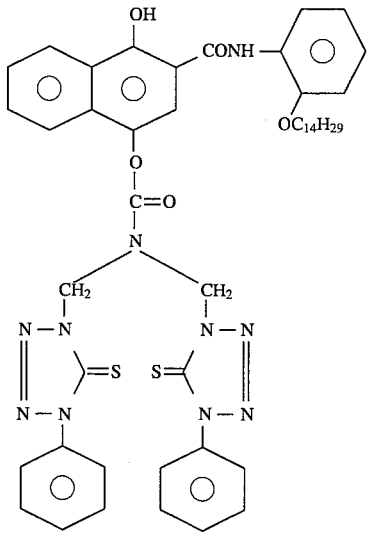
(CA-20)
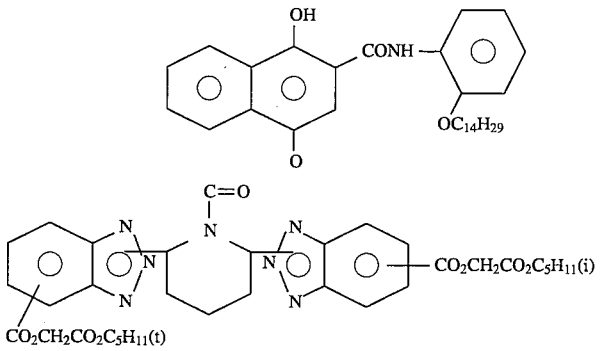

-continued
(CA-21)
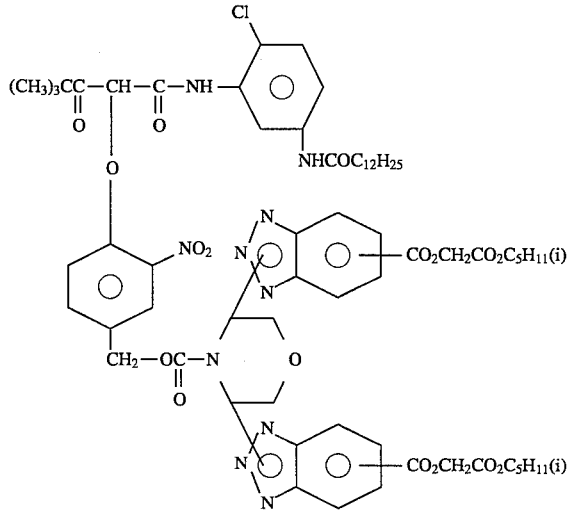
(CA-22)
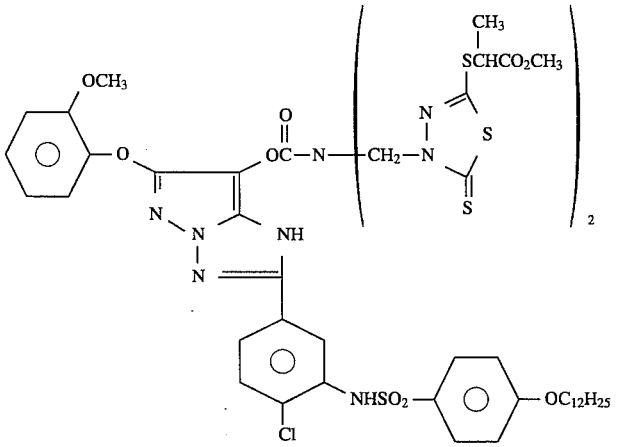
(CA-23)
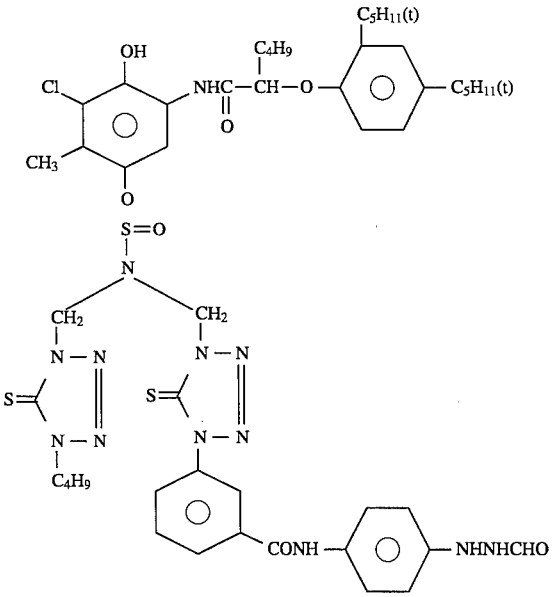

-continued
(CB-1)
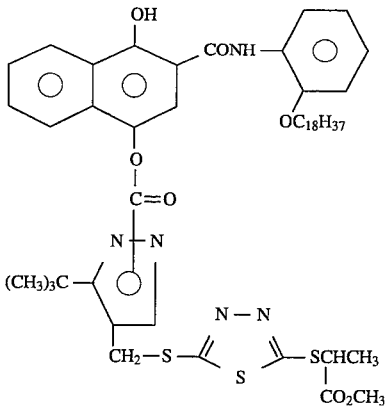
(CB-2)
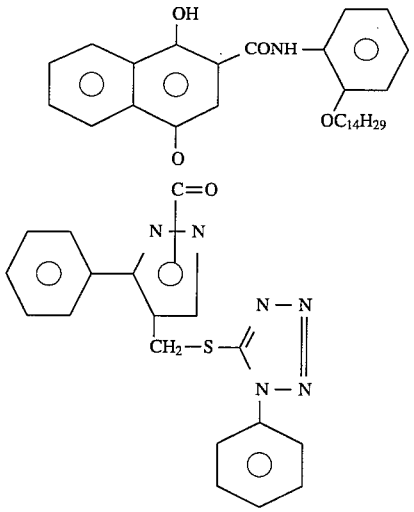
(CB-3)
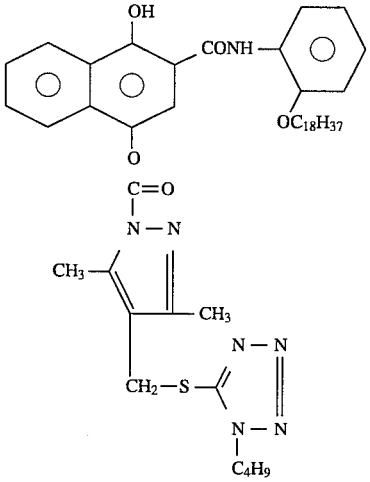
(CB-4)
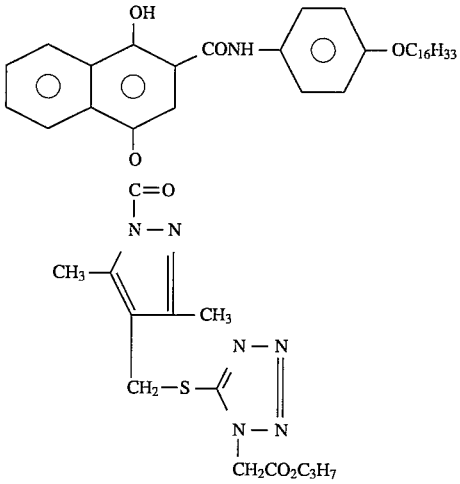
(CB-5)
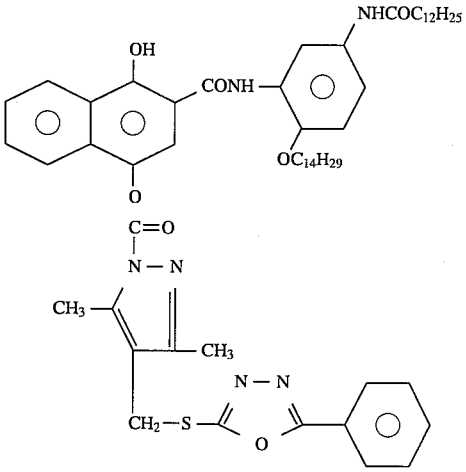

-continued
(CB-6)
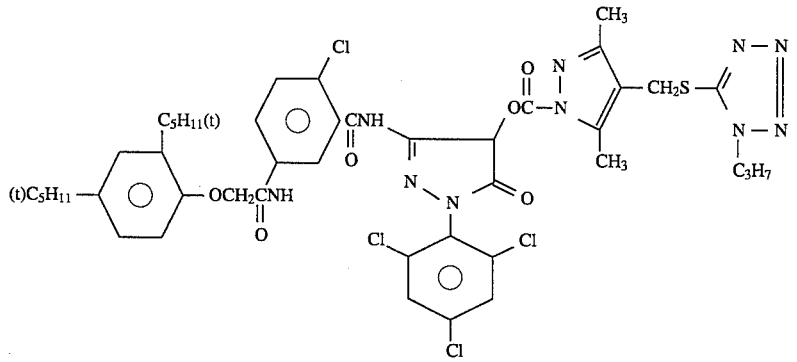
(CB-7)
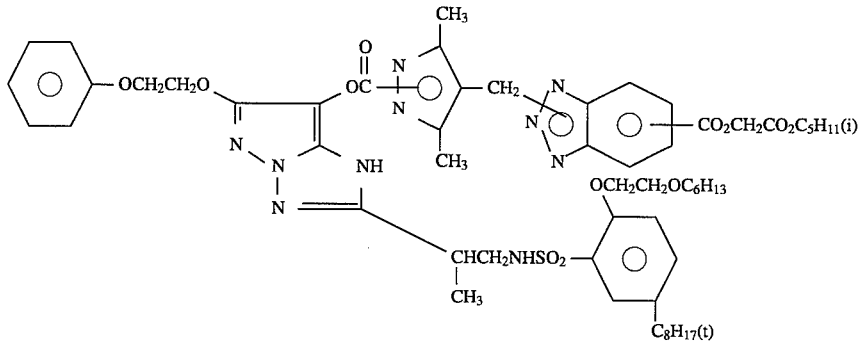
(CB-8)
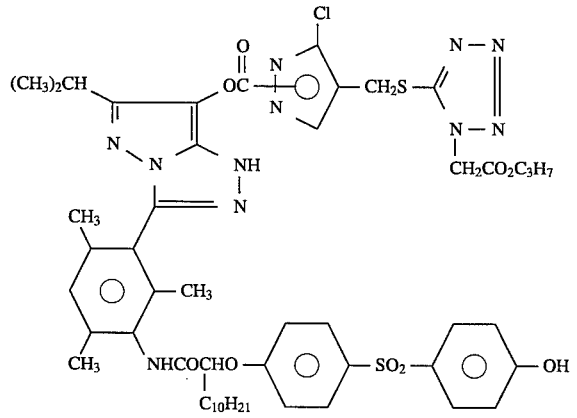
(CB-9)
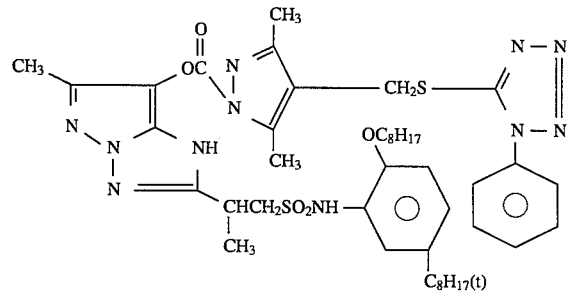

-continued
(CB-10)
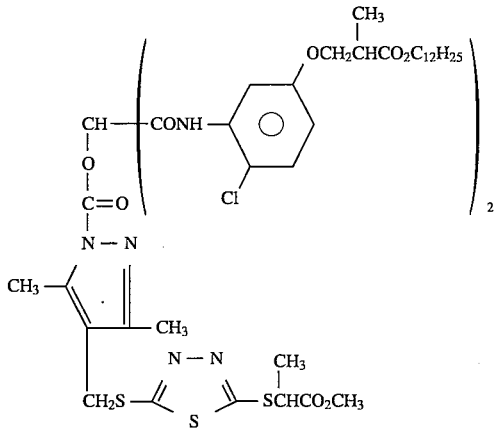
(CB-11)
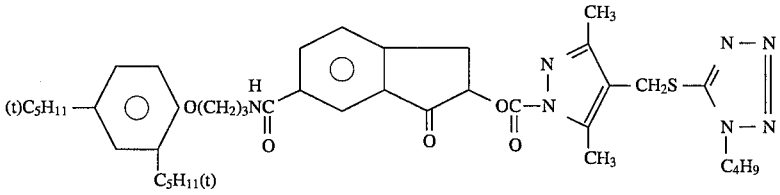
(CB-12)
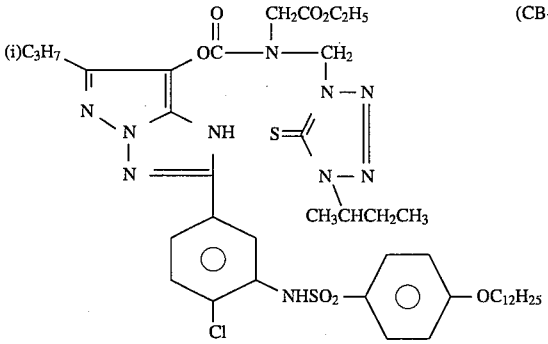
(CB-13)
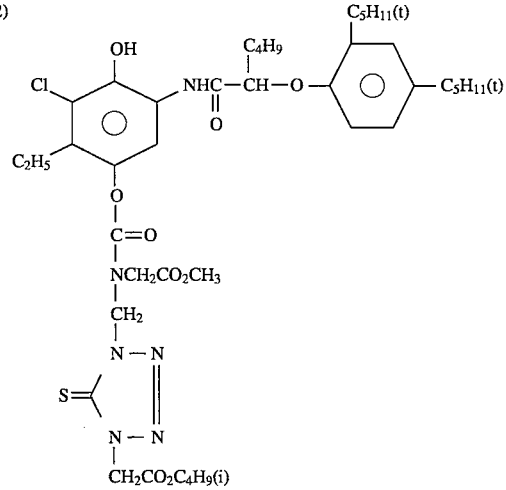
(CB-14)
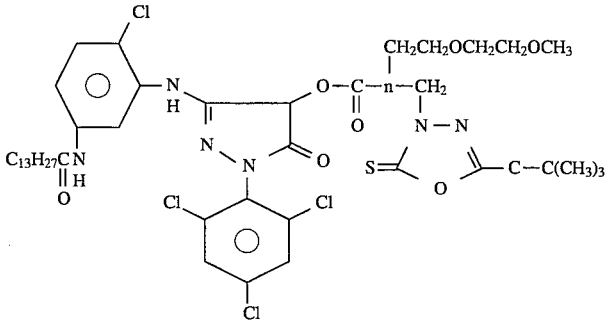

-continued
(CB-15)
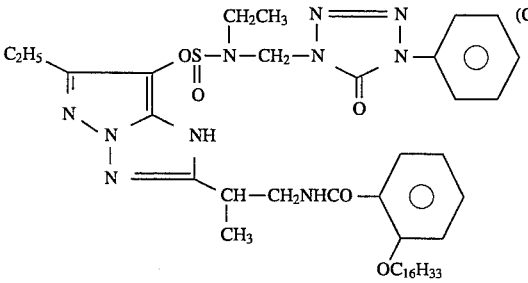
(CB-16)
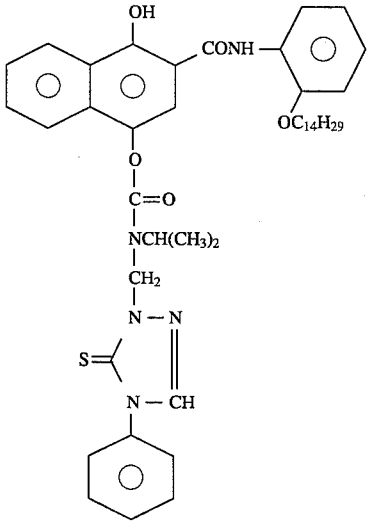
(CB-17)
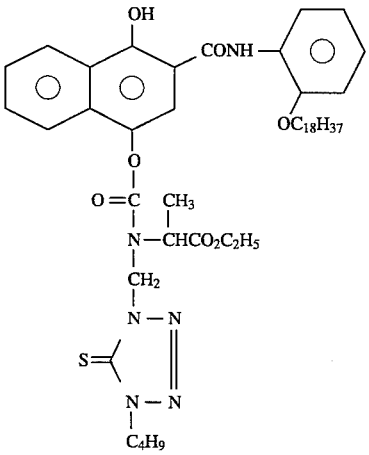
(CB-18)
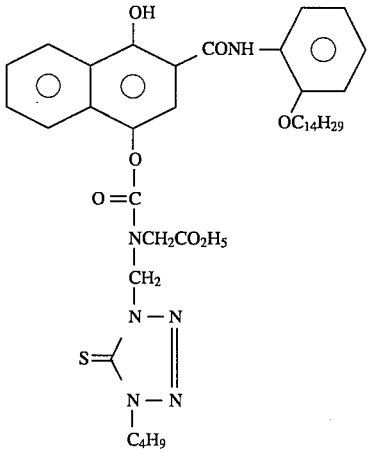
(CB-19)
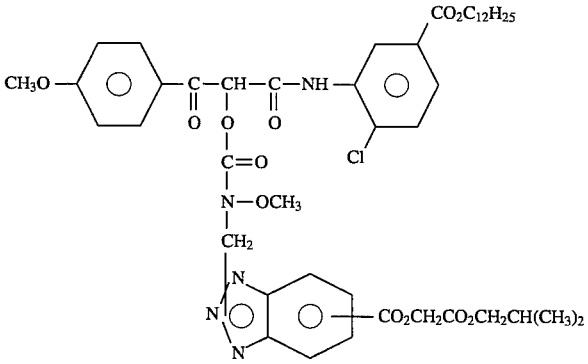

-continued
(CB-20)
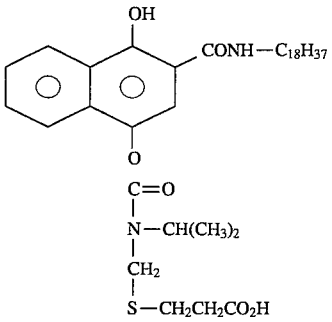
(CB-21)
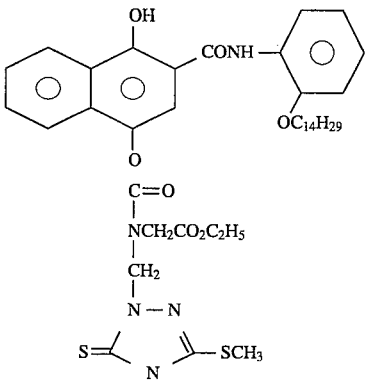
(CB-22)
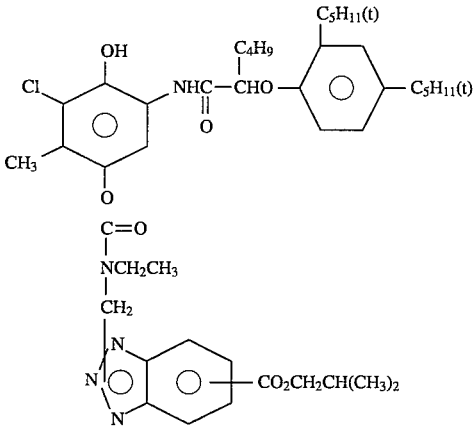
(CB-23)
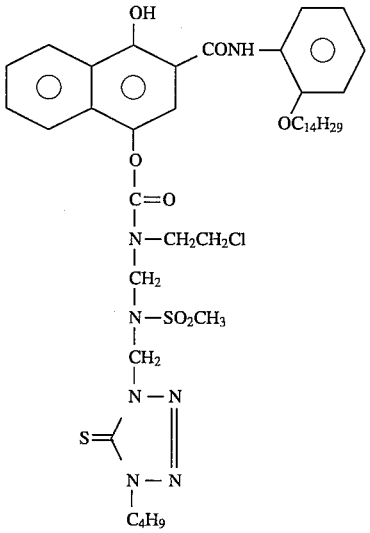
(CB-24)
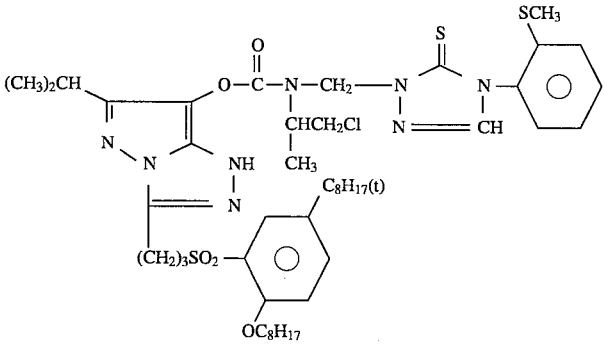

-continued
(CB-25)
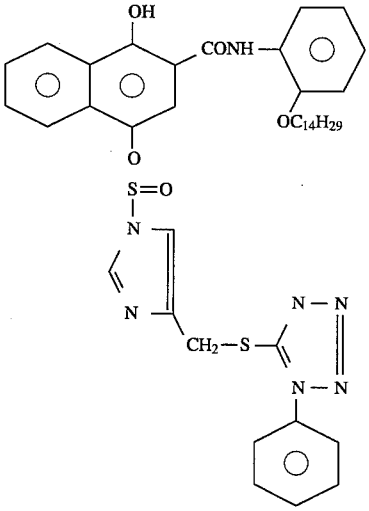
(CB-26)
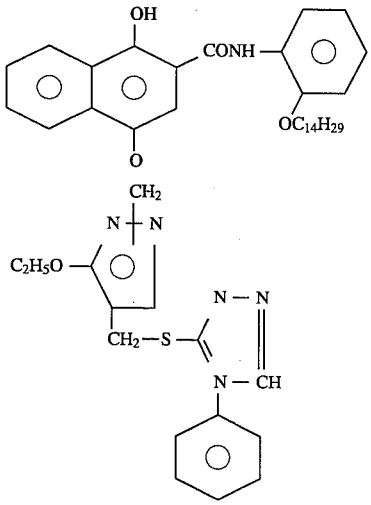
(CB-27)
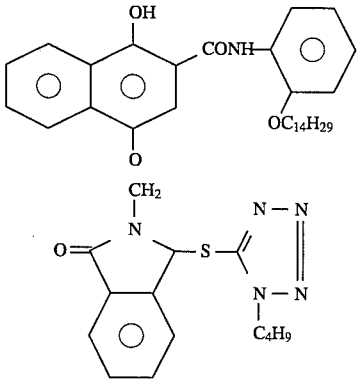
(CB-28)
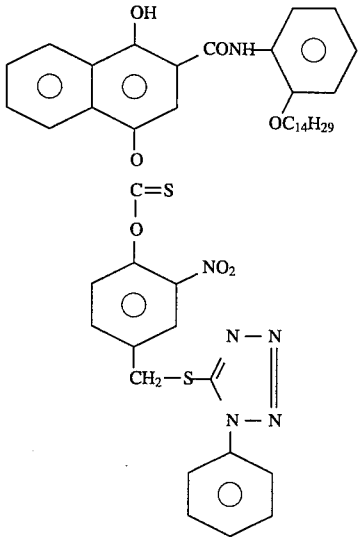
(CB-29)
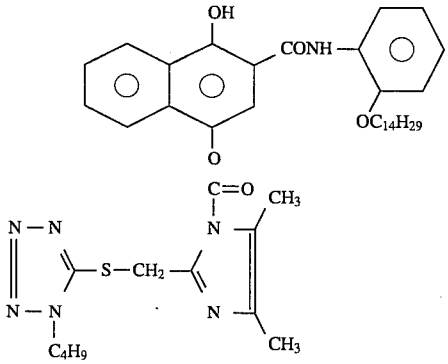
(CB-30)
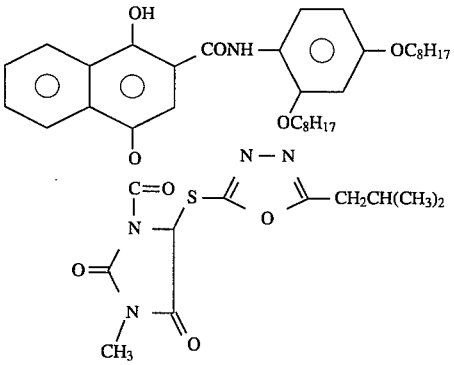

-continued
(CB-31)
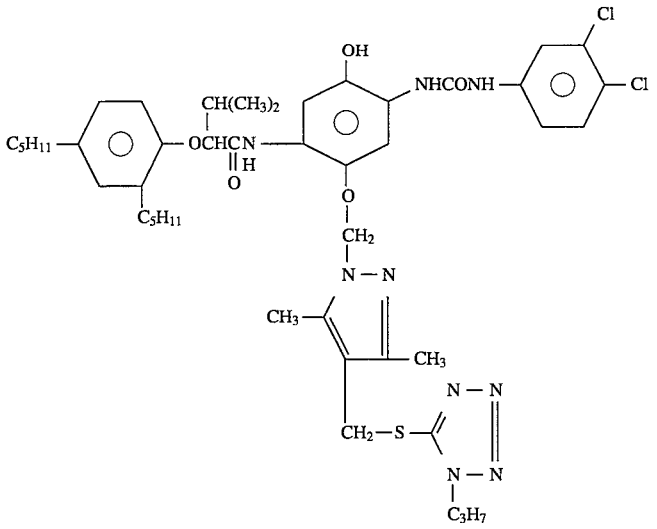
(CB-32)
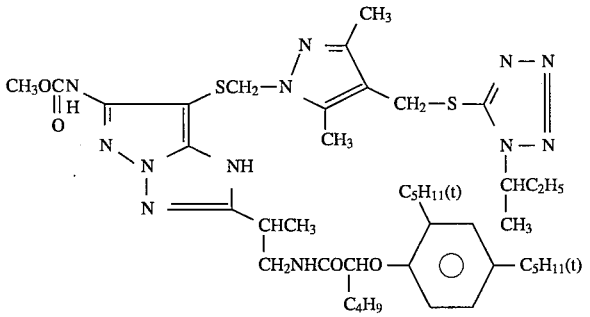
(CB-33)
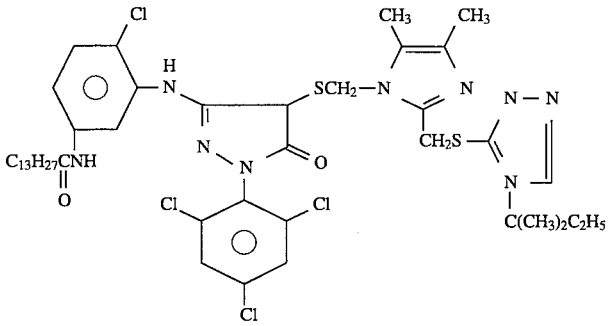
(CB-34)
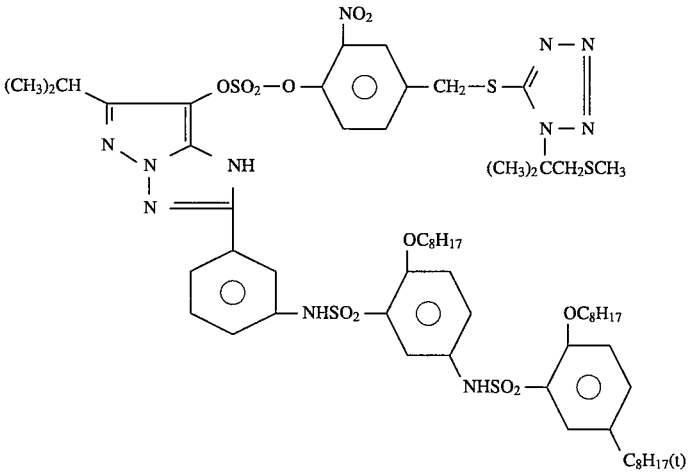

-continued
(CB-35)
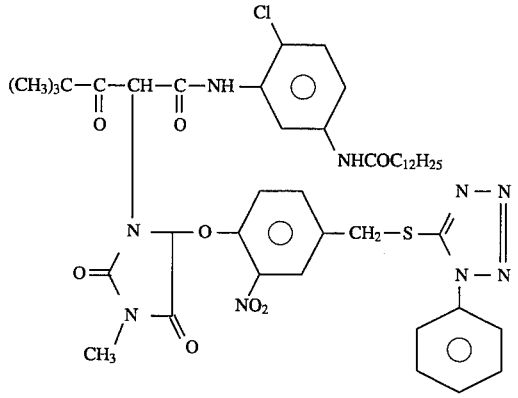
(CB-36)
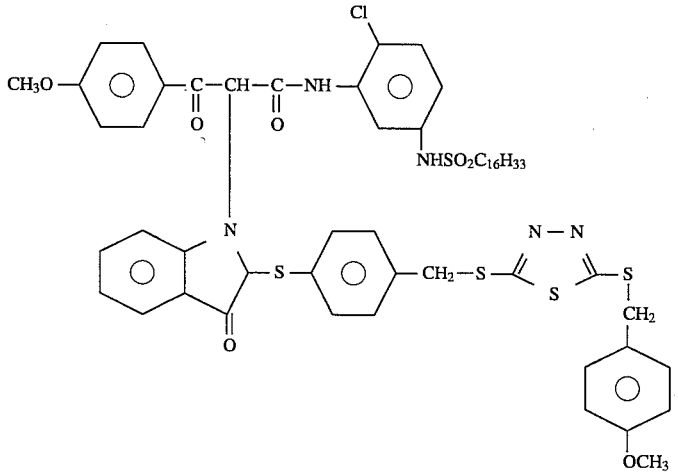
(CB-37)
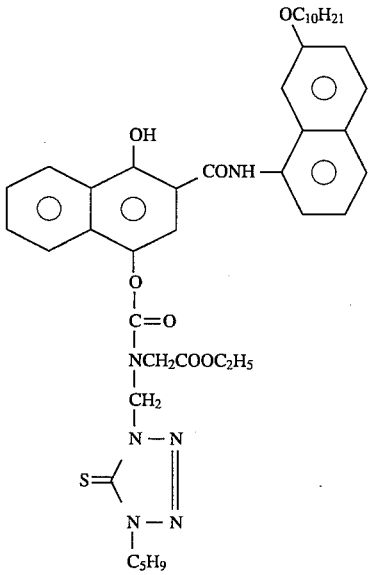
(CB-38)
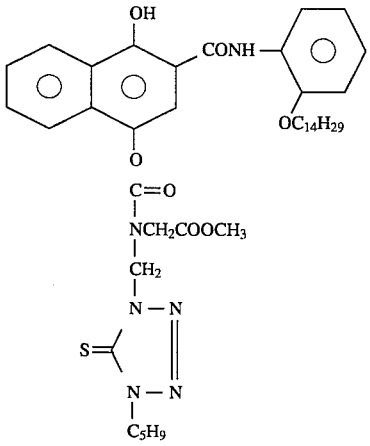

-continued
(SA-1)
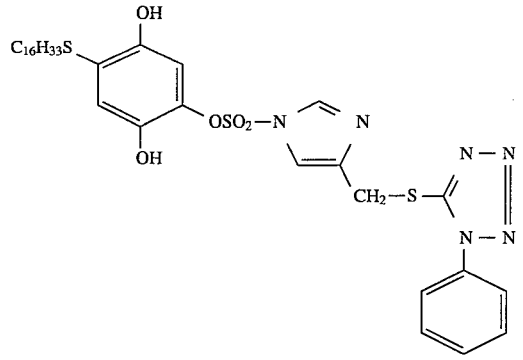
(SA-2)
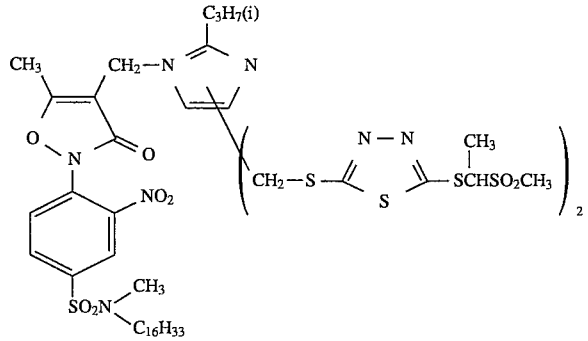
(SA-3)
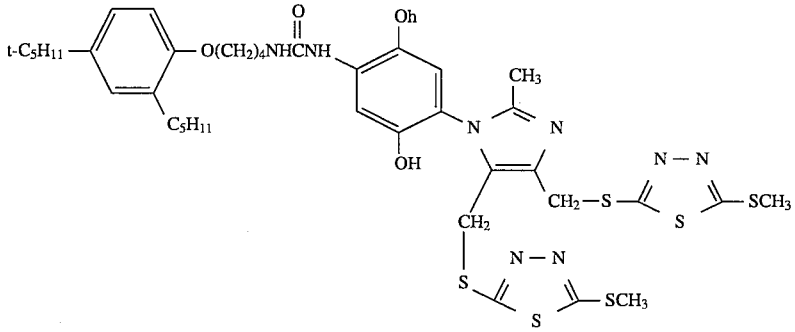
(SA-4)
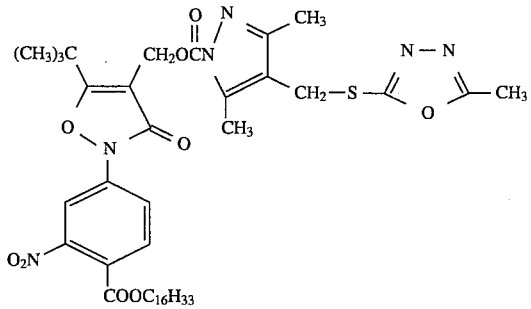

-continued (SA-5)

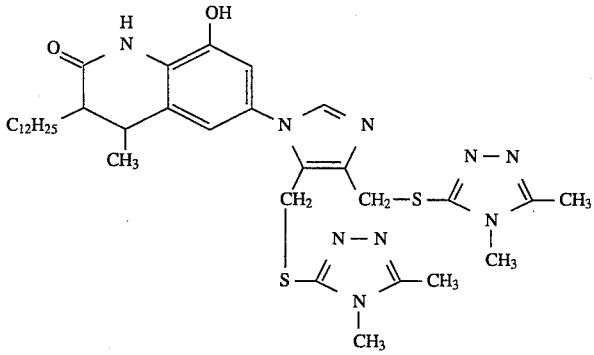

(SA-6)

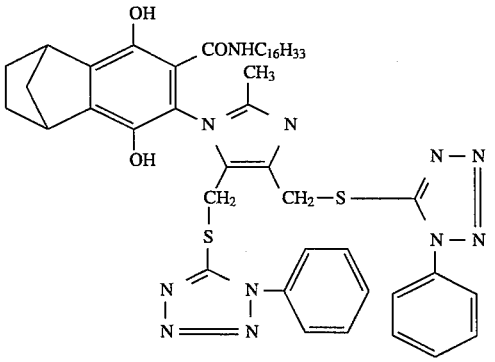

(SA-7)

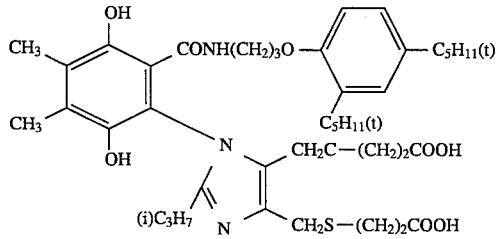

(SA-8)

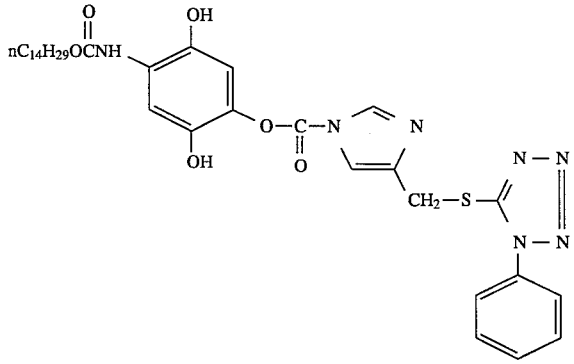

The compounds of this invention can be synthesized by the methods disclosed in, for example, U.S. Pat. Nos. 4,847,383, 4,770,990, 4,684,604 and 4,886,736, JP-A-60-218645, JP-A-61-230135, JP-A-2-37070, JP-A-2-170832, and JP-A-2-251192, or by methods similar to these.

Actual examples of synthesizing compounds will be described.

(Synthesis 1): Synthesis of Exemplified Compound (CA-1)

The compound (CA-1) was synthesized in the synthesis route illustrated below:

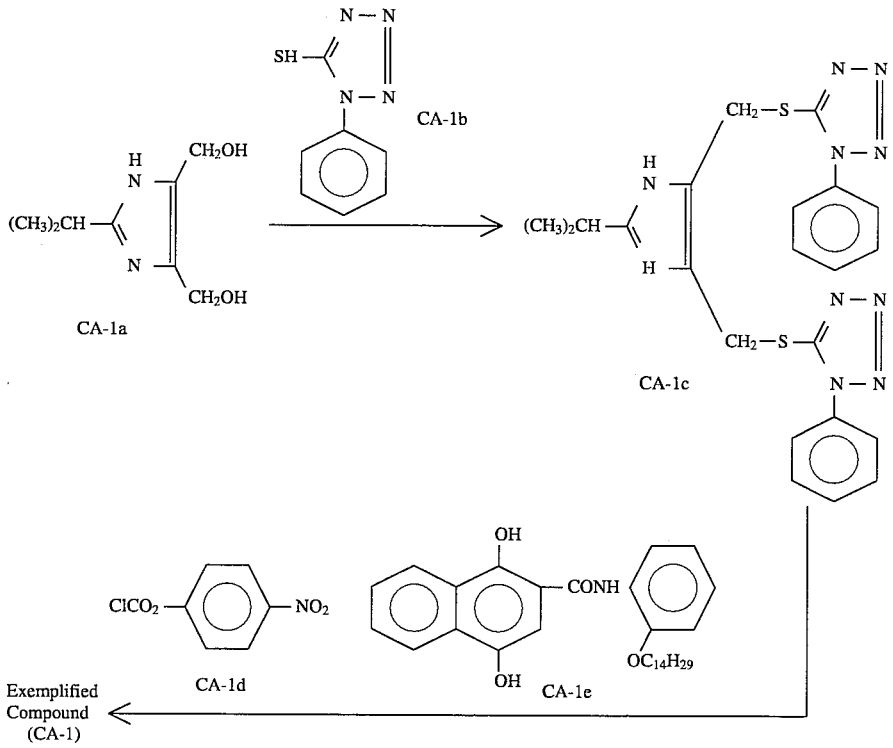

CA-1a (3.40 g) was reacted in thionyl chloride (30 ml) for 1 hour at 60° C. Next, the excessive thionyl chloride was distilled out under reduced pressure. The resultant residue was added to a dimethylformamide solution (0° C.) of CA-1b (7.48 g) and diisopropylethylamine (10.5 ml). The resultant solution was stirred for 1 hour. Thereafter, the solution was poured into water (500 ml), whereby crystals were precipitated. The crystals were filtered out, thus obtaining 9.8 g of crude crystals of CA-1c. The structure of CA-1c was identified by means of NMR method.

CA-1c (3.20 g) and CA-1d (1.38 g) were reacted for 1 hour in 1,2-dichloroethane (30 ml). Then, an ethyl acetate solution (20 ml) of CA-1e (3.20 g) was added therein under water-cooling. Further, diisopropylethylamine (4.5 ml) was added, and the resultant mixture was stirred for 1 hour.

1N hydrochloric acid was added to terminate the reaction, then chloroform (30 ml) was added to the reaction solution for diluting the same. Thereafter, the reaction solution was water-washed three times, and the organic layer thereof was dried over sodium sulfate. The organic solvent was distilled out, whereby an oily substance was obtained. This substance was refined by means of silica-gel column chromatography (ethyl acetate-hexane=1:5), thereby obtaining 1.20 g of exemplified compound CA-1. The structure of compound CA-1 was identified by means of NMR method. The compound had a melting point of 133.0° to 134.0° C.

(Synthesis 2): Synthesis of Exemplified Compound (CA-19)

The compound (CA-19) was synthesized in the synthesis route illustrated below:

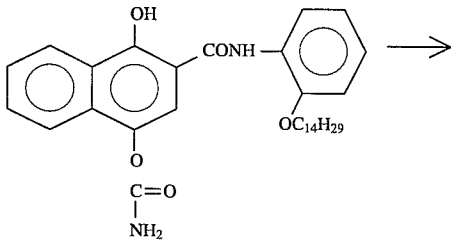

-continued

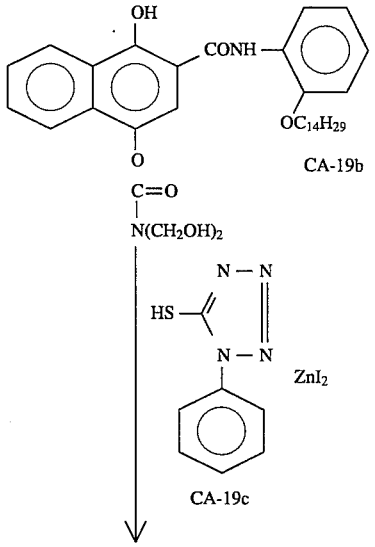

Exemplified Compound (CA-19)

CA-19a (10.7 g) and a 37% formalin aqueous solution (30 ml) were reacted at 70° C. for 5 hours in acetic acid (100 ml). The solvent was distilled out under reduced pressure. Then, the resultant residue was refined by silica-gel column chromatography (ethyl acetate-hexane=2:1), thus obtaining 6.4 g of CA-19b (yield: 53%).

Next, CA-19b (3.2 g) and CA-19c (2.1 g) were suspended in chloroform (40 ml). Zinc iodide (5.7 g) was added to the suspension, whereby reaction was proceeded for 2 hours at room temperature. 1N hydrochloric acid was added to terminate the reaction. The reaction solution was diluted with 40 ml of chloroform and washed twice with water. The resultant organic layer was dried over sodium sulfate and condensed, whereby a residue was obtained. The residue was refined by means of silica-gel column chromatography (ethyl acetate-hexane=1:4). As a result, 4.1 g of compound CA-19 was obtained (yield: 25%). The structure of this compound was identified by NMR method, mass-spectrum analysis, and element analysis.

(Synthesis 3): Synthesis of Exemplified Compound (CB-2)

The compound (CB-2) was synthesized in the synthesis route shown below:

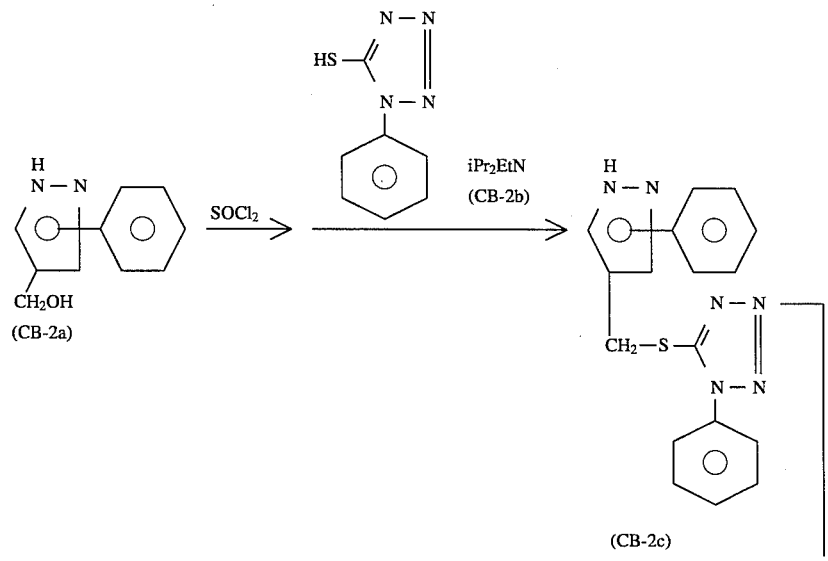

-continued

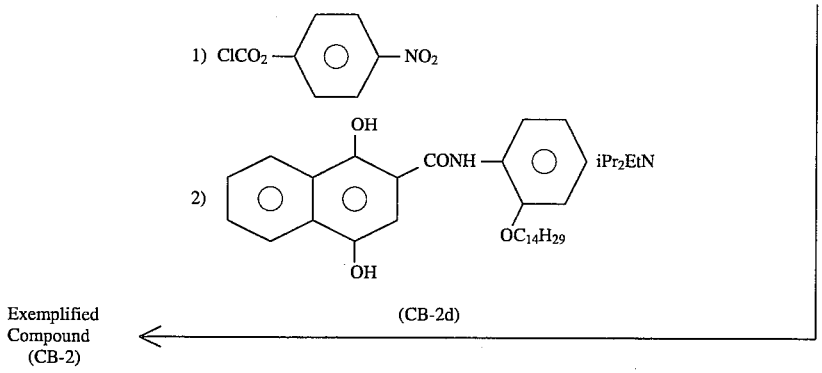

CB-2a (10 mmol) was suspended in chloroform (30 ml), forming a suspension. Thionyl chloride (20 mmol) was added to the suspension. Reaction was proceeded for 1 hour at 50° C. Next, the solvent was distilled out, obtaining a residue. The residue was added to a dimethylformamide solution (30 ml) of CB-2b (10 mmol) and diisopropylethylamine (20 mmol) and was reacted for 1 hour. The reaction solution was poured into ice water (200 ml). Then, 50 ml of chloroform was added to the solution, which was stirred. Thereafter, the aqueous layer was removed, and the organic layer was water-washed twice, each time with 100 ml of water. The organic layer was dried over sodium sulfate and condensed, whereby compound CB-2c was obtained.

Compound CB-2c, thus obtained, was dissolved in chloroform (30 ml). Nitrophenylchlorocarbonate (10 mmol) was added to the solution, and reaction was continued for 1 hour. Next, an ethyl acetate solution (50 ml) of CB-2d (10 mmol) was added to the reaction solution, and then diisopropylethylamine (50 mmol) was added to the solution. Reaction was proceeded for 1 hour. 1N hydrochloric acid (10 ml) was added to terminate the reaction. The reaction solution was diluted with ethyl acetate (10 ml). The organic layer was water-washed, dried over sodium sulfate, and condensed, thus obtaining a residue. The residue was refined by means of silica-gel column chromatography (eluent: ethyl acetate-hexane=1:3). As a result, 1.94 g of compound CB-2 was obtained (yield: 23%). Compound CB-2 had a melting point of 101.5° to 102.5° C.

(Synthesis 4): Synthesis of Exemplified Compound (CB-3)

The compound (CB-3) was synthesized in the synthesis route illustrated below:

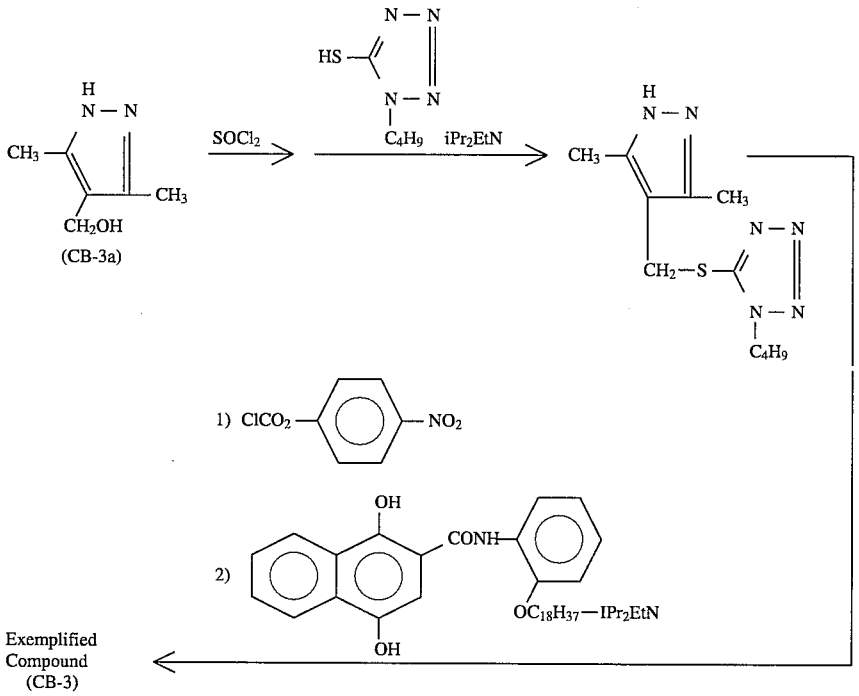

Using (CB-3a) as starting material, compound (CB-3) was synthesized at the yield of 31%, in the same method as compound CB-2. Compound (CB-3) had a melting point of 68.0° to 69.0° C.

(Synthesis 5): Synthesis of Exemplified Compound (CB-16)

The compound (CB-16) was synthesized in the route illustrated below:

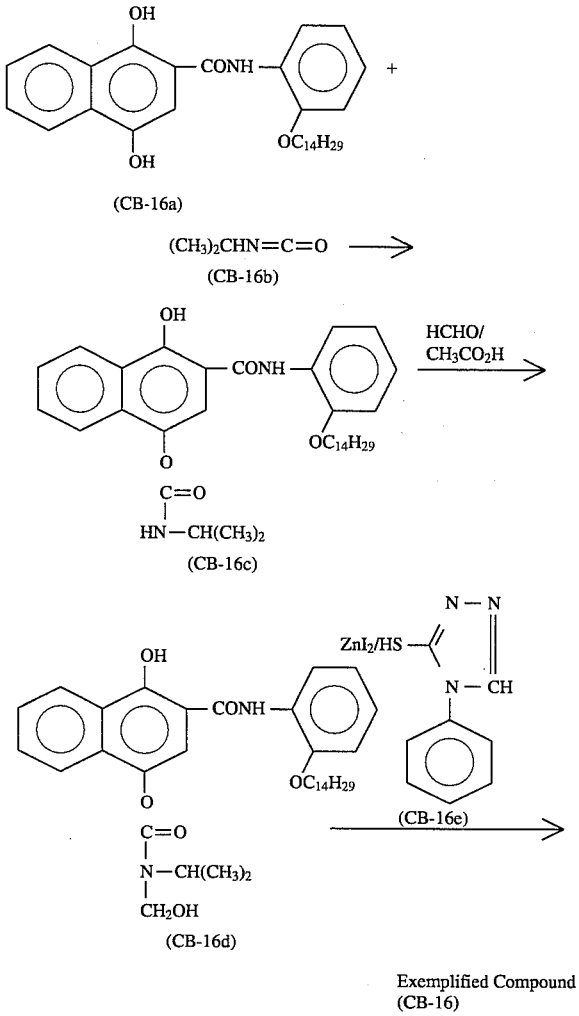

First, 200 g of (CB-16a) and 34.7 g of (CB-16b) were dissolved in ethyl acetate (500 ml), forming a solution. Diisopropylethylamine (142 ml) was added to the solution. The resultant solution was stirred for 4 hours, and crystals were precipitated. The crystals were filtered out and washed with ethyl acetate, whereby 176 g of compound (CB-16c) was obtained (yield: 75%).

Next, 53.6 g of (CB-16c) and 27.9 g of paraformaldehyde were reacted for 4 hours in a mixture of 1,2-dichloroethane (500 ml) and acetic acid (54 ml) under refluxing. The reaction solution was cooled to room temperature, washed with water, dried over anhydrous sodium sulfate, and finally condensed. As a result, a residue was obtained. The residue was refined by means of silica-gel column chromatography using chloroform as eluent, whereby 23.2 g of compound (CB-16d) was obtained (yield; 41.2%).

Then, 23.2 g of (CB-16d) and 6.78 g of (CB-16e) were dissolved in chloroform (250 ml), thus forming a solution. To this solution, 26.88 g of zinc iodide was added. The resultant solution was stirred for 3 hours. 1N hydrochloric acid was added to the solution, and the reaction solution was washed with water. The organic layer was dried over anhydrous sodium sulfate and condensed, obtaining a residue. The residue was refined by means of silica-gel column chromatography (ethyl acetate-hexane=1:4). As a result, 7.0 g of compound (CB-16) was obtained (yield: 23.9%). Compound (CB-16) had a melting point of 117.0° to 118.5° C.

(Synthesis 6): Synthesis of Exemplified Compound (CB-18)

The compound (CB-18) was synthesized in the same method as synthesis 5. Compound (CB-18) had a melting point of 61.5° to 63.0° C.

(Synthesis 7): Synthesis of Exemplified Compound (CB-25)

The compound (CB-25) was synthesized in the same method as synthesis 2 disclosed in JP-A-60-218645. Compound (CB-25) was obtained at yield of 7%, and had a melting point of 115° C.

(Synthesis 8): Synthesis of Exemplified Compound (SA-6)

The compound (SA-6) was synthesized in the synthesis route shown below:

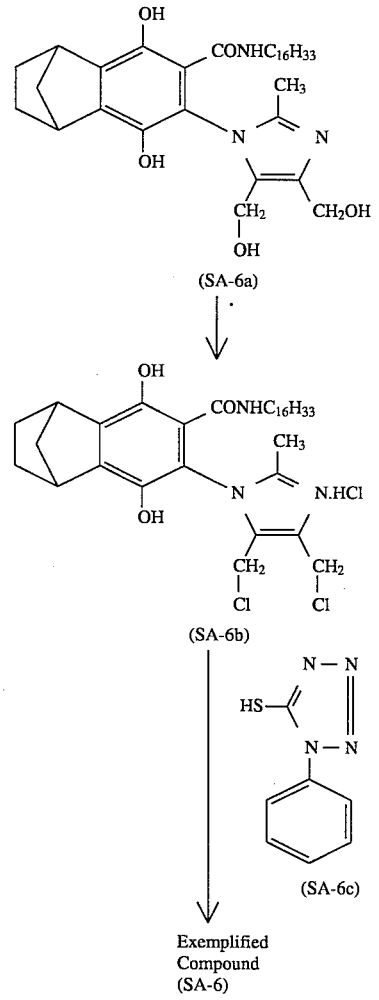

First, 11.6 g of SA-6a (synthesized by the same method as described in JP-A-61-230135) was added to 30 ml of thionyl chloride under water-cooling. Reaction was proceeded for 1 hour at 50° C. The excessive thionyl chloride was distilled out under reduced pressure. The crystals precipitated were washed with a small amount of ice-cooled chloroform, thereby obtaining SA-6b in the form of crude crystal. Next, 13.1 g of SA-6b was added at 0° C. to an N,N-dimethylformamide solution (100 ml) of 7.2 g of SA-6c and 12.1 g of triethylamine. Reaction was effected for 1 hour at room temperature.

The reaction mixture was poured into an aqueous solution of 60 ml of 2N hydrochloric acid and 300 ml of ice water. Further, 300 ml of ethyl acetate was added to the solution.

The resultant solution was stirred. The solution was introduced into a separating funnel, thus collecting the organic layer. The organic layer was then water-washed several times. The organic layer was dried over anhydrous sodium sulfate and condensed, whereby a residue was obtained. The residue was refined by means of silica-gel column chromatography (ethyl acetate-hexane=¼ to ⅓ (V/V) was used as eluent). As a result, 3.7 g of compound SA-6 was obtained in the amorphous form.

The compounds represented by the formulas (I) and (II) are used, chiefly in order to enhance image qualities such as color reproduction, sharpness and graininess.

The compounds represented by the formulas (I) and (II) can be used in either a light-sensitive layer or a non-light-sensitive layer. Preferably, they are used in a light-sensitive layer or a non-light-sensitive layer adjacent to a light-sensitive layer.

The addition amount of the compounds of the formula (I) or (II) depends on the photographic properties desired of the light-sensitive material. It is $1\times10^{-8}$ to $1\times10^{-2}$ mol per square meter ($m^2$) of the layer to be added, preferably $1\times10^{-7}$ to $1\times10^{-3}$ mol/$m^2$. In other words, the amount is $1\times10^{-6}$ to 0.5 mol, more preferably $1\times10^{-5}$ to $1\times10^{-1}$ mol, per mol of silver halide contained in the light-sensitive layer or the layer adjacent thereto, to which the compound is added. These specific ranges can be applied to the case where only one compound represented by the formula (I) or (II) is added to the layer.

Two or more types of the compounds represented by the formulas (I) and (II) can be used in the same layer. Alternatively, any one of the compounds of the formulas (I) and (II) can be used in two or more layers. Further, any compound of the formulas (I) and (II) can be used along with a known DIR compound.

In the present invention, the compounds represented by the formulas (I) and (II) can be introduced into a light-sensitive material by various known dispersion methods which will be described later.

These compounds can be used, either mixed with or along with various couplers or compounds which will be described later.

According to the present invention, silver halide grains are chemically sensitized with at least one sensitizer selected from the group consisting of a selenium sensitizer, a gold sensitizer and a sulfur sensitizer. The chemical sensitization and the sensitizers will be described in detail.

Selenium sensitization is carried out by the method known hitherto. To be specific, an unstable selenium compound and/or a non-unstable selenium compound is added to an emulsion, and the emulsion is stirred for a predetermined time at a high temperature, preferably 40° C. or more. Preferable is selenium sensitization in which use is made of the unstable selenium sensitizer disclosed in JP-A-44-15748. Specific examples of the selenium sensitizer are: aliphatic isoselenocyanates such as allylselenocyanates; selenoureas; selenoketones; selenoamides; selenocaroxylic acids and esters; and selenophosphates. Unstable selenium compounds, which are preferred in particular, will be specified below.

I. Colloidal metal selenium

II. Organic selenium compounds (wherein a selenium atom is double-bonded to the carbon atom of an organic compound by virtue of covalent bonding)

a. Isoselenocyanates

For example, aliphatic isoselenocyanates such as allylisoselenocyanate.

b. Selenoureas (including enol type)

For example, selenourea and aliphatic selenoureas such as methyl-, ethyl-, propyl-, isopropyl-, butyl-, hexyl-, octyl-, dioctyl-, tetramethyl-, N-(β-carboxyethyl)-N',N'-dimethyl, N,N-dimethyl-, diethyl- and dimethyl-selenoureas; for example, aromatic selenoureas each having one or more aromatic groups such as phenyl and tolyl; for example, heterocyclic selenoureas each having a heterocyclic group such as pyridine benzothiazolyl. Of these, particularly preferable is tetra-substituted selenourea. Specific examples are as follows:

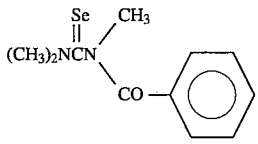
S-1

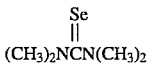
S-2

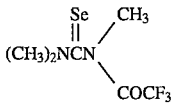
S-3

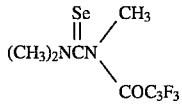
S-4

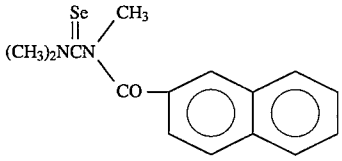
S-5

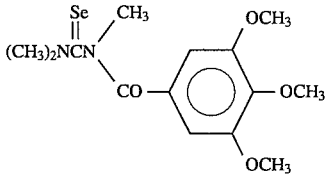
S-6

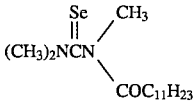
S-7

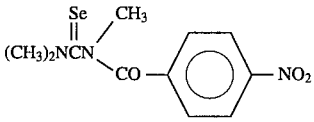
S-8

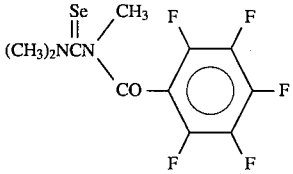
S-9

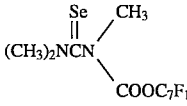
S-10

-continued

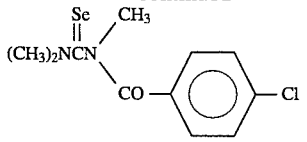

S-11

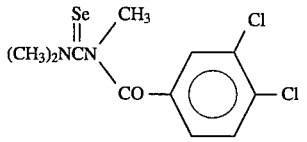

S-12

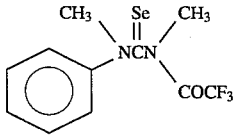

S-13 c. Selenoketones

For example, selenoacetone, selenoacetophenone, selenoketone in which an alkyl group is bonded to —C(=Se), and selenobenzophenone d. Selenoamides For example, selenoamide e. Selenocarboxylic acids and esters For example, 2-selenopropionic acid, 3-selenobutyric acid, methyl3-selenobutyrate III. Others a. Selenides For example, diethylselenide, diethyldiselenide, triphenylphosphineselenide, triisopropylphosphineselenide, tri-n-butylphosphineselenide, diphenylpentafluorophenylphosphineselenide, di-n-butyl-phenylphosphineselenide, tris-2,4,6-trichlorophosphineselenide, phenyl-bis-pentachlorophenylphosphineselenide b. Selenophosphates For example, tri-p-tolylselenophosphate and tri-n-butylselenophosphate Unstable selenium compounds for use in the present invention are not limited to those exemplified above. It has been generally understood to those skill in the art that the structures of unstable selenium compounds, as sensitizers for photographic emulsions, are not so important as long as selenium is unstable, and that the organic part of a selenium sensitizer molecule serves only to support selenium and allows it to exist in an unstable form in an emulsion. Unstable selenium compounds, in this broad sense, are used effectively in the present invention.

Also, selenium sensitization is utilized in the invention, which uses the non-unstable selenium sensitizers disclosed in JP-B-46-4553, JP-B-52-34492 and JP-B-52-34491. Examples of the non-unstable selenium sensitizers are: selenious acid, potassium selenocyanate, selenazoles, quaternary ammonium salts of selenazoles, diarylselenide, diaryldiselenide, 2-thioselenazolidinedione, 2-selenoxyzolidinethione, and derivatives thereof.

The non-unstable selenium sensitizer and the thioselenazolidinedione compound, which are described in JP-B-52-38408, are also effective.

Any one of these selenium sensitizers is dissolved in water, in an organic solvent such as methanol or ethanol, or in a mixture of the solvents. The resultant solution is added to the emulsion for chemical sensitization. Preferably, the solution is added before the chemical sensitization. Not only one selenium sensitizer, but also two or more selenium sensitizers can be used together. A combination of an unstable selenium compound and a non-unstable selenium compound is preferred.

The addition amount of a selenium sensitizer or selenium sensitizers used in the present invention depends on, for examples, the activity of the sensitizers, the type and size of silver halide grains, and the ripening temperature and time. Preferably, the amount is $1\times10^{-8}$ mol or more per mol of silver halide. More preferably, it is $1\times10^{-7}$ to $5\times10^{-5}$ mol per mol of silver halide. In the case where a selenium sensitizer or selenium sensitizers are used, the temperature for chemical ripening is preferably 45° C. or more, more preferably 50° C. to 80° C. Both pAg and pH can be of any values desired. For example, pH may range broadly, from 4 to 9, successfully achieving the advantages of the present invention.

The selenium sensitization of the present invention is more effective if conducted in the presence of silver halide solvent.

Examples of the silver halide solvent which can be used in the present invention are: (a) organic thioethers disclosed in, for example, U.S. Pat. Nos. 3,271,157, 3,531,289 and 3,574,628, JP-A-54-1019, and JP-A-54-158917; (b) thiourea derivatives disclosed in JP-A-53-82408, JP-A-55-77737, and JP-A-55-2982; (c) silver halide solvents each having a thiocarbonyl group sandwiched between a nitrogen atom and an oxygen atom or a sulfur atom; (d) imidazoles disclosed in JP-A-54-100717; (e) bisulfites; and (f) thiocyanates.

Particularly preferred solvents are thiocyanates and tetramethylthiourea. The amount in which to use the solvent depends on the type of the solvent. In the case of thiocyanate, its preferable amount is $1\times10^{-4}$ to $1\times10^{-2}$ mol per mol of silver halide.

It is desirable that the emulsion of the invention not only be selenium-sensitized, but also be sulfur-sensitized and gold-sensitized.

Sulfur sensitization is usually achieved by adding a sulfur sensitizer to the emulsion and stirring the emulsion for a predetermined time at a high temperature, preferably 40° C. or more.

Gold sensitization is usually accomplished by adding a gold sensitizer to the emulsion and stirring the emulsion for a predetermined time at a high temperature, preferably 40° C. or more.

In the sulfur sensitization, use is made of a known sulfur sensitizer. Examples of the sulfur sensitizer are: thiosulfate, allylthiocarbamidethiourea, allylisothiocynate, cystine, p-toluenethiosulfonate, and rhodanine. Also, the sulfur sensitizers disclosed in U.S. Pat. Nos. 1,574,944, 2,410,689, 2,278,947, 2,728,668, 3,501,313 and 3,656,955, German Patent 1,422,869, JP-B-56-24937, and JP-A-55-45016 can be used. The sulfur sensitizer is used in an amount sufficient to increase the sensitivity of the emulsion effectively. The amount varies in accordance with the various conditions such as pH, temperature and the size of the silver halide grains, but is preferably $1\times10^{-7}$ to $5\times10^{-5}$ mol per mol of silver halide.

As a gold sensitizer used in the gold sensitization mentioned above, a gold sensitizer in which the oxidation number of gold is +1 or +3, and use may be made of a gold compound usually used as a gold sensitizer. Examples of the gold sensitizer are: chloroaurate, potassium chloroaurate, auricrichloride, potassium auricthiocyanate, potassium iodoaurate, tetracyanoauric acid, ammonium aurothiocyanate, and pyridyltrichloro gold.

The addition amount of a gold sensitizer depends on various conditions, but is preferably $1\times10^{-7}$ to $5\times10^{-5}$ mol per mol of silver halide.

To achieve the chemical ripening, a silver halide solvent, a selenium sensitizer, a sulfur sensitizer, and a gold sensitizer, for example, need not be added at any specific timing or in any particular order. They can be added at the same time or different times at (preferably) the initial phase of chemical ripening, or during the chemical ripening. Further, they may be dissolved in water or an organic solvent which can mix with water, such as methanol, ethanol, acetone or a mixture thereof, and the resultant solution may be added to the emulsion.

The silver halide emulsion of this invention is preferably reduction-sensitized during the forming of grains.

To perform reduction sensitization during the forming of silver halide emulsion grains means basically to subject the emulsion to reduction sensitization during the nucleation, ripening or growth. The reduction sensitization may be conducted at any stage, i.e., the nucleation (i.e., the initial stage of the forming of grains), the physical ripening, or the growth. It is most desirable that the reduction sensitization be carried out during the growth of silver halide grains. "During the growth" includes two methods. In the first method, this sensitization is carried out while the grains are growing due to physical ripening or due to the addition of water-soluble silver salt and water-soluble alkali halide. In the second method, the sensitization is performed while the growth of the grain is temporarily stopped, and the grain are again grown after the reduction sensitization.

The reduction sensitization can be the method of adding a known reduction sensitizer to the silver halide emulsion, the silver ripening method in which silver halide grains are grown or ripened in a low-pAg atmosphere of pAg 1 to 7, or the high-pH ripening method in which silver halide grains are grown or ripened in a high-pH atmosphere of pH 8 to 11. Alternatively, two or more of these methods can be used in combination.

The method of adding a reduction sensitizer is desirable in that the level of reduction sensitization can be minutely controlled.

Known as reduction sensitizers are, for example, stannous salts, amines and polyamines, hydrazine derivatives, formamidinesulfinic acid, silane compound, and borane compound. Any reduction sensitizer selected from these known ones can be used in the present invention. Two or more compounds can be used in combination in the invention. Preferable as reduction sensitizers for use in this invention are stannous chloride, thiourea dioxide, dimethylamineborane, and ascorbic acid and derivative thereof. Since the addition amount of the reduction sensitizer depends on conditions under which the emulsion is manufactured, it should be selected in accordance with the time during which the sensitizer is added. However the appropriate range of the addition amount of the reduction sensitizer is $10^{-8}$ to $10^{-3}$ mol per mol of silver halide.

The reduction sensitizer is dissolved in, for example, water, or organic solvent such as alcohols, glycols, ketones, esters, or amides, thus forming a solution. This solution is added during the forming of grains. Although the solution can be introduced into the reaction vessel beforehand, it is preferable to add the solution at a proper time during the forming of silver halide grains. Alternatively, the reduction sensitizer may be dissolved in an aqueous solution of water-soluble silver salt or water-soluble alkali halide, and the resultant solution may be used to form the grains. Another preferable method is to add the reduction sensitizer solution several times, in portions, or continuously, while the silver halide grains are growing.

Preferably, a palladium compound is added in an amount of $5\times10^{-5}$ mol or more per mol of silver halide to the silver halide emulsion of the invention after the forming of grains and, preferably, before desalting.

The "palladium compound" means a divalent or tetravalent palladium salt. Preferably, the palladium compound is one represented by $R_2PdX_6$ or $R_2PdX_4$, where R is a hydrogen atom, an alkali metal atom, or an ammonium group, and X is a halogen atom, i.e., a chlorine atom, a bromine atom, or an iodine atom.

More specifically, preferable palladium compounds are: $K_2PdCl_4$, $(NH_4)_2PdCl_6$, $Na_2PdCl_4$, $(NH_4)_2PdCl_4$, $Li_2PdCl_4$, $Na_2PdCl_6$, and $K_2PdBr_4$.

Most preferably, any of these palladium compounds is used together with thiocyanate ions applied in a molar amount five or more times the amount of the palladium compound.

Preferably, the silver halide emulsion of this invention is used after it has been spectral-sensitized.

Usually used as a spectral-sensitizing dye in the present invention is a methine dye. The dye includes cyanine dye, merocyanine dye, composite cyanine dye, composite merocyanine dye, holopolar cyanine dye, hemicyanine dye, styryl dye, and hemioxonol dye. These dyes may contain any of nuclei which are usually used in cyanine dyes as basic heterocyclic nuclei. Examples of the nuclei are nuclei such as pyrroline, oxazoline, thiazoline, pyrrole, oxazole, thiazole, selenazole, imidazole, teterazole, and pyridine; nuclei each formed by fusion of any one of these nuclei and an alicyclic hydrocarbon ring; and nuclei each formed by fusion of any one of these nuclei and an aromatic hydrocarbon ring, such as indolenine, benzindolenine, indole, benzoxazole, naphthoxazole, benzothiazole, naphthothiazole, benzoselenazole, benzimidazole, and quinoline. These nuclei can be substituted at carbon atoms.

Merocyanine dye or composite merocyanine dye may contain, as nuclei of ketomethylene structure, 5- or 6-membered heterocyclic nuclei such as pyrazoline-5-on, thiohydantoin, 2-thioxazolidine-2,4-dione, thiazolidine-2,4-dione, rhodanine or thiobarbituric acid.

Of the dyes mentioned above, a particularly useful sensitizing dye is cyanine dye. Specific examples of the cyanine dye useful in the present invention are those which are represented by the following formula (1):

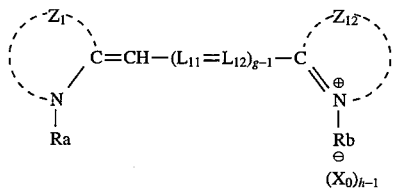

Formula (1)

In the formula (1), $Z_{11}$ and $Z_{12}$ represent atomic groups required for forming heterocyclic nuclei usually used in a cyanine dye, particularly, for example, thiazole, thiazoline, benzothiazole, naphthothiazole, oxazole, oxazoline, benzoxazole, naphthoxazole, tetrazole, pyridine, quinoline, imidazoline, imidazole, benzoimidazole, naphthoimidazole, selenazoline, selenazole, benzoselenazole, naphthoselenazole or indolenine. Each of these nuclei may be substituted with a lower alkyl group such as methyl, or with a halogen atom, phenyl, hydroxyl, an alkoxy group having 1 to 4 carbon atoms, carboxyl, alkoxycarbonyl, alkylsulfamoyl, alkylcarbamoyl, acetyl, acetoxy, cyano, trichloromethyl, trifluoromethyl, or nitro.

$L_{11}$ and $L_{12}$ represent methine groups or substituted methine groups. Examples of the substituted methine group are: a methine group substituted with a lower alkyl group such as methyl or ethyl, phenyl, substituted phenyl, methoxy or ethoxy.

$R_a$ and $R_b$ represent an alkyl group having 1 to 5 carbon atoms; a substituted alkyl group having a carboxyl group; a substituted alkyl group having a sulfo group, such as β-sulfoethyl, γ-sulfopropyl, δ-sulfobutyl, 2-(3-sulfopropoxy-)ethyl, 2-[2-(3-sulfopropoxy)ethoxy]ethyl or 2-hydroxy sulfopropyl; or a substituted alkyl group having an allyl group or any other substituted alkyl groups to be used as N-substituent of the commonly used cyanine dye. In the formula (1), g is 1, 2 or 3. The anion of X represents an acidic anion group usually used in a cyanine dye, such as iodine ion, bromine ion, p-toluenesulfonic acid ion, or peroxide ion. The notation of h is 1 or 2; it is 1 if the cyanine dye has betaine structure.

Other than the spectral-sensitizing dyes specified above, there can be used those dyes disclosed in, for example, German Patent 929,080, U.S. Pat. Nos. 2,493,748, 2,503,776, 2,519,001, 2,912,329, 3,656,959, 3,672,897, 3,694,217, 4,025,349, 4,046,572, 2,688,545, 2,977,229, 3,397,060, 3,522,052, 3,527,641, 3,617,293, 3,628,964, 3,666,480, 3,672,898, 3,679,428, 3,703,377, 3,814,609, 3,837,862 and 4,026,707, British Patents 1,242,588, 1,344,281 and 1,507,803, JP-B-44-14030, JP-B-52-24844, JP-B-43-4936, JP-B-53-12375, JP-A-52-110618, JP-A-52-109925, and JP-A-50-80827.

The amount of the sensitizing dyes added to the silver halide emulsion being made varies depending on the types of the dyes or the amount of silver halide used. The amount, however, is substantially the same as in the conventional methods.

To be more specific, the sensitizing dyes are added in an amount of preferably 0.001 to 100 mmol per mol of silver halide, more preferably 0.01 to 10 mmol per mol of silver halide.

The sensitizing dyes are added either before or after chemical ripening. To sensitize the silver halide grains of this invention, it is most desirable that the sensitizing dyes be added during the chemical ripening of the grains or before the chemical ripening (e.g., at the time of forming or physical ripening the grains).

The emulsion may contain not only the sensitizing dyes, but also a dye not having spectral sensitization action or a substance absorbing virtually no visible light, which can achieve supersensitization. Examples of the dye and the substance are: an aminostyl compound substituted with a nitrogen-containing heterocyclic group (e.g., those disclosed in U.S. Pat. Nos. 2,933,390 and 3,635,721), a formaldehyde condensate of an aromatic organic acid (e.g., those disclosed in U.S. Pat. No. 3,743,510), a cadmium salt, and an azaindene compound. The combinations of these, which are described in U.S. Pat. Nos. 3,615,613, 3,615,641, 3,617,295 and 3,635,72 are useful in particular.

The photographic emulsion for use in the invention can contain various compounds to prevent fogging from occurring during the manufacture, storage or processing of the light-sensitive material, and to stabilize the photographic properties of the light-sensitive material. More precisely, compounds known as antifoggants or stabilizing agents can be added to the emulsion. Examples of these compounds are: azoles (e.g., benzothiazolium salt, nitroindazoles, triazoles, benzotriazoles, and benzimidazoles (particularly, nitro- or halogen-substituted ones); heterocyclic mercapto compounds (e.g., mercapto thiazoles, mercapto benzothiazoles, mercapto benzimidazoles, mercaptotetrazoles (particularly, 1-phenyl-5-mercaptotetrazole), mercaptopyrimidines); heterocyclic mercapto compounds having a water soluble group such as a carboxyl group or a sulfon group; thioketone compounds (e.g., oxazolinethione); azaindenes (e.g., tetraazaindene (particularly, 4-hydroxy-substituted (1, 3, 3a, 7) tetraazaindenes); benzenethiosulfonic acids; and benzenesulfinic acid.

Usually, the antifoggants and the stabilizing agents are added after the emulsion has been chemically sensitized. Preferably, however, they can be added during the chemical ripening or before the start thereof. In other words, they should better be added during the forming of silver halide grains—more precisely, during the addition of the silver salt solution, after the addition of this solution and before the start of the chemical ripening, or during the chemical ripening (preferably within the first 50% of the chemical-ripening period, more preferably within the first 20% thereof).

Specific examples of the compounds known as antifoggants or stabilizing agents are: a tetraazaindene based compound having at least one hydroxy group, a benzotriazole compound, and a heterocyclic compound substituted with at least one mercapto group and having at least two aza-nitrogen atoms in the molecule.

Preferable as a tetraazaindene based compound having at least one hydroxy group are those represented by the following formula (2) or (3):

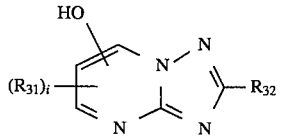

Formula (2)

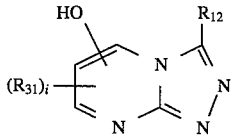

Formula (3)

$R_{31}$ and $R_{32}$ in the formulas (2) and (3) may be the same or different, each being a hydrogen atom, an aliphatic residue, or an aromatic residue. Examples of the aliphatic residue are: an alkyl group (e.g., methyl, ethyl, propyl, pentyl, hexyl, octyl, isopropyl, sec-butyl, t-butyl, cyclohexyl, cyclopentylmethyl, or 2-norbornyl; an alkyl group substituted with an aromatic residue group (e.g., benzyl, phenetyl, benzhydlyl, 1-naphthylmethyl, or 3-phenylbutyl); an alkyl group substituted with an alkoxy group (e.g., methoxymethyl, 2-methoxyethyl, 3-ethoxy propyl, or 4-methoxybutyl); an alkyl group substituted with a hydroxy, carbonyl or alkoxycarbonyl group (e.g., hydroxymethyl, 2-hydroxyethyl, 3-hydroxybutyl, carboxymethoxy, 2-carboxyethyl, or 2-(methoxycarbonyl)ethyl. Examples of the aromatic residue are: an aryl group (e.g., phenyl or 1-naphthyl); an aryl group having a substituent (e.g., p-tolyl, m-ethylphenyl, m-cumenyl, mesityl, 2,3-xylyl, p-chlorophenyl,o-bromophenyl, p-hydroxyphenyl, 1-hydroxy-2-naphthyl, m-methoxyphenyl, p-ethoxyphenyl, p-carboxyphenyl, o-(methoxycarbonyl) phenyl, m-(ethoxycarbonyl)phenyl, 4-carboxy-naphthyl). $R_{31}$ and $R_{32}$ have 12 or less carbon atoms in total. In the formulas (2) and (3), i is 1 or 2.

Examples of the hydroxytetraazaindene compounds represented by the formulas (2) and (3) will be specified below. Nonetheless, hydroxytetraazaindene compounds which can be used in the present invention are not limited to these.

2-1: 4-hydroxy-6-methyl-1,3,3a,7-tetraazaindene
2-2: 4-hydroxy-1,3,3a,7-tetraazaindene
2-3: 4-hydroxy-6-methyl-1,2,3a,7-tetraazaindene
2-4: 4-hydroxy-6-phenyl-1,3,3a,7-tetraazaindene
2-5: 4-methyl-6-hydroxy-1,3,3a,7-tetraazaindene
2-6: 2,6-dimethyl-4-hydroxy-1,3,3a, 7-tetraazaindene 2-7: 4-hydroxy-5-ethyl-6-methyl-1,3,3a,7-tetraazaindene
2-8: 2,6-dimethyl-4-hydroxy-5-ethyl-1,3,3a,7-tetraazaindene
2-9: 4-hydroxy-5,6-dimethyl-1,3,3a,7-tetraazaindene
2-10: 2,5,6-trimethyl-4-hydroxy-1,3,3a,7-tetraazaindene
2-11: 2-methyl-4-hydroxy-6-phenyl-1,3,3a,7-tetraazaindene
2-12: 4-hydroxy-6-ethyl-1,2,3a,7-tetraazaindene
2-13: 4-hydroxy-6-phenyl-1,2,3a,7-tetraazaindene
2-14: 4-hydroxy-1,2,3a,7-tetraazaindene
2-15: 4-methyl-6-hydroxy-1,2,3a,7-tetraazaindene
2-16: 5,6-trimethylene-4-hydroxy-1,3,3a,7-tetraazaindene Examples of the benzotriazole compounds are those represented by the following formula (4):

Formula (4)

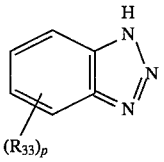

In the formula (4), p is an integer of 1 to 4. $R_{33}$ represents a halogen atom (e.g., chlorine, bromine, or iodine) or an aliphatic group (including a saturated or unsaturated aliphatic group). Examples of the aliphatic group are: an unsubstituted alkyl group having 1 to 8 carbon atoms (e.g., methyl, ethyl, n-propyl, or hexyl); a substituted alkyl group (preferably, one having an alkyl moiety having 1 to 4 carbon atoms, such as vinylmethyl, an aralkyl group (e.g., benzyl or phenetyl), a hydroxyalkyl group (e.g., 2-hydroxyethyl, 3-hydroxypropyl, 4-hydroxybutyl), or an acetoxyalkyl group (e.g., 2-acetoxyethyl or 3-acetoxypropyl), and an alkoxyalkyl group (e.g., 2-methoxyethyl or 4-methoxybutyl); and an aryl group (e.g., phenyl). More preferably, $R_{33}$ is a halogen atom (chlorine or iodine), or an alkyl group having 1 to 3 carbon atoms (e.g., methyl, ethyl, or propyl).

Specific examples of the benzotriazoles for use in the present invention will be described below. It should be noted, however, benzotriazoles which can be used in this invention are not limited to these.

Compound 4-1: benzotriazole
Compound 4-2: 5-methyl-benzotriazole
Compound 4-3: 5,6-dimethylbenzotriazole
Compound 4-4: 5-bromo-benzotriazole
Compound 4-5: 5-chloro-benzotriazole
Compound 4-6: 5-nitro-benzotriazole
Compound 4-7: 4-nitro-6-chlorobenzotriazole
Compound 4-8: 5-nitro-6-chlorobenzotriazole The addition amount of the antifoggants and the stabilizing agents used in the present invention, all described above, varies depending on the method of adding them or the amount of silver halide used. The amount is preferably $10^{-7}$ to $10^{-2}$ mol per mol of silver halide, more prefer ably $10^{-5}$ to $10^{-2}$ mol per mol of silver halide.

The heterocyclic compound substituted with at least one mercapto group and having at least two aza-nitrogen atoms in the molecule (hereinafter called nitrogen-containing heterocyclic compound having a mercapto group) will now be described in detail. The hetero-ring of this compound may have, for example, an oxygen atom, a sulfur atom, or a selenium atom, in addition to the nitrogen atom. Useful as this compound are: a 5- or 6-membered monocyclic-type heterocyclic compound having at least two aza-nitrogen atoms, and a di- or tricyclic-type heterocyclic compound which is formed by condensing 2 or 3 heterocyclic rings each having at least one aza-nitrogen atom and which has a mercapto group substituted on a carbon atom adjacent to the aza-nitrogen atom.

Usable as the heterocyclic ring of the nitrogen-containing heterocyclic compound having a mercapto group are: pyrazole, 1,2,4-triazole, 1,2,3-triazole, 1,3,4-thiadiazole, 1,2,3-thiadiazole, 1,2,4-thiadiazole, 1,2,5-thiadiazole, 1,2,3,4-tetrazole, pyridazine, 1,2,3-triazine, 1,2,4-triazine, 1,3,5-triazine, and a ring formed by condensing 2 or 3 of these rings, such as triazolotriazole, diazaindene, triazaindene, tetraazaindene or pentaazaindene. A heterocyclic ring formed by condensing a monocyclic-type heterocyclic ring and an aromatic ring, such as a phthalazine ring or indazole ring, can be used.

Of these rings, preferable are: 1,2,4-triazole, 1,3,4-thiadiazole, 1,2,3,4-tetrazole, 1,2,4-triazine, triazolotriazole, and tetraazaindene.

The mercapto group may be substituted on any one of the carbon atoms of these rings. Preferably, however, is the case where one of the following three bonds is formed:

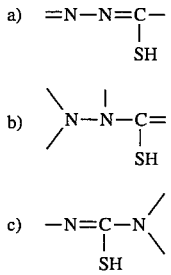

The heterocyclic ring may have a substituent other than a mercapto group. Examples of the substituent are: an alkyl group having 8 or less carbon atoms (e.g., methyl, ethyl, cyclohexyl, or cyclohexylmethyl), a substituted alkyl group (e.g., sulfoethyl or hydroxymethyl), an alkoxy group having 8 or less carbon atoms (e.g., methoxy or ethoxy), an alkylthio group having 8 or less carbon atoms (e.g., methylthio or butylthio), a hydroxy group, an amino group, a hydroxyamino group, an alkylamino group having 8 or less carbon atoms (e.g., methylamino or butylamino), a dialkylamino group having 8 or less carbon atoms (e.g., dimethylamino or diisopropylamino), an arylamino group (e.g., anilino), an acylamino group (e.g., acetylamino), a halogen atom (e.g., chlorine or bromine), a cyano group, a carboxyl group, a sulfo group, a sulfato group, and a phospho group.

The mercapto compound suitable for use, along with the selenium sensitizer of the invention, is one which is represented by the following formula (A):

Formula (A)

$$Q—SM^1$$

In the formula (A), Q is a heterocyclic residue directly or indirectly bonding a group selected from the group consisting of $—SO_3M^2$, $—COOM^2$, —OH and $NR^1R^2$. $M^1$ and $M^2$ are independently a hydrogen atom, alkali metal, quaternary ammonium, quaternary phosphonium. $R^1$ and $R^2$ are hydrogen atoms or substituted or unsubstituted alkyl groups.

Examples of the heterocyclic residue represented by Q in the formula (A) are: an oxazole ring, a thiazole ring, an imidazole ring, a selenazole ring, a triazole ring, a tetrazole ring, a thiadiazole ring, an oxadiazole ring, a pentazole ring, a pyrimidine ring, a thiadia ring, a triazine ring, a thiadiazine ring, or a ring bonded to another carbon or heterocyclic ring (e.g., a benzothiazole ring, a benzotriazole ring, a benzimidazole ring, a benzoxazole ring, a benzoselenazole ring, a naphthoxazole ring, a triazaindolizine ring, a diazaindolizine ring, or a tetraazaindolizine ring.

Of the mercapto heterocyclic compounds represented by the formula (A), particularly preferable can be those represented by the following formulas (B) and (C):

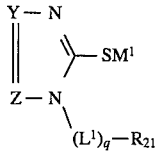

Formula (B)

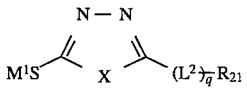

Formula (C)

In the formula (B), Y and Z are independently a nitrogen atom or $CR_{22}$ (where $R_{22}$ is a hydrogen atom, a substituted or unsubstituted alkyl group, or a substituted or unsubstituted aryl group). $R_{21}$ is an organic residue substituted with at least one group selected from the group consisting of $—SO_3M^2$, $—COOM^2$, —OH and $—NR_{23}R_{24}$. Specific examples of $R_{21}$ are: an alkyl group having 1 to 20 carbon atoms (e.g., methyl, ethyl, propyl, hexyl, dodecyl, or octadecyl), and an aryl group having 6 to 20 carbon atoms (e.g., phenyl or naphthyl). $L^1$ is a linking group selected from the group consisting of —S—, —O—, —N—, —CO—, —SO— and $—SO_2—$, and q is 0 or 1. $M^1$ and $M^2$ have the same meaning as those shown in the formula (A). $R_{23}$ and $R_{24}$ are equal to $R^1$ and $R^2$ defined in conjunction with the formula (A).

The alkyl group and the aryl group, both specified above, can be substituted with other substituent such as a halogen atom (e.g., F, Cl, or Br), an alkoxy group (e.g., methoxy or methoxy ethoxy), an aryloxy group (e.g., phenoxy), an alkyl group (if $R_{24}$ is an aryl group), an aryl group (if $R_{24}$ is an alkyl group), an amido group (e.g., acetoamido or benzoylamino), a carbamoyl group (e.g., an unsubstituted carbamoyl, phenylcarbamoyl, or methylcarbamoyl), a sulfonamido group (e.g., methanesulfonamido or phenylsulfonamido), a sulfamoyl group (e.g., an unsubstituted sulfamoyl, methylsulfamoyl, or phenylsulfamoyl), a sulfonyl group (e.g., methylsulfonyl or phenylsulfonyl), a sulfinyl group (e.g., methylsulfinyl or phenylsulfinyl), a cyano group, an alkoxycarbonyl group (e.g., methoxycarbonyl), an aryloxycarbonyl group (e.g., phenoxycarbonyl), or a nitro group.

If there are two or more substituents for $R_{21}$, such as $—SO_3M^2$, $—COOM^2$, —OH, $—NR_{23}$, $R_{24}$, they can be either the same or different.

$M^2$ is of the same meaning as has been explained in conjunction with the formula (A).

In the formula (C), X is a sulfur atom, an oxygen atom, or $—N(R_{25})—$, where $R_{25}$ is a hydrogen atom, a substituted or unsubstituted alkyl group, or a substituted or unsubstituted aryl group.

$L^2$ is $—CONR_{26}—$, $—NR_{26}CO—$, $—SO_2NR_{26}—$, $—NR_{26}SO_2—$, —OCO—, —COO—, —S—, $NR_{26}—$, —CO—, —SO—, —OCOO—, $—NR_{26}CONR_{27}—$, $—NR_{26}COO—$, $—OCONR_{26}—$, or $—NR_{26}SO_2NR_{27}—$, where $R_{26}$ and $R_{27}$ are each a hydrogen atom, a substituted or unsubstituted alkyl group, or a substituted or unsubstituted aryl group.

$R_{21}$, $M^1$, and $M^2$ are of the same meaning as has been described in connection with the formulas (A) and (B), and q is 0 or 1.

Examples of the substituents for the alkyl groups and aryl groups, which are represented by $R_{22}$, $R_{25}$, $R_{26}$, and $R_{27}$, are those exemplified as the substituent for $R_{21}$.

Particularly preferred as the compounds represented by the formulas (B) and (C) are those in which $R_{21}$ is $—SO_3M^2$ or $—COOM^2$.

Examples of the preferable compound represented by the formula (A), which is used in the present invention, will be specified below:

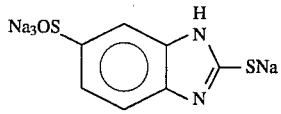

(1)

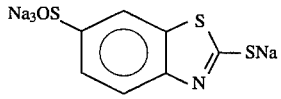

(2)

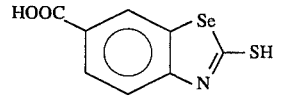

(3)

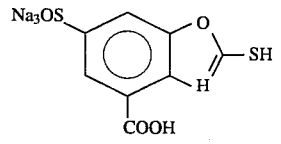

(4)

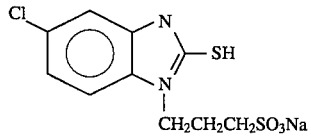

(5)

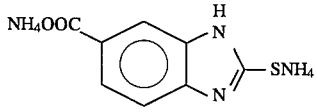

(6)

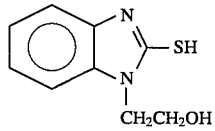

(7)

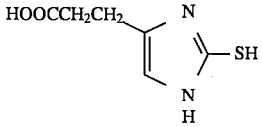

(8)

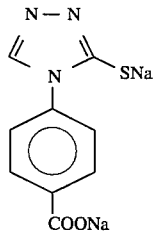

(9)

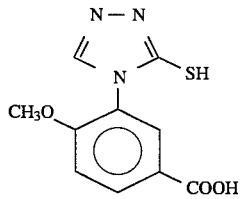

(10)

-continued
(11)
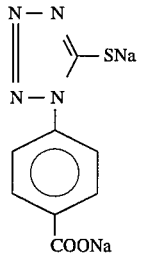
(12)
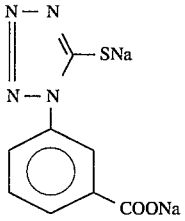
(13)
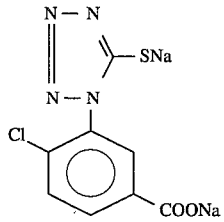
(14)
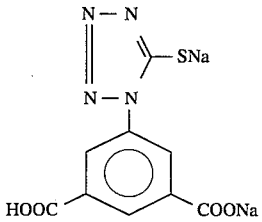
(15)
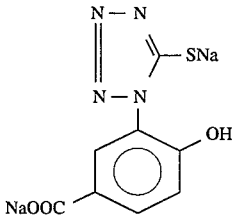
(16)
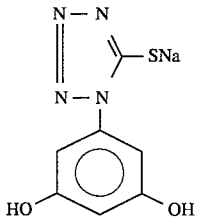
(17)
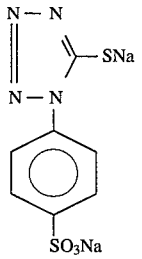
-continued
(18)
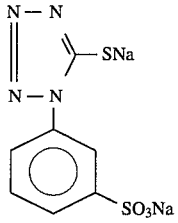
(19)
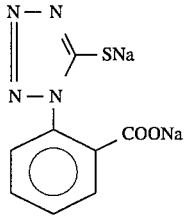
(20)
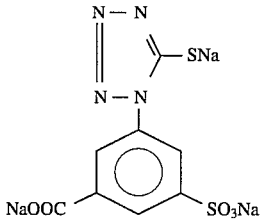
(21)
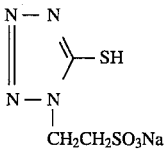
(22)
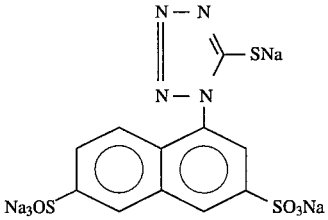
(23)
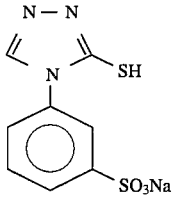
(24)
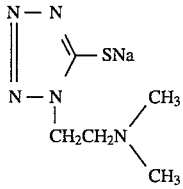
(25)
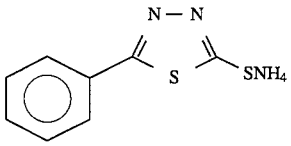

-continued (26)

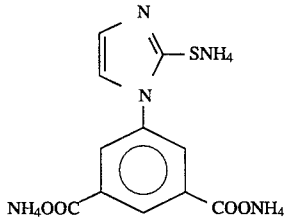

(27)

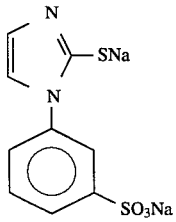

(28)

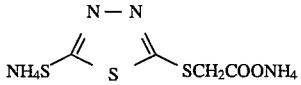

(29)

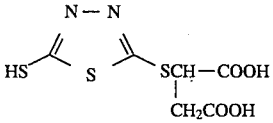

(30)

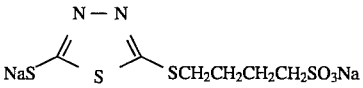

(31)

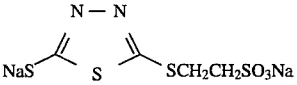

(32)

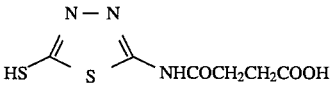

(33)

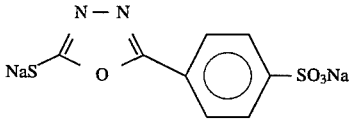

(34)

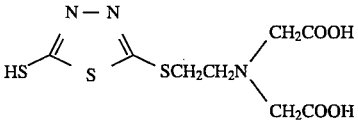

(35)

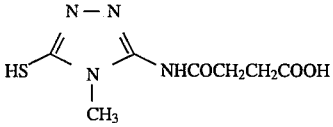

(36)

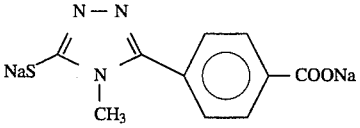

(37)

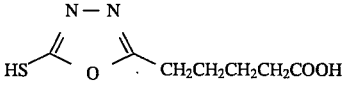

-continued (38)

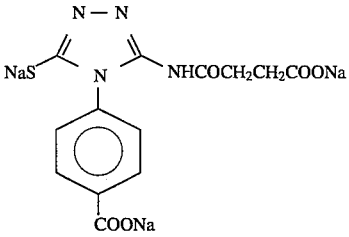

(39)

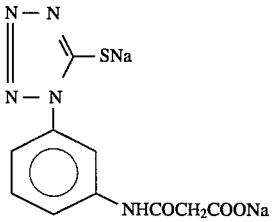

(40)

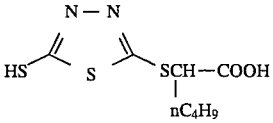

(41)

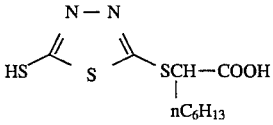

(42)

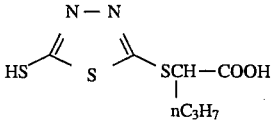

(43)

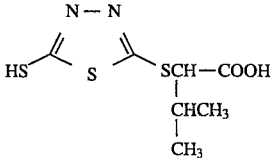

The compound of the formula (A) is known, and can be synthesized by the methods disclosed in U.S. Pat. Nos. 2,585,388 and 2,541,924, JP-B-42-21842, JP-A-53-50169, British Patent 1,275,701, D. A. Berges et al., "Journal of the Heterocyclic Chemistry," Vol. 15, No. 981 (1978), "The Chemistry of Heterocyclic Chemistry, Imidazole and Derivatives, Part I", pp. 336–9, "Chemical Abstract," Vol. 58, No. 7921 (1963), p. 394, E. Hoggarth, "Journal of Chemical Society," pp. 1160–7 (1949), S. R. Saudler, W. Karo, "Organic Functional Group Preparations," Academic Press, pp. 312–5 (1968), M. Chamdon, et al., "Bulletin de la Societe Chimique de France," 723 (1954), D. A. Shirley, D. W. Alley, "Journal of American Chemical Society," 79, 4922 (1954), A. Wohl, W. Marchwald, "Berichte" (Journal of German Chemical Society), Vol. 22, pp. 568 (1889), Journal of American Chemical Society, 44, pp. 1502–10, U.S. Pat. No. 3,017,270, British Patent 940,169, JP-B-49-8334, JP-A-55-59463, "Advanced in Heterocyclic Chemistry," 9, 165–209 (1968), West German Patent 2,716,707, "The Chemistry of Heterocyclic Compounds Imidazole and Derivatives," Vol. 1, p. 384, "Organic Synthesis," IV., 569 (1963), "Berichte," 9, 465 (1976), "Journal of American Chemical Society," 45, 2390 (1923), JP-A-50-89034, JP-A-53-28426, JP-A-55-21007, and JP-A-40-28496.

Preferably, the compound of the formula (A) is contained in an silver halide emulsion layer or a hydrophilic colloid layer (e.g., an interlayer, a surface protective layer, an yellow filter layer, an antihalation layer). More preferably, the compound is contained in a silver halide emulsion layer or a layer adjacent thereto.

The compound is used in an amount of $1\times10^{-7}$ to $1\times10^{-3}$ mol/m$^2$, preferably $5\times10^{-7}$ to $1\times10^{-4}$ mol/m$^2$, more preferably $1\times10^{-6}$ to $3\times10^{-5}$ mol/m$^2$.

The emulsion of the invention can be used, mixed with another emulsion. Also, two or more types of emulsions according to this invention can be used in the form of a mixture. Alternatively, the emulsion of the invention can be used, mixed with one or more other emulsions. Further, in this invention, a mixture of emulsions having different grain sizes, a mixture of emulsions having different halogen compositions, or a mixture of emulsions differing in the shape of grains can be used. Moreover, use can be made of a mixture of monodisperse emulsions, a mixture of polydisperse emulsions, a mixture of monodisperse and polydisperse emulsions.

It is particularly preferable that the silver halide grains of the present invention are mainly constructed by (111) planes. The index of plane of silver halide grains can be determined directly from electron-microscope photos of the grains. The index can be measured more accurately by a quantitative method utilizing dye adsorption, as is disclosed in Journal of Japan Chemical Society, 1984, (6), pp. 942–947. The phrase "mainly constructed by (111) planes" means that the (111) planes occupy at least 50%, preferably at least 60%, more preferably at least 70%, of the total surface area of the silver halide grain.

The silver halide grains mainly constructed by (111) planes include tabular silver halide grains (hereinafter referred to as "tabular grains"), octahedral regular crystal grains, octahedral grains with their corners chipped off, octahedral grains having rounded corners, and grains in amorphous form.

Most preferably, tabular grains are used in the present invention. The silver halide emulsion containing tabular grains, which is preferably used in the invention, will be described in detail.

As for the tabular silver halide grains used in the present invention, the term "average aspect ratio" means the average of the ratio of the diameter of any grain to the thickness thereof. In other words, the average aspect ratio is the average of values each obtained by dividing the diameter of each grain by the thickness thereof. The term "diameter" of each grain is that of the circle having the area equal to the projected area of the grain which is determined by observing the silver halide emulsion by means of a microscope or an electron microscope. Hence, the aspect ratio of 2:1 or more means that the diameter thus defined is two times or more greater than the thickness of the grain.

In the tabular silver halide grains used in the silver halide emulsion of the present invention, the diameter of the grains is 2 times or more, preferably 3 to 20 times, more preferably 4 to 15 times, particularly preferably 5 to 10 times, the thickness of the grains. The tabular silver halide grains occupy at least 50%, preferably at least 70%, more preferably at least 85%, of the total projected area of all grains contained in the emulsion.

The use of this emulsion will result in a silver halide photographic light-sensitive material which excels in sharpness. The material has excellent sharpness since the light scattering of the emulsion layers using this emulsion is far less prominent than that of a conventional emulsion layer. This can easily be proved by the experimental method which those skilled in the art usually conduct. Although it remains unclear why the light scattering of a layer using an emulsion containing tabular silver halide grains is small, this is perhaps because main surfaces of a tabular silver halide grain are orientated parallel to the surface of the support.

The tabular silver halide grains have a diameter of 0.2 to 20 μm, preferably 0.3 to 10.0 μm, more preferably 0.4 to 5.0 μm. Preferably, they have a thickness of 0.5 μm or less. The "diameter" of a tabular silver halide grain is the diameter of the circle having the same area as the projected area of the grain. The "thickness" of the grain is represented by the distance between the two parallel surfaces constructing the silver halide grain.

More preferable as tabular silver halide grains for use in the present invention are those which have a diameter of 0.3 μm to 10.0 μm, a thickness of 0.1 μm to 1.0 μm, and an average aspect (diameter/thikcness) ratio of 3 to 10. If the aspect ratio exceeds 10, the photographic properties of the light-sensitive material will abnormally change in some cases when the material is bent, wound tightly, or scratched with a sharp object. More preferably is a silver halide emulsion which contains grains having a diameter of 0.4 μm to 5.0 μm, in which grains having an average aspect (diameter/thickness) ratio of 5 to 10 occupy at least 85% of the total projected area of all grains contained in the emulsion.

The tabular silver halide grains for use in this invention may be silver chloride, silver bromide, silver chlorobromide, silver bromoiodide, or silver bromochloroiodide. It is desirable that the grains be silver bromide, silver bromoiodide containing 15 mol % or less of silver iodide, silver bromochloroiodide containing 50 mol % or less of silver chloride and 2 mol % or less of silver iodide, or silver chlorobromide. In the case where the grains are made of a mixed silver halide, they may have either a uniform halogen composition or localized halogen composition.

The tabular silver halide grains for use in this invention may have a narrow grain size distribution or a broad grain size distribution.

Silver halide emulsions of the type for used in the invention, which contains tabular silver halide grains, are described in the report by Cugnac and Chateau, in Duffin, "Photographic Emulsion Chemistry", Focal Press, New York, 1966, pp. 66–72, and in A. P. H Trivelli and W. F. Smith, ed., "Phot. Journal," 80 (1940), p. 285. They can easily be prepared by the methods, for example the methods disclosed in JP-A-58-113927, JP-A-58-113928 and JP-A-58-127921.

More specifically, the silver halide emulsions can be prepared by forming seed crystals, 40% or more by weight of which are tabular grains, in an atmosphere of relatively high pAg and pBr of 1.3, and then growing the seed crystals while adding silver and a halogen solution simultaneously, and while maintaining similar pBr. It is desirable that silver and a halogen solution be added during the growth of grains, so that no new crystal nuclei are formed.

The size of the tabular silver halide grains can be adjusted by controlling the temperature, selecting a type or quality of a solvent, and the speed with which to add silver salt and halogen compound.

At the time of forming the tabular silver halide grains of the invention, a solvent for silver halide may be used, if necessary, in order to control the grain size, grain shape (e.g., diameter-to-thickness ratio), grain-size distribution, and grain-growth speed. The amount in which to use the solvent is preferably $10^{-3}$ to 1.0 wt % of the reaction solution used, particularly preferably $10^{-2}$ to $10^{-1}$ wt % thereof. In the present invention, with the increase in the amount of the solvent used, the grain-size distribution may become monodispersing, and the grain-growth speed can be enhanced, and also the grain thickness can increase.

The silver halide grains can be formed or physically ripened in the presence of, for example, cadmium salt, zinc salt, lead salt, thallium salt, iridium salt, complex salt thereof, rhodium salt, a complex salt thereof, iron salt, or complex salt thereof.

To form the tabular silver halide grains for use in the invention, a method is preferably used in which a silver chloride solution (e.g., $AgNO_3$ aqueous solution) and a halide solution (e.g., KBr aqueous solution) are added for increasing the speed of forming the grains, at an increased rate, in an increased amount, and in an increased concentration. Methods of this type are described in, for example, British Patents 1,335,925, 3,650,757, 3,672,900 and 4,242,445, JP-A-55-142329, and JP-A-55-158124.

It is desirable that 50% in number of all silver halide grains contained in the emulsion used in the present invention have 10 or more dislocation lines each.

Dislocation in tabular grains can be observed by a direct method disclosed in J. F. Hamilton, Phot. Sci. Eng., 11, 57 (1967) and T. Shiozawa, J. Soc. Phot. Sci. Jap., 35,213 (1972), in which use is made of a transmission electron microscope at low temperatures. More specifically, silver halide grains separated from the emulsion under a pressure which is not so high as to cause dislocation in the grains, are placed on a mesh designed for use in electron microscope observation, and are observed by the transmission method. During the observation, the grain sample is kept cooling in order not to suffer from damages (e.g., printouts) due to electron beams. In this case, the thicker the grains, the more hard it is for electron beams to pass through the grains. Hence, electron microscope of a high-pressure type (for example, 200 kv to the grains of 0.25 μm thick.) should better be employed to observe the grains clearly. The position and the number of the dislocation in each grain, which are observed in a direction perpendicular to the major surface of the grain, can be known from the photograph of the grain thus obtained.

In each of the tabular silver halide grains for use in the invention, dislocation occurs in the annular region defined between the periphery of the grain and the closed curve obtained by connecting positions each of which is away from the center of the long axis by x % of the distance between the center and the periphery. The value of x is preferably $10 \leqq x < 100$, more preferably $30 \leqq x < 98$, sill more preferably $50 \leqq x < 95$. The hexagonal figure formed by connecting the points at which dislocation initiates, i.e. the figure of the closed curve, is substantially similar to the shape of the grain, but not perfectly similar. The line of the dislocation extends from the center of the grain toward the side, but it meanders in many cases.

Regarding the number of dislocation in the tabular grain of the invention, it is preferable that 50% by number or more of the tabular grains contained in the silver halide emulsion of the invention have 10 or more dislocation lines each. More preferably, 80% by number or more of the tabular grains have 10 or more dislocation lines each. Still more preferably, 80% by number or more of the tabular grains have 20 or more dislocation lines each.

The light-sensitive material of the present invention needs only to have at least one of silver halide emulsion layers, i.e., a blue-sensitive layer, a green-sensitive layer, and a red-sensitive layer, and at least one of non-light-sensitive layers, formed on a support. A typical example is a silver halide photographic light-sensitive material having, on a support, at least one light-sensitive layers comprising a plurality of silver halide emulsion layers which are sensitive to essentially the same color sensitivity but has different sensitivities. The light-sensitive layers are unit light-sensitive layer sensitive to blue, green or red. In a multilayered silver halide color photographic light-sensitive material, the unit light-sensitive layers are generally arranged such that red-, green-, and blue-sensitive layers are formed from a support side in the order named. However, this order may be reversed or a layer sensitive to one color may be sandwiched between layers sensitive to another color in accordance with the application.

Non-light-sensitive layers such as various types of interlayers may be formed between the silver halide light-sensitive layers and as the uppermost layer and the lowermost layer.

The interlayer may contain, e.g., couplers and DIR compounds as described in JP-A-61-43748, JP-A-59-113438, JP-A-59-113440, JP-A-61-20037, and JP-A-61-20038 or a color mixing inhibitor which is normally used.

As a plurality of silver halide emulsion layers constituting each unit light-sensitive layer, a two-layered structure of high- and low-sensitivity emulsion layers can be preferably used as described in West German Patent 1,121,470 or British Patent 923,045. Usually, layers are preferably arranged such that the sensitivity is sequentially decreased toward a support, and a non-light-sensitive layer may be formed between the silver halide emulsion layers. In addition, as described in JP-A-57-112751, JP-A-62-200350, JP-A-62-206541, and JP-A-62-206543, layers may be arranged such that a low-sensitivity emulsion layer is formed remotely from a support and a high-sensitivity layer is formed close to the support.

More specifically, layers may be arranged from the farthest side from a support in an order of low-sensitivity blue-sensitive layer (BL)/high-sensitivity blue-sensitive layer (BH)/high-sensitivity green-sensitive layer (GH)/low-sensitive green-sensitive layer (GL)/high-sensitivity red-sensitive layer (RH)/low-sensitivity red-sensitive layer (RL), an order of BH/BL/GL/GH/RH/RL, or an order of BH/BL/GH/GL/RL/RH.

In addition, as described in JP-B-55-34932, layers may be arranged from the farthest side from a support in an order of blue-sensitive layer/GH/RH/GL/RL. Furthermore, as described in JP-A-56-25738 and JP-A-62-63936, layers may be arranged from the farthest side from a support in an order of blue-sensitive layer/GL/RL/GH/RH.

As described in JP-B-49-15495, three layers may be arranged such that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer, i.e., three layers having different sensitivities may be arranged such that the sensitivity is sequentially decreased toward the support. When a layer structure is constituted by three layers having different sensitivities, these layers may be arranged in an order of medium-sensitivity emulsion layer/high-sensitivity emulsion layer/low-sensitivity emulsion layer from the farthest side from a support in a layer sensitive to one color as described in JP-A-59-202464.

Also, an order of high-sensitivity emulsion layer/low-sensitivity emulsion layer/medium-sensitivity emulsion layer or low-sensitivity emulsion layer/medium-sensitivity emulsion layer/high-sensitivity emulsion layer may be adopted. Furthermore, the arrangement can be changed as described above even when four or more layers are formed.

To improve the color reproduction, a donor layer (CL) of interimage effects can be arranged near to, or arranged adjacent to, a main light-sensitive layer BL, GL or RL. The donor layer should have a spectral sensitivity distribution which is different from that of the main light-sensitive layer. Donor layers of this type are disclosed in U.S. Pat. No. 4,663,271, U.S. Pat. Nos. 4,705,744, 4,707,436, JP-A-62-160448, and JP-A-63-89850.

As described above, various layer configuration and arrangements can be selected in accordance with the application of the light-sensitive material.

Silver halide grains other than those for use in the present invention will be described.

A preferable silver halide contained in photographic emulsion layers of the photographic light-sensitive material of the present invention is silver bromoiodide, silver chloroiodide, or silver bromochloroiodide containing about 30 mol % or less of silver iodide. The most preferable silver halide is silver bromoiodide or silver bromochloroiodide containing about 2 mol % to about 10 mol % of silver iodide.

Silver halide grains contained in the photographic emulsion may have regular crystals such as cubic, octahedral, or tetradecahedral crystals, irregular crystals such as spherical or tabular crystals, crystals having defects such as crystal twin faces, or composite shapes thereof.

The silver halide may comprise fine grains having a grain size of about 0.2 μm or less or large grains having a diameter of a projected surface area of up to about 10 μm, and the emulsion may be either a poly-dispersed emulsion or a monodispersed emulsion.

The silver halide photographic emulsion which can be used in the present invention can be prepared by methods described in, for example, Research Disclosure (RD) No. 17,643 (December, 1978), pp. 22 to 23, "I. Emulsion preparation and types", RD No. 18,716 (November, 1979), page 648, and RD No. 307,105 (November, 1989), pp. 863 to 865; P. Glafkides, "Chemie et Phisique Photographique", Paul Montel, 1967; G. F. Duffin, "Photographic Emulsion Chemistry", Focal Press, 1966; and V. L. Zelikman et al., "Making and Coating Photographic Emulsion", Focal Press, 1964.

Monodispersed emulsions described in, for example, U.S. Pat. Nos. 3,574,628 and 3,655,394 and British Patent 1,413,748 are also preferred.

Also, tabular grains having an aspect ratio of about 3 or more can be used in the present invention. The tabular grains can be easily prepared by methods described in, e.g., Gutoff, "Photographic Science and Engineering", Vol. 14, PP. 248 to 257 (1970); U.S. Pat. Nos. 4,434,226, 4,414,310, 4,433,048, and 4,439,520, and British Patent 2,112,157.

The crystal structure may be uniform, may have different halogen compositions in the interior and the surface thereof, or may be a layered structure. Alternatively, a silver halide having a different composition may be joined by an epitaxial junction or a compound other than a silver halide such as silver rhodanide or zinc oxide may be joined. A mixture of grains having various types of crystal shapes may be used.

The above emulsion may be of any of a surface latent image type in which a latent image is mainly formed on the surface of each grain, an internal latent image type in which a latent image is formed in the interior of each grain, and a type in which a latent image is formed on the surface and in the interior of each grain. However, the emulsion must be of a negative type. when the emulsion is of an internal latent image type, it may be a core/shell internal latent image type emulsion described in JP-A-63-264740. A method of preparing this core/shell internal latent image type emulsion is described in JP-A-59-133542. Although the thickness of a shell of this emulsion changes in accordance with development or the like, it is preferably 3 to 40 nm, and most preferably, 5 to 20 nm.

A silver halide emulsion layer is normally subjected to physical ripening, chemical ripening, and spectral sensitization steps before it is used. Additives for use in these steps are described in Research Disclosure Nos. 17,643, 18,716, and 307,105 and they are summarized in the following table X (represented later).

In the light-sensitive material of the present invention, two or more types of light-sensitive silver halide emulsions different in at least one characteristic of a grain size, a grain size distribution, a halogen composition, a grain shape, and sensitivity can be mixed in one layer.

Surface-fogged silver halide grains described in U.S. Pat. No. 4,082,553, internally fogged silver halide grains described in U.S. Pat. No. 4,626,498 or JP-A-59-214852, and colloidal silver can be preferably used in a light-sensitive silver halide emulsion layer and/or a substantially non-light-sensitive hydrophilic colloidal layer. The internally fogged or surface-fogged silver halide grains are silver halide grains which can be uniformly (non-imagewise) developed in either a non-exposed portion or an exposed portion of the light-sensitive material. A method of preparing the internally fogged or surface-fogged silver halide grain is described in U.S. Pat. No. 4,626,498 or JP-A-59-214852.

The silver halides which form the core of the internally fogged core/shell silver halide grains may have the same halogen composition or different halogen compositions. Examples of the internally fogged or surface-fogged silver halide are silver chloride, silver chlorobromide, silver bromoiodide, and silver bromochloroiodide. Although the grain size of these fogged silver halide grains is not particularly limited, an average grain size is 0.01 to 0.75 μm, and most preferably, 0.05 to 0.6 μm. The grain shape is also not particularly limited but may be a regular grain shape. Although the emulsion may be a polydispersed emulsion, it is preferably a monodispersed emulsion (in which at least 95% in weight or number of silver halide grains have a grain size falling within the range of 40% of an average grain size).

In the present invention, a non-light-sensitive fine grain silver halide is preferably used. The non-light-sensitive fine grain silver halide means silver halide fine grains not sensitive upon imagewise exposure for obtaining a dye image and essentially not developed in development. The non-light-sensitive fine grain silver halide is preferably not fogged beforehand.

The fine grain silver halide contains 0 to 100 mol % of silver bromide and may contain silver chloride and/or silver iodide as needed. Preferably, the fine grain silver halide contains 0.5 to 10 mol % of silver iodide.

An average grain size (an average value of equivalent-circle diameters of projected surface areas) of the fine grain silver halide is preferably 0.01 to 0.5 μm, and more preferably, 0.02 to 0.2 μm.

The fine grain silver halide can be prepared by a method similar to a method of preparing normal light-sensitive silver halide. In this preparation, the surface of a silver halide grain need not be subjected to either optical sensitization or spectral sensitization. However, before the silver halide grains are added to a coating solution, a known stabilizer such as a triazole compound, an azaindene compound, a benzothiazolium compound, a mercapto compound, or a zinc compound is preferably added. This fine grain silver halide grain containing layer preferably contains colloidal silver.

A coating silver amount of the light-sensitive material of the present invention is preferably 6.0 g/m$^2$ or less, and most preferably, 4.5 g/m$^2$ or less.

Known photographic additives usable in the present invention are also described in the above three RDs, and they are summarized in the following Table X:

TABLE X

| Additives | RD17643 | RD18716 | RD307105 |
|---|---|---|---|
| 1. Chemical sensitizers | page 23 | Page 648, right column | page 866 |
| 2. Sensitivity increasing agents | | Page 648, right column | |
| 3. Spectral sensitizers, super sensitizers | page 23–24 | page 648, right column to page 649, right column | page 866–868 |
| 4. Brighteners | page 24 | page 647, right column | page 868 |
| 5. Antifoggants and stabilizers | page 24–25 | page 649, right column | page 868–870 |
| 6. Light absorbent. filter dye. ultraviolet absorbents | page 25–26 | page 649, right column to page 650, left column | page 873 |
| 7. Stain preventing agents | page 25, right column | page 650, left to right columns | page 872 |
| 8. Dye image stabilizer | page 25 | Page 650, left column | page 872 |
| 9. Hardening agents | page 26 | page 651, left column | page 874–875 |
| 10. Binder | page 26 | page 651, left column | page 873–874 |
| 11. Plasticizers. lubricants | page 27 | page 650, right column | page 876 |
| 12. Coating aids. surface active agents | page 26–27 | page 650, right column | page 875–876 |
| 13. Antistatic agents | page 27 | page 650, right column | page 876–877 |
| 14. Matting agent | | page 650, right column | page 878–879 |

In order to prevent degradation in photographic properties caused by formaldehyde gas, a compound described in U.S. Pat. No. 4,411,987 or 4,435,503, which can react with formaldehyde and fix the same, is preferably added to the light-sensitive material.

The light-sensitive material of the present invention preferably contains mercapto compounds described in U.S. Pat. Nos. 4,740,454 and 4,788,132, JP-A-62-18539, and JP-A-1-283551, in addition to mercapto compounds of the present invention described above.

The light-sensitive material of the present invention preferably contains compounds for releasing a fogging agent, a development accelerator, a silver halide solvent, or precursors thereof described in JP-A-l-106052 regardless of a developed silver amount produced by the development.

The light-sensitive material of the present invention preferably contains dyes dispersed by methods described in International Disclosure WO 88/04794 and JP-A-1-502912 or dyes described in European Patent 317,308A, U.S. Pat. No. 4,420,555, and JP-A-1-259358.

Various color couplers can be used in the present invention, and specific examples of these couplers are described in patents described in above-mentioned Re search Disclosure (RD), No. 17643, VII-C to VII-G and RD No. 307105, VII-C to VII-G.

Preferable examples of a yellow coupler are described in, e.g., U.S. Pat. Nos. 3,933,501, 4,022,620, 4,326,024, 4,401,752, and 4,248,961, JP-B-58-10739, British Patents 1,425,020 and 1,476,760, U.S. Pat. Nos. 3,973,968, 4,314,023, and 4,511,649, and European Patent 249,473A.

Examples of a magenta coupler are preferably 5-pyrazolone type and pyrazoloazole type compounds, and more preferably, compounds described in, for example, U.S. Pat. Nos. 4,310,619 and 4,351,897, European Patent 73,636, U.S. Pat. Nos. 3,061,432 and 3,725,067, Research Disclosure No. 24220 (June 1984), JP-A-60-33552, Research Disclosure No. 24230 (June 1984), JP-A-60-43659, JP-A-61-72238, JP-A-60-35730, JP-A-55-118034, and JP-A-60-185951, U.S. Pat. Nos. 4,500,630, 4,540,654, and 4,556,630, and WO No. 88/04795.

Examples of a cyan coupler are phenol type and naphthol type couplers. Of these, preferable are those described in, for example, U.S. Pat. Nos. 4,052,212, 4,146,396, 4,228,233, 4,296,200, 2,369,929, 2,801,171, 2,772,162, 2,895,826, 3,772,002, 3,758,308, 4,334,011, and 4,327,173, West German Patent Laid-open Application 3,329,729, European Patents 121,365A and 249,453A, U.S. Pat. Nos. 3,446,622, 4,333,999, 4,775,616, 4,451,559, 4,427,767, 4,690,889, 4,254,212, and 4,296,199, and JP-A-61-42658. Also, the pyrazoloazole type couplers disclosed in JP-A-64-553, JP-A-64-554, JP-A-64-555 and JP-A-64-556, and imidazole type couplers disclosed in U.S. Pat. No. 4,818,672 can be used as cyan coupler in the present invention.

Typical examples of a polymerized dye-forming coupler are described in U.S. Pat. Nos. 3,451,820, 4,080,211, 4,367,282, 4,409,320, and 4,576,910, British Patent 2,102,137, and European Patent 341,188A.

Preferable examples of a coupler capable of forming colored dyes having proper diffusibility are those described in U.S. Pat. No. 4,366,237, British Patent 2,125,570, European Patent 96,570, and West German Laid-open Patent Application No. 3,234,533.

Preferable examples of a colored coupler for correcting additional, undesirable absorption of a colored dye are those described in Research Disclosure No. 17643, VII-G, No. 307105, VII-G, U.S. Pat. No. 4,163,670, JP-B-57-39413, U.S. Pat. Nos. 4,004,929 and 4,138,258, and British Patent 1,146,368. A coupler for correcting unnecessary absorption of a colored dye by a fluorescent dye re leased upon coupling described in U.S. Pat. No. 4,774,181 or a coupler having a dye precursor group which can react with a developing agent to form a dye as a split-off group described in U.S. Pat. No. 4,777,120 may be preferably used.

Compounds releasing a photographically useful residue upon coupling are preferably used in the present invention. DIR couplers, i.e., couplers releasing a development inhibitor are those described in the patents cited in the above-described RD No. 17643, VII-F, RD No. 307105, VII-F, JP-A-57-151944, JP-A-57-154234, JP-A-60-184248, JP-A-63-37346, JP-A-63-37350, and U.S. Pat. Nos. 4,248,962 and 4,782,012, in addition to the compounds represented by formula (I) and (II).

Research Disclosures Nos. 11449 and 24241, JP-A-61-201247, and the like disclose couplers which release breaching accelerator. These couplers effectively serve to shorten the time of any process that involves breaching. They are effective, particularly when added to light-sensitive material containing tabular silver halide grains mentioned-above. Preferable examples of a coupler for imagewise releasing a nucleating agent or a development accelerator are described in British Patents 2,097,140 and 2,131,188, JP-A-59-157638, and JP-A-59-170840. In addition, compounds for releasing a fogging agent, a development accelerator, or a silver halide solvent upon redox reaction with an oxidized form of a developing agent, described in JP-A-60-107029, JP-A-60-252340, JP-A-1-44940, and JP-A-1-45687, can also be preferably used.

Examples of a compound which can be used in the light-sensitive material of the present invention are competing couplers described in, for example, U.S. Pat. No. 4,130,427; poly-equivalent couplers described in, e.g., U.S. Pat. Nos. 4,283,472, 4,338,393, and 4,310,618; a DIR redox compound releasing coupler, a DIR coupler releasing coupler, a DIR coupler releasing redox compound, or a DIR redox releasing redox compound described in, for example, JP-A-60-185950 and JP-A-62-24252; couplers re leasing a dye which turns to a colored form after being released described in European Patent 173,302A and 313,308A; a ligand releasing coupler described in, e.g., U.S. Pat. No. 4,555,477; a coupler releasing a leuco dye described in JP-A-63-75747; and a coupler releasing a fluorescent dye described in U.S. Pat. No. 4,774,181.

The couplers for use in this invention can be added to the light-sensitive material by various known dispersion methods.

Examples of a high-boiling solvent to be used in the oil-in-water dispersion method are described in e.g. U.S. Pat. No. 2,322,027. Examples of a high-boiling organic solvent to be used in the oil-in-water dispersion method and having a boiling point of 175° C. or more at atmospheric pressure are phthalate esters (e.g., dibutylphthalate, dicyclohexylphthalate, di-2-ethylhexylphthalate, decylphthalate, bis(2,4-di-t-amylphenyl)phthalate, bis(2,4-di-t-amylphenyl-)isophthalate, bis(1,1-di-ethylpropyl)phthalate), phosphate or phosphonate esters (e.g., triphenylphosphate, tricresylphosphate, 2-ethylhexyldiphenylphosphate, tricyclohexylphosphate, tri-2-ethylhexylphosphate, tridodecylphosphate, tributoxyethylphosphate, trichloropropylphosphate, and di-2-ethylhexylphenylphosphonate), benzoate esters (e.g., 2-ethylhexylbenzoate, dodecylbenzoate, and 2-ethylhexyl-p-hydroxybenzoate), amides (e.g., N,N-diethyldodecaneamide, N,N-diethyllaurylamide, and N-tetradecylpyrrolidone), alcohols or phenols (e.g., isostearylalcohol and 2,4-di-tert-amylphenol), aliphatic carboxylate esters (e.g., bis(2-ethylhexyl)sebacate, dioctylazelate, glyceroltributylate, isostearyllactate, and trioctylcitrate), an aniline derivative (e.g., N,N-dibutyl-2-butoxy-5-tert-octylaniline), and hydrocarbons (e.g., paraffin, dodecylbenzene, and diisopropylnaphthalene). An organic solvent having a boiling point of about 30° C. or more, and preferably, 50° C. to about 160° C. can be used as an auxiliary solvent. Typical examples of the auxiliary solvent are ethyl acetate, butyl acetate, ethyl propionate, methylethylketone, cyclohexanone, 2-ethoxyethylacetate, and dimethylformamide.

Steps and effects of a latex dispersion method and examples of a loadable latex are described in, e.g., U.S. Pat. No. 4,199,363 and German Laid-open Patent Application Nos. 2,541,274 and 2,541,230.

Various types of antiseptics and fungicides are preferably added to the color light-sensitive material of the present invention. Examples of the antiseptics and the fungicides are phenetyl alcohol, and 1,2-benzisothiazoline-3-one, n-butyl-p-hydroxybenzoate, phenol, 4-chloro-3,5-dimethylphenol, 2-phenoxyethanol, and 2-(4-thiazolyl) benzimidazole, which are described in JP-A-63-257747, JP-A-62-272248, and JP-A-1-80941.

The present invention can be applied to various color light-sensitive materials. Examples of the material are a color negative film for a general purpose or a movie, a color reversal film for a slide or a television, color paper, a color positive film, and color reversal paper.

A support which can be suitably used in the present invention is described in, e.g., RD. No. 17643, page 28, RD. No. 18716, from the right column, page 647 to the left column, page 648, and RD. No. 307105, page 879.

In the light-sensitive material of the present invention, the sum total of film thicknesses of all hydrophilic colloidal layers at the side having emulsion layers is preferably 28 μm or less, more preferably, 23 μm or less, much more preferably, 18 μm or less, and most preferably, 16 μm or less. A film swell speed $T_{1/2}$ is preferably 30 sec. or less, and more preferably, 20 sec. or less. The film thickness means a film thickness measured under moisture conditioning at a temperature of 25° C. and a relative humidity of 55% (two days). The film swell speed $T_{1/2}$ can be measured in accordance with a known method in the art. For example, the film swell speed $T_{1/2}$ can be measured by using a swell meter described in Photographic Science & Engineering, A. Green et al., Vol. 19, No. 2, pp. 124 to 129. When 90% of a maximum swell film thickness reached by performing a treatment by using a color developing agent at 30° C. for 3 min. and 15 sec. is defined as a saturated film thickness, $T_{1/2}$ is defined as a time required for reaching ½ of the saturated film thickness.

The film swell speed $T_{1/2}$ can be adjusted by adding a film hardening agent to gelatin as a binder or changing aging conditions after coating. A swell ratio is preferably 150% to 400%. The swell ratio is calculated from the maximum swell film thickness measured under the above conditions in accordance with a relation: (maximum swell film thickness—film thickness)/film thickness.

In the light-sensitive material of the present invention, hydrophilic colloidal layers (called back layers) having a total dried film thickness of 2 to 20 μm are preferably formed on the side opposite to the side having emulsion layers. The back layers preferably contain, e.g., the light absorbent, the filter dye, the ultraviolet absorbent, the antistatic agent, the film hardener, the binder, the plasticizer, the lubricant, the coating aid, and the surfactant described above. The swell ratio of the back layers is preferably 150% to 500%.

The color photographic light-sensitive material according to the present invention can be developed by conventional methods described in RD. No. 17643, pp. 28 and 29, RD. No. 18716, the left to right columns, page 651, and RD. No. 307105, pp. 880 and 881.

A color developer used in development of the light-sensitive material of the present invention is an aqueous alkaline solution containing as a main component, preferably, an aromatic primary amine-based color developing agent. As the color developing agent, although an aminophenol-based compound is effective, a p-phenylenediamine-based compound is preferably used. Typical examples of the p-phenylenediamine-based compound are: 3-methyl-4-amino-N,N-diethylaniline, 3-methyl-4-amino-N-ethyl-N-β-hydroxyethylaniline, 3-methyl-4-amino-N-ethyl-N-β-methanesulfonamide ethylaniline, 3-methyl-4-amino-N-ethyl-N-β-methoxyethylaniline, 4-amino-3-methyl-N-methyl-N-(3-hydroxypropyl)aniline, 4-amino-3-methyl-N-ethyl-N-(3-hydroxypropyl)aniline, 4-amino-3-methyl-N-ethyl-N-(2-hydroxypropyl)aniline, 4-amino-3-ethyl-N-ethyl-N-(3-hydroxypropyl)aniline, 4-amino-3-methyl-N-propyl-N-(3-hydroxypropyl)aniline, 4-amino-3-propyl-N-methyl-N-(3-hydroxypropyl)aniline, 4-amino-3-methyl-N-methyl-N-(4-hydroxybutyl)aniline, 4-amino-3-methyl-N-ethyl-N-(4-hydroxybutyl)aniline, 4-amino-3-methyl-N-propyl-N-(4-hydroxybutyl)aniline, 4-amino-3-methyl-N-ethyl-N-(3-hydroxy-2-methylpropyl)aniline, 4-amino-3-methyl-N,N-bis(4-hydroxybutyl)aniline, 4-amino-3-methyl-N,N-bis(5-hydroxypentyl)aniline, 4-amino-3-methyl-N-(5-hydroxypentyl)-N-(4-hydroxybutyl)aniline, 4-amino-3-methoxy-N-ethyl-N-(4-hydroxybutyl)aniline, 4-amino-3-ethoxy-N,N-bis(5-hydroxypentyl)aniline, 4-amino-N-propyl-N-(4-hydroxy butyl)aniline, and the sulfates, hydrochlorides and p-toluenesulfonates thereof. Of these compounds, 3-methyl-4-amino-N-ethyl-N-β-hydroxyethyl aniline, 4-amino-3-methyl-N-ethyl-N-(3-hydroxypropyl)aniline, 4-amino-3-methyl-N-ethyl-N-(3-hydroxybutyl)aniline, and the sulfates, hydrochlorides and p-toluenesulfonates thereof are preferred in particular. The most preferable are 4-amino-3-methyl-N-ethyl-N-(3-hydroxybutyl)aniline and the salts thereof, which help to improve color forming properties and provide a certain color density even if the amount of developed silver is small, thereby it is possible to shorten developing time and to improve desilvering properties. These compounds can be used in a combination of two or more thereof in accordance with the application.

In general, the color developer contains a pH buffering agent such as a carbonate, a borate, or a phosphate of an alkali metal, and a development restrainer or an antifoggant such as a chloride, a bromide, an iodide, a benzimidazole, a benzothiazole, or a mercapto compound. If necessary, the color developer may also contain a preservative such as hydroxylamine, diethylhydroxylamine, a sulfite, a hydrazine such as N,N-biscarboxymethyl hydrazine, a phenylsemicarbazide, triethanolamine, or a catechol sulfonic acid; an organic solvent such as ethyleneglycol or diethyleneglycol; a development accelerator such as benzylalcohol, polyethyleneglycol, a quaternary ammonium salt or an amine; a dye-forming coupler; a competing coupler; an auxiliary developing agent such as 1-phenyl-3-pyrazolidone; a viscosity-imparting agent; and various types of a chelating agent such as aminopolycarboxylic acid, an aminopolyphosphonic acid, an alkylphosphonic acid, or a phosphonocarboxylic acid. Examples of the chelating agent are ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, and ethylenediamine-di(o-hydroxyphenylacetic acid), and salts thereof.

In order to perform reversal development, black-and-white development is performed and then color development is performed. As a black-and-white developer, well-known black-and-white developing agents, e.g., a dihydroxybenzene such as hydroquinone, a 3-pyrazolidone such as 1-phenyl-3-pyrazolidone, and an aminophenol such as N-methyl-p-aminophenol can be used singly or in a combination of two or more thereof. The pH of the color and black-and-white developers is generally 9 to 12. Although the quantity of replenisher of the developer depends on a color photographic light-sensitive material to be processed, it is generally 3 liters or less per $m^2$ of the light-sensitive material. The quantity of replenisher can be decreased to be 500 ml or less by decreasing a bromide ion concentration in a replenisher. In order to decrease the quantity of the replenisher, a contact area of a processing tank with air is preferably decreased to prevent evaporation and oxidation of the solution upon contact with air.

The contact area of the solution with air in a processing tank can be represented by an aperture efficienty defined below:

Aperture efficiency = {The value of contact area of processing solution with air represented by $cm^2$ unit}/{The value of volume of the solution represented by $cm^3$ unit}

The above aperture efficiency is preferably 0.1 or less, and more preferably, 0.001 to 0.05. In order to reduce the aperture efficiency, a shielding member such as a floating cover may be provided on the surface of the photographic processing solution in the processing tank. In addition, a method of using a movable cover described in JP-A-1-82033 or a slit developing method described in JP-A-63-216050 may be used. The aperture efficiency is preferably reduced not only in color and black-and-white development steps but also in all subsequent steps, e.g., bleaching, bleach-fixing, fixing, washing, and stabilizing steps. In addition, the quantity of replenisher can be reduced by using a means of suppressing storage of bromide ions in the developing solution.

A color development time is normally 2 to 5 minutes. The processing time, however, can be shortened by setting a high temperature and a high pH and using the color developing agent at a high concentration.

The photographic emulsion layer is generally subjected to bleaching after color development. The bleaching may be performed either simultaneously with fixing (bleach-fixing) or independently thereof. In addition, in order to increase a processing speed, bleach-fixing may be performed after bleaching. Also, processing may be performed in a bleach-fixing bath having two continuous tanks, fixing may be performed before bleach-fixing, or bleaching may be performed after bleach-fixing, in accordance with the application. Examples of the bleaching agent are a compound of a multivalent metal, e.g., iron(III), peroxides; quinones; and a nitro compound. Typical examples of the bleaching agent are an organic complex salt of iron(III), e.g., a complex salt of iron(III)and an aminopolycarboxylic acid such as ethylenediaminetetraacetic acid, diethylenetriaminepentaacetic acid, cyclohexanediaminetetraacetic acid, methyliminodiacetic acid, and 1,3-diaminopropanetetraacetic acid, and glycoletherdiaminetetraacetic acid; or a complex salt of iron(III) and citric acid, tartaric acid, or malic acid. Of these compounds, an iron(III) complex salt of aminopolycarboxylic acid such as an iron(III) complex salt of ethylenediaminetetraacetic acid or 1,3-diaminopropanetetraacetic acid is preferred because it can increase a processing speed and prevent an environmental contamination. The iron(III) complex salt of aminopolycarboxylic acid is useful in both the bleaching and bleach-fixing solutions. The pH of the bleaching or bleach-fixing solution using the iron(III) complex salt of aminopoly carboxylic acid is normally 4.0 to 8. In order to increase the processing speed, however, processing can be performed at a lower pH.

A bleaching accelerator can be used in the bleaching solution, the bleach-fixing solution, and their pre-bath, if necessary. Useful examples of the bleaching accelerator are: compounds having a mercapto group or a disulfide group described in, for example, U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, and JP-A-53-141623, and JP-A-53-28426, and Research Disclosure No. 17129 (July, 1978); a thiazolidine derivative described in JP-A-50-140129; thiourea derivatives described in JP-B-45-8506, JP-A-52-20832, JP-A-53-32735, and U.S. Pat. No. 3,706,561; iodide salts described in west German Patent 1,127,715 and JP-A-58-16235; polyoxyethylene compounds described in West German Patents 966,410 and 2,748,430; a polyamine compound described in JP-B-45-8836; compounds described in JP-A-49-40943, JP-A-49-59644, JP-A-53-94927, JP-A-54-35727, JP-A-55-26506, and JP-A-58-163940; and a bromide ion. Of these compounds, a compound having a mercapto group or a disulfide group is preferable since the compound has a large accelerating effect. In particular, compounds described in U.S. Pat. No. 3,893,858, west German Patent 1,290,812, and JP-A-53-95630 are preferred. A compound described in U.S. Pat. No. 4,552,834 is also preferable. These bleaching accelerators may be added in the light-sensitive material. These bleaching accelerators are useful especially in bleach-fixing of a photographic color light-sensitive material.

The bleaching solution or the bleach-fixing solution preferably contains, in addition to the above compounds, an organic acid in order to prevent a bleaching stain. The most preferable organic acid is a compound having an acid dissociation constant (pKa) of 2 to 5, e.g., acetic acid, propionic acid, or hydroxy acetic acid.

Examples of the fixing agent to be used in the fixing solution or the bleach-fixing solution are thiosulfate, a thiocyanate, a thioether-based compound, a thiourea and a large amount of an iodide. Of these compounds, a thiosulfate, especially, ammonium thiosulfate can be used in the widest range of applications. In addition, a combination of thiosulfate and a thiocyanate, a thioether-based compound, or thiourea is preferably used. As a preservative of the fixing solution or the bleach-fixing solution, a sulfite, a bisulfite, a carbonyl bisulfite adduct, or a sulfinic acid compound described in European Patent 294,769A is preferred. In addition, in order to stabilize the fixing solution or the bleach-fixing solution, various types of aminopolycarboxylic acids or organic phosphonic acids are preferably added to the solution.

In the present invention, 0.1 to 10 mol/l of a compound having a pKa of 6.0 to 9.0 are preferably added to the fixing solution or the bleach-fixing solution in order to adjust the pH. Preferable examples of the compound are imidazoles such as imidazole, 1-methylimidazole, 1-ethylimidazole, and 2-methylimidazole.

The total time of a desilvering step is preferably as short as possible as long as no desilvering defect occurs. A preferable time is one to three minutes, and more preferably, one to two minutes. A processing temperature is 25° C. to 50° C., and preferably, 35° C. to 45° C. within the preferable temperature range, a desilvering speed is increased, and generation of a stain after the processing can be effectively prevented.

In the desilvering step, stirring is preferably as strong as possible. Examples of a method of intensifying the stirring are a method of colliding a jet stream of the processing solution against the emulsion surface of the light-sensitive material described in JP-A-62-183460, a method of increasing the stirring effect using rotating means described in JP-A-62-183461, a method of moving the light-sensitive material while the emulsion surface is brought into contact with a wiper blade provided in the solution to cause disturbance on the emulsion surface, thereby improving the stirring effect, and a method of increasing the circulating flow amount in the overall processing solution. Such a stirring improving means is effective in any of the bleaching solution, the bleach-fixing solution, and the fixing solution. It is assumed that the improvement in stirring increases the speed of supply of the bleaching agent and the fixing agent into the emulsion film to lead to an increase in desilvering speed. The above stirring improving means is more effective when the bleaching accelerator is used, i.e., significantly increases the accelerating speed or eliminates fixing interference caused by the bleaching accelerator.

An automatic developing machine for processing the light-sensitive material of the present invention preferably has a light-sensitive material conveyer means described in JP-A-60-191257, JP-A-60-191258, or JP-A-60-191259. As described in JP-A-60-191257, this conveyer means can significantly reduce carry-over of a processing solution from a pre-bath to a post-bath, thereby effectively preventing degradation in performance of the processing solution. This effect significantly shortens especially a processing time in each processing step and reduces the quantity of replenisher of a processing solution.

The photographic light-sensitive material of the present invention is normally subjected to washing and/or stabilizing steps after desilvering. An amount of water used in the washing step can be arbitrarily determined over a broad range in accordance with the properties (e.g., a property determined by the materials used, such as a coupler) of the light-sensitive material, the application of the material, the temperature of the water, the number of water tanks (the number of stages), a replenishing scheme representing a counter or forward current, and other conditions. The relationship between the amount of water and the number of water tanks in a multi-stage counter-current scheme can be obtained by a method described in "Journal of the Society of Motion Picture and Television Engineering", Vol. 64, PP. 248–253 (May, 1955). In the multi-stage counter-current scheme disclosed in this reference, the amount of water used for washing can be greatly decreased. Since washing water stays in the tanks for a long period of time, however, bacteria multiply and floating substances may be adversely attached to the light-sensitive material. In order to solve this problem in the process of the color photographic light-sensitive material of the present invention, a method of decreasing calcium and magnesium ions can be effectively utilized, as described in JP-A-62-288838. In addition, a germicide such as an isothiazolone compound and thiabendazol described in JP-A-57-8542, a chlorine-based germicide such as chlorinated sodium isocyanurate, and germicides such as benzotriazole described in Hiroshi Horiguchi et al., "Chemistry of Antibacterial and Antifungal Agents", (1986), Sankyo Shuppan, Eiseigijutsu-Kai ed., "Sterilization, Antibacterial, and Antifungal Techniques for Microorganisms", (1982), Kugyogijutsu-Kai, and Nippon Bokin Bokabi Gakkai ed., "Dictionary of Antibacterial and Antifungal Agents", (1986), can be used.

The pH of the water for washing the photographic light-sensitive material of the present invention is 4 to 9, and preferably, 5 to 8. The water temperature and the washing time can vary in accordance with the properties and applications of the light-sensitive material. Normally, the washing time is 20 seconds to 10 minutes at a temperature of 15° C. to 45° C., and preferably, 30 seconds to 5 minutes at 25° C. to 40° C. The light-sensitive material of the present invention can be processed directly by a stabilizing solution in place of washing. All known methods described in JP-A-57-8543, JP-A-58-14834, and JP-A-60-220345 can be used in such stabilizing processing.

In some cases, stabilizing is performed subsequently to washing. An example is a stabilizing bath containing a dye stabilizing agent and a surface-active agent to be used as a final bath of the photographic color light-sensitive material. Examples of the dye stabilizing agent are formalin, an aldehyde such as glutaraldehyde, an N-methylol compound, hexamethylenetetramine, and an adduct of aldehyde sulfite.

various cheleting agents and fungicides can be added to the stabilizing bath.

An overflow solution produced upon washing and/or replenishment of the stabilizing solution can be resued in another step such as a desilvering step.

In the processing using an automatic developing machine or the like, if each processing solution described above is condensed by evaporation, water is preferably added to correct condensation.

The silver halide color light-sensitive material of the present invention may contain a color developing agent in order to simplify processing and increases a processing speed. For this purpose, various types of precursors of a color developing agent can be preferably used. Examples of the precursor are an indoaniline-based compound described in U.S. Pat. No. 3,342,597, Schiff base compounds described in U.S. Pat. No. 3,342,599 and Research Disclosure (RD) Nos. 14850 and 15159, an aldol compound described in RD No. 13924, a metal salt complex described in U.S. Pat. No. 3,719,492, and an urethane-based compound described in JP-A-53-135628.

The silver halide color light-sensitive material of the present invention may contain various 1-phenyl-3-pyrazolidones in order to accelerate color development, if necessary. Typical examples of the compound are described in JP-A-56-64339, JP-A-57-144547, and JP-A-58-115438.

Each processing solution in the present invention is used at a temperature of 10° C. to 50° . Although a normal processing temperature is 33° C. to 38°, processing may be accelerated at a higher temperature to shorten a processing time, or image quality or stability of a processing solution may be improved at a lower temperature.

EXAMPLES

The present invention will be described in more detail below by way of its examples, but the present invention is not limited to these examples.

Example 1

(Preparation of Emulsions)

First, 30 g of inactive gelatin and 6 g of potassium bromide were dissolved in 1 liter of distilled water, forming an aqueous solution. While stirring this aqueous solution at 75° C., 35 cc of an aqueous solution containing 5.0 g of silver nitrate and 35 cc of an aqueous solution containing 3.2 g of potassium bromide and 0.98 g of potassium iodide were added to the solution, each at the flow rate of 70 cc/min. over 30 seconds. Thereafter, the pAg value of the resultant solution was increased to 10, and the solution was ripened for 30 minutes, thereby preparing a seed emulsion.

Next, a predetermined part of 1 liter of an aqueous solution containing 145 g of silver nitrate, and an aqueous solution containing a mixture of potassium bromide and potassium iodide were added to the solution at a predetermined temperature and a predetermined pAg value at an addition speed nearly equal to the critical growth speed in the same mol amount, thereby preparing an emulsion containing tabular core emulsion. Further, the remaining part of the silver nitrate aqueous solution and an aqueous solution containing a mixture of potassium bromide and potassium iodide having a composition different from that of the mixture used during preparing a core emulsion were added to the tabular core emulsion, at a speed nearly equal to the critical growth speed in the same mol amount and coated with core, thereby preparing core/shell type silver bromoiodide emulsion 1 to 5. Of these emulsions, emulsions 2 to 5 were tabular emulsions according to the present invention.

The aspect ratio of each emulsion was adjusted by selecting a proper value for pAg at the time of preparing the cores and shells. The particulars of the emulsions 1 to 5 were as is shown in Table 1 (presented later).

By means of a transmission electron microscope it was ascertained that 80% or more of the grains in each emulsion had 10 or more dislocation lines each.

Emulsions 1 to 5 were heated to 60° C. Sensitizing dyes I to VII, which will be specified later, were added to emulsions 1 to 5, each in the amount specified in the "Compositions of light-sensitive layers" of Example 1 (described later)and determined in accordance with the color sensitivity. (To be more specific, the dyes I to III were added to the red-sensitive emulsion layers; the dyes IV to VI to the green-sensitive layers; and the dye VII to the blue-sensitive layers.) Next, emulsions 1 to 5 were maintained at 60° C. for 20 minutes, and sodium thiosulfate, chloroauric acid, and potassium thiocyanate, which should preferably used in the invention, were added to the emulsions, at pH of 6.3, at 60° C. and in the amounts shown in Table 2 (presented later). As a result of this, optimum gold-sulfur sensitization was performed on the emulsions. To perform "optimum gold-sulfur sensitization" means chemical sensitization wherein the sensitivity will be most high when exposed to light for 1/100 second after gold-sulfur sensitization. The emulsions shall be referred to as "emulsions 1a, 2a, 3a, 4a, and 5a."

In the meantime, emulsions 1 to 5 were subjected to gold-sulfur-selenium sensitization. More precisely, sensitizing dyes I to VII were added to emulsions 1 to 5, each in the amount specified in the "Compositions of light-sensitive layers" of Example 1 and determined in accordance with the color sensitivity as in the preparation of gold-sulfur-sensitization. Next, emulsions 1 to 5 were maintained at 60° C. for 20° C. minutes, and the three compounds used in preparing emulsions 1a to 5a and, also, diphenyl-pentafluorophenylphosphine selenide and compound (14) were added to the emulsions, at pH of 6.0 and temperature of 60° C. in the amounts shown in Table 2. As a result, optimal gold-sulfur-selenium sensitization was performed on the emulsions 1 to 5. The emulsions shall be referred to as "emulsions 1b, 2b, 3b, 4b, and 5b."

Further, emulsion 5 was gold-sulfur-selenium sensitized in the same way as in the preparation of emulsion 5b, except that a chemical sensitizer was used, in place of the compound (14), in the amount specified in Table 2. As a result of this, gold-sulfur-selenium sensitized emulsion 5c was prepared.

Sensitizing dye I

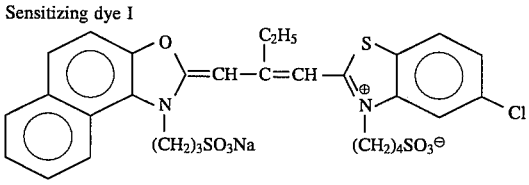

Sensitizing dye II

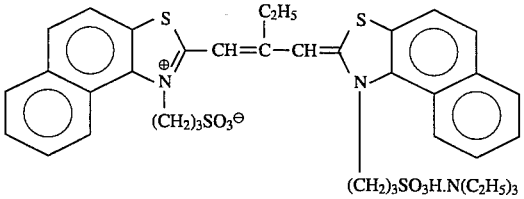

-continued

Sensitizing dye III

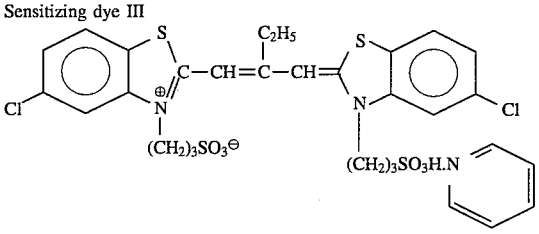

Sensitizing dye IV

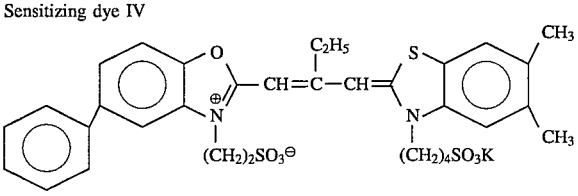

Sensitizing dye V

TABLE 1

| Emulsion | Average aspect ratio 1) | Average aspect ratio 2) | Average grain size (μm) | Average grain thickness (μm) | Average iodine contact (mol %) |
|---|---|---|---|---|---|
| 1 | 1.5/1 | 1.2/1 | 0.86 | 0.67 | 7.6 |
| 2 | 2.8/1 | 2.2/1 | 1.01 | 0.55 | 7.6 |
| 3 | 4.6/1 | 3.6/1 | 1.63 | 0.36 | 7.6 |
| 4 | 6.7/1 | 5.2/1 | 1.74 | 0.30 | 7.6 |
| 5 | 11.7/1 | 9.8/1 | 2.10 | 0.21 | 7.6 |

1): An average value of the aspect ratios of individual grains obtained as follows; the projected area of 1000 grains are measured and the measured value are selected in the order of the measured value from the greatest one to the lowest one, until the summed projected area reach 50% of the projected area of all grains.

2): An average value of the aspect ratios of the grains corresponding to 85% of the projected areas of all grains which is obtained by the same method as above.

TABLE 2

| Emulsion | Chemical sensitization | Chemical sensitizer [(mol/1 mol Ag) × $10^5$] Sodium thiosulfate | Chloroauric acid | Potassium thiocyanate | Diphenyl-pentafluoro-phenylphosfine selenide | Compound (14) |
|---|---|---|---|---|---|---|
| 1a | S* | 0.15 | 0.27 | 130 | — | — |
| 1b | Se** | 0.12 | 0.34 | 320 | 0.08 | 2.0 |
| 2a | S | 0.18 | 0.31 | 140 | — | — |
| 2b | Se | 0.13 | 0.40 | 350 | 0.09 | 3.0 |
| 3a | S | 0.19 | 0.33 | 160 | — | — |
| 3b | Se | 0.14 | 0.42 | 380 | 0.09 | 3.5 |
| 4a | S | 0.19 | 0.35 | 170 | — | — |
| 4b | Se | 0.15 | 0.43 | 390 | 0.10 | 4.0 |
| 5a | S | 0.20 | 0.36 | 180 | — | — |
| 5b | Se | 0.16 | 0.44 | 400 | 0.11 | 4.0 |
| 5c | Se | 0.14 | 0.40 | 360 | 0.09 | — |

*Gold-sulfur sensitization

**Gold-sulfur-selenium sensitization

-continued

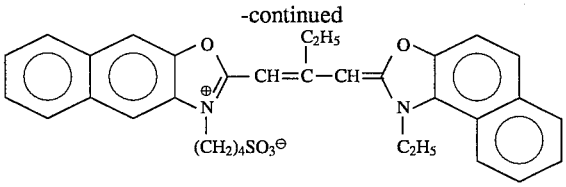

Sensitizing dye VI

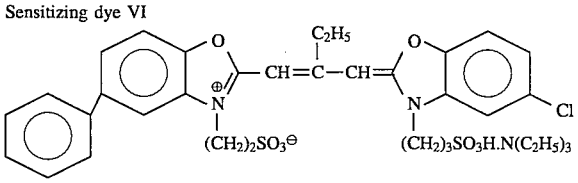

Sensitizing dye VII

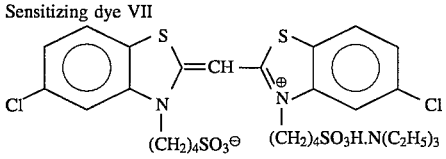

Example 1

A plurality of layers having the following compositions were coated on an undercoated triacetylcellulose film support, forming a multilayered color light-sensitive material (hereinafter referred to as "Sample 101").

(Compositions of light-sensitive layers)

Numerals corresponding to each component indicates a coating amount represented in units of g/m$^2$. The coating amount of silver halide is represented by the coating amount of silver. The coating amount of a sensitizing dye is represented in units of moles per mole of a silver halide in the same layer.

(Sample 101)

| | |
|---|---|
| Layer 1: Antihalation layer | |
| Black colloidal silver | silver 0.18 |
| Gelatin | 0.50 |
| Layer 2: Interlayer | |
| 2,5-di-t-pentadecylhydroquinone | 0.18 |
| EX-1 | 0.18 |
| EX-3 | 0.200 |

| | |
|---|---|
| EX-12 | $2.0 \times 10^{-3}$ |
| U-1 | 0.060 |
| U-2 | 0.080 |
| U-3 | 0.10 |
| HBS-1 | 0.10 |
| HBS-2 | 0.020 |
| Gelatin | 0.80 |
| Layer 3: First red-sensitive emulsion layer | |
| Emulsion A | silver 0.15 |
| Emulsion B | silver 0.35 |
| Sensitizing dye I | $6.9 \times 10^{-5}$ |
| Sensitizing dye II | $1.8 \times 10^{-5}$ |
| Sensitizing dye III | $3.1 \times 10^{-4}$ |
| EX-2 | 0.110 |
| EX-10 | 0.020 |
| EX-14 | 0.110 |
| EX-16 | 0.150 |
| U-1 | 0.070 |
| U-2 | 0.050 |
| U-3 | 0.070 |
| HBS-1 | 0.100 |
| Gelatin | 0.75 |
| Layer 4: Second red-sensitive emulsion layer | |
| Emulsion G | silver 0.30 |
| Emulsion D | 0.50 |
| Sensitizing dye I | $5.1 \times 10^{-5}$ |
| Sensitizing dye II | $1.4 \times 10^{-5}$ |
| Sensitizing dye III | $2.3 \times 10^{-4}$ |
| EX-2 | 0.14 |
| EX-3 | 0.050 |
| EX-10 | 0.015 |
| EX-14 | 0.14 |
| EX-15 | 0.050 |
| EX-16 | 0.15 |
| EX-19 | 0.030 |
| U-1 | 0.020 |
| U-2 | 0.010 |
| U-3 | 0.020 |
| Gelatin | 1.00 |
| Layer 5: Third red-sensitive emulsion layer | |
| Emulsion 1a | silver 1.40 |
| (which contains | |
| Sensitizing dye I | $5.4 \times 10^{-5}$ |
| Sensitizing dye II | $1.4 \times 10^{-5}$ |
| Sensitizing dye III | $2.4 \times 10^{-4}$) |
| Compound (11) | $6.0 \times 10^{-4}$ |
| EX-19 | 0.050 |
| EX-2 | 0.082 |
| EX-3 | 0.010 |
| EX-4 | 0.080 |
| EX-16 | 0.020 |
| HBS-1 | 0.20 |
| HBS-2 | 0.10 |
| Gelatin | 1.30 |
| Layer 6: Interlayer | |
| EX-20 | 0.060 |
| HBS-1 | 0.020 |
| Gelatin | 0.50 |
| Layer 7: First green-sensitive emulsion layer | |
| Emulsion A | silver 0.10 |
| Emulsion B | silver 0.20 |
| Sensitizing dye IV | $3.0 \times 10^{-5}$ |
| Sensitizing dye V | $1.0 \times 10^{-4}$ |
| Sensitizing dye VI | $3.8 \times 10^{-4}$ |
| EX-1 | 0.021 |
| EX-6 | 0.18 |
| EX-7 | 0.030 |
| EX-8 | 0.010 |
| CB-2 of the invention | 0.030 |
| EX-17 | 0.10 |
| HBS-1 | 0.02 |
| HBS-3 | 0.006 |
| Gelatin | 0.63 |
| Layer 8: Second green-sensitive emulsion layer | |

| | |
|---|---|
| Emulsion C | silver 0.25 |
| Emulsion E | silver 0.20 |
| Sensitizing dye IV | $2.1 \times 10^{-5}$ |
| Sensitizing dye V | $7.0 \times 10^{-5}$ |
| Sensitizing dye VI | $2.6 \times 10^{-4}$ |
| EX-6 | 0.094 |
| EX-7 | 0.026 |
| EX-8 | 0.015 |
| CB-2 of the invention | 0.025 |
| EX-20 | 0.010 |
| HBS-1 | 0.16 |
| HBS-3 | $8.0 \times 10^{-3}$ |
| Gelatin | 0.50 |
| Layer 9: Third green-sensitive emulsion layer | |
| Emulsion 1a | silver 1.20 |
| (which contains | |
| Sensitizing dye IV | $3.5 \times 10^{-5}$ |
| Sensitizing dye V | $8.0 \times 10^{-5}$ |
| Sensitizing dye VI | $3.0 \times 10^{-4}$) |
| EX-1 | 0.013 |
| EX-11 | 0.060 |
| EX-13 | 0.017 |
| CB-2 of the invention | 0.010 |
| EX-18 | 0.007 |
| EX-20 | 0.030 |
| HBS-1 | 0.05 |
| HBS-2 | 0.10 |
| Gelatin | 1.00 |
| Layer 10: Yellow filter layer | |
| Yellow colloidal silver | silver 0.050 |
| EX-5 | 0.080 |
| HBS- | 0.030 |
| Gelatin | 0.50 |
| Layer 11: First blue-sensitive emulsion layer | |
| Emulsion A | silver 0.080 |
| Emulsion B | silver 0.070 |
| Emulsion F | silver 0.070 |
| Sensitizing dye VII | $3.5 \times 10^{-4}$ |
| EX-8 | 0.085 |
| EX-9 | 0.72 |
| HBS-1 | 0.20 |
| Gelatin | 1.10 |
| Layer 12: Second blue-sensitive emulsion layer | |
| Emulsion 1a | silver 0.45 |
| (which contains | |
| Sensitizing dye VII | $2.1 \times 10^{-4}$) |
| EX-8 | 0.050 |
| EX-9 | 0.15 |
| EX-10 | $7.0 \times 10^{-3}$ |
| HBS-1 | 0.050 |
| Gelatin | 0.50 |
| Layer 13: Third blue-sensitive emulsion layer | |
| Emulsion H | silver 0.50 |
| Emulsion G | silver 0.20 |
| Sensitizing dye VII | $2.2 \times 10^{-4}$ |
| Exemplified Compound (18) | $5.0 \times 10^{-4}$ |
| EX-9 | 0.20 |
| HBS-1 | 0.070 |
| Gelatin | 0.69 |
| Layer 14: First protective layer | |
| Emulsion I | silver 0.20 |
| U-4 | 0.11 |
| U-5 | 0.17 |
| HBS-1 | $5.0 \times 10^{-2}$ |
| Gelatin | 1.00 |
| Layer 15: Second protective layer | |
| H-1 | 0.40 |
| B-1 (diameter: 1.7 μm) | $5.0 \times 10^{-2}$ |
| B-2 (diameter: 1.7 μm) | 0.10 |
| B-3 | 0.10 |
| S-1 | 0.20 |
| Gelatin | 0.60 |

Further, all layers of Sample 101 contained W-1, W-2, W-3, B-4, B-5, F-1, F-2, F-3, F-4, F-5, F-6, F-7, F-8, F-9, F-10, F-11, F-12, F-13, iron salt, lead salt, gold salt, platinum salt, iridium salt, and rhodium salt, so that they may have improved storage stability, may be more readily processed, may be more resistant to pressure, more antibacterial and more antifungal, may be better protected against electrical charging, and may be more readily coated.

The emulsions used in Sample 101 will be specified in the following Table 3, and the structures of the compounds used in Sample 101 will be specified below:

TABLE 3

| | Average AgI Content (%) | Average grain size (μm) | Variation coefficient (%) in terms of grain size | Diameter/ thickness | Silver amount ratio (AgI content %) |
|---|---|---|---|---|---|
| Emulsion A | 4.0 | 0.45 | 27 | 1 | Core/shell = 1/3 (13/1), Double-structure grains |
| Emulsion B | 8.9 | 0.70 | 14 | 1 | Core/shell = 3/7 (25/2), Double-structure grains |
| Emulsion C | 10 | 0.75 | 17 | 1 | Core/shell = 1/2 (24/3), Double-structure grains |
| Emulsion D | 16 | 0.95 | 22 | 1 | Core/shell = 4/6 (40/0), Double-structure grains |
| Emulsion E | 10 | 0.95 | 18 | 1 | Core/shell = 1/2 (24/3), Double-structure grains |
| Emulsion F | 4.0 | 0.25 | 28 | 1 | Core/shell= 1/3 (13/1), Double-structure grains |
| Emulsion G | 14.0 | 0.75 | 17 | 1 | Core/shell = 1/2 (42/0), Double-structure grains |
| Emulsion H | 14.5 | 1.20 | 18 | 1 | Core/shell = 37/63 (34/3), Double-structure grains |
| Emulsion I | 1 | 0.07 | 15 | 1 | Uniform grains |

EX-1
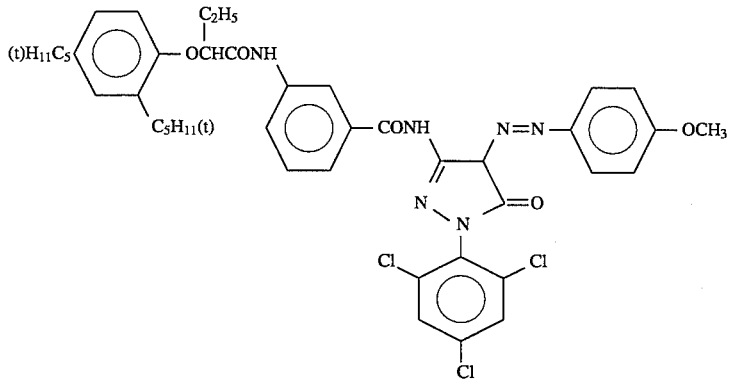
EX-2
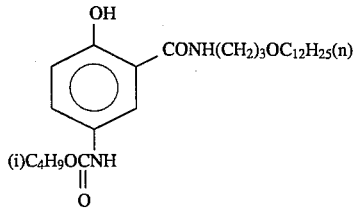
EX-3
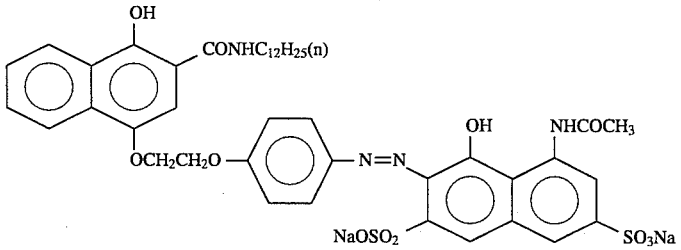
EX-4
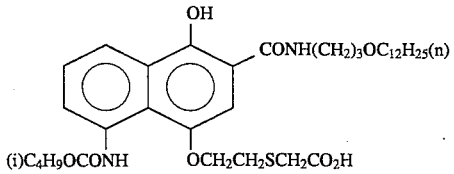
EX-5
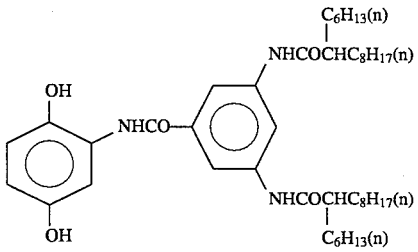
EX-6
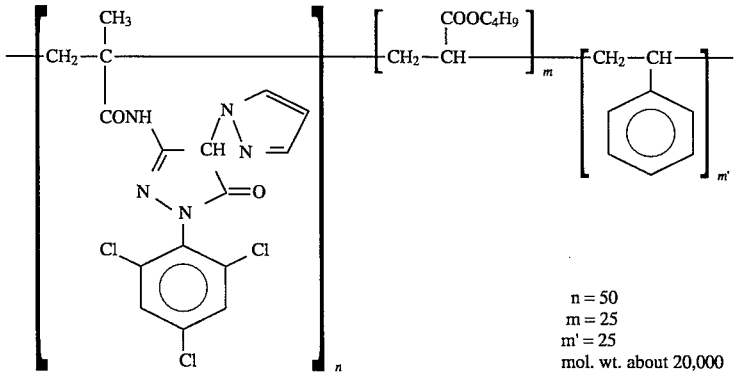
n = 50
m = 25
m' = 25
mol. wt. about 20,000

-continued
EX-7
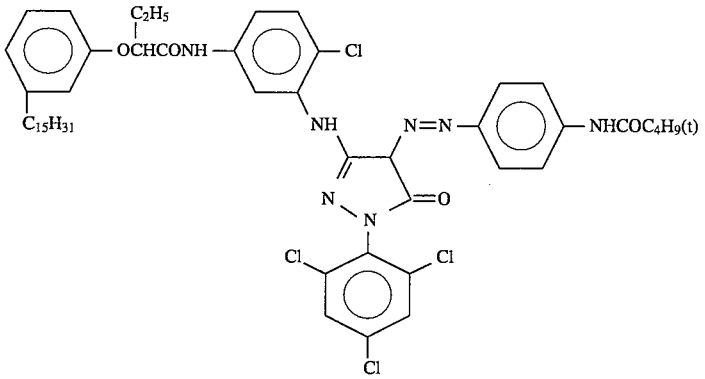
EX-8
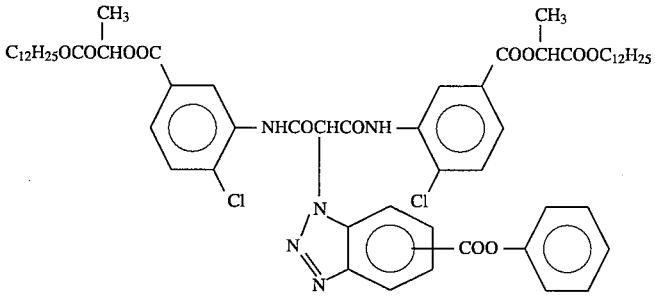
EX-10
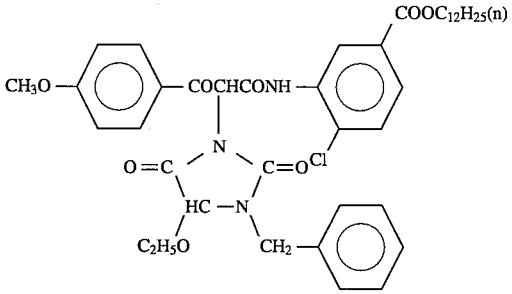
EX-10
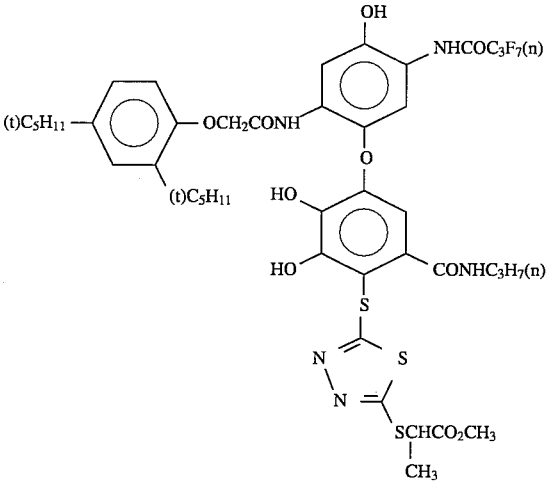

-continued
EX-11
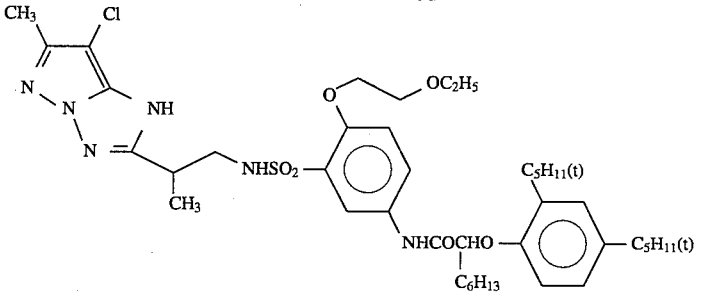
EX-12
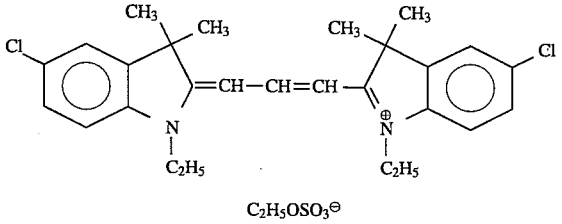
EX-13
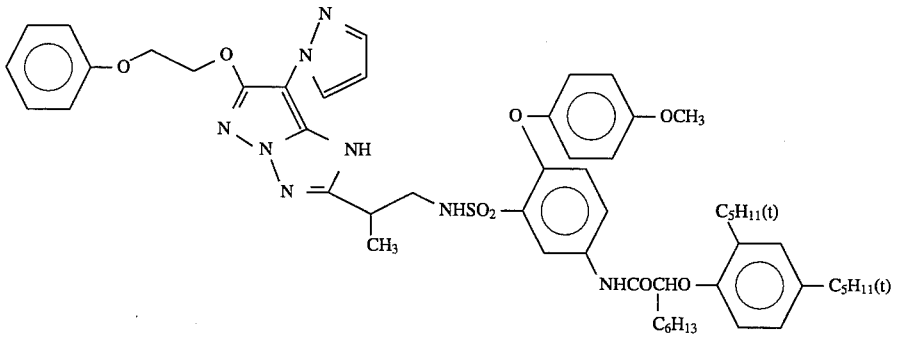
EX-14
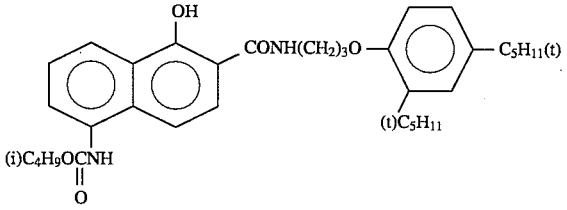
EX-15
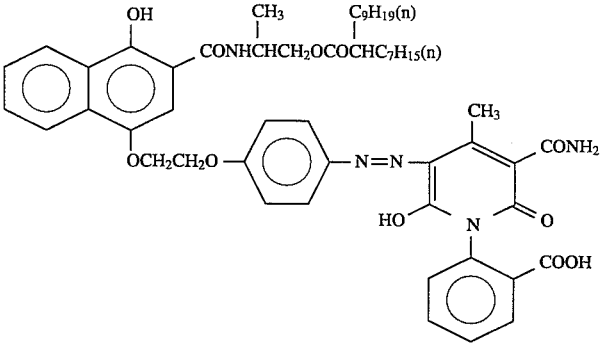
EX-16
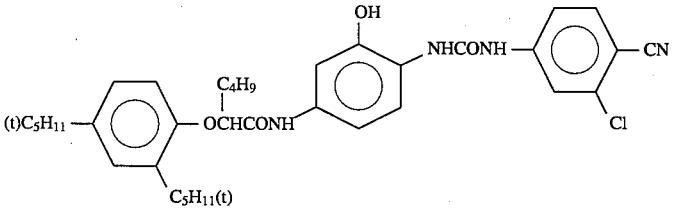

-continued
EX-17
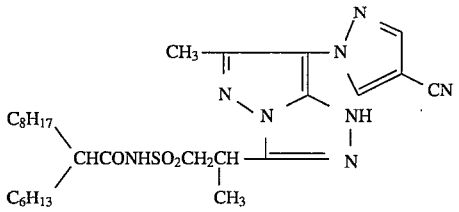
EX-18
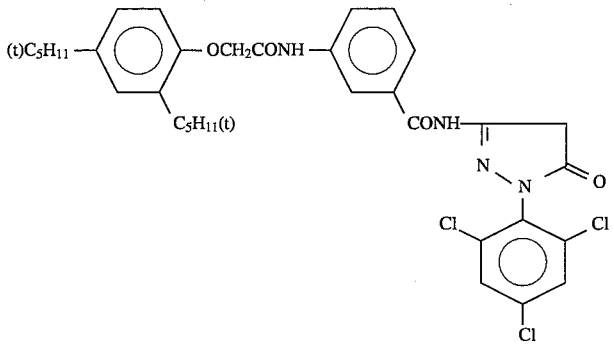
EX-19
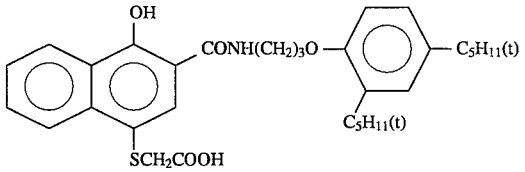
EX-20
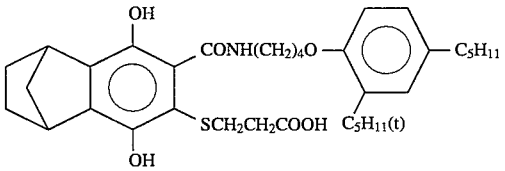
U-1
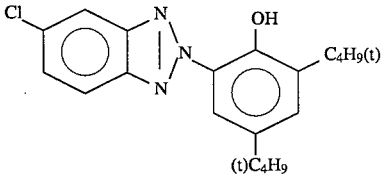
U-2
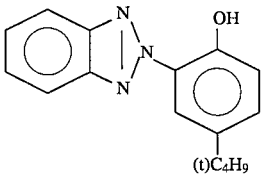
U-3
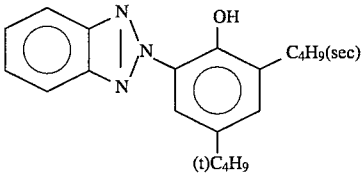
U-4
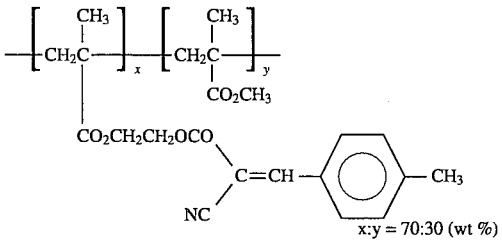
x:y = 70:30 (wt %)
U-5
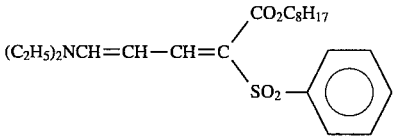
HBS-1
tricresylphosphate
HBS-2
di-n-butylphthalate
HBS-3
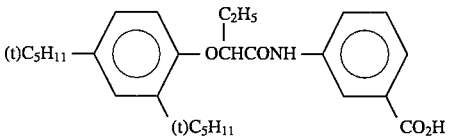

-continued
S-1
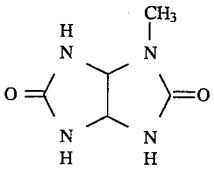
H-1
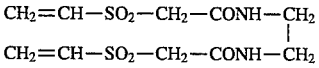
B-1
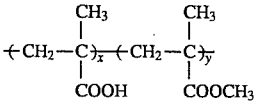
x/y = 10/90
B-2
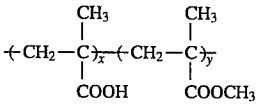
x/y = 40/60
B-3
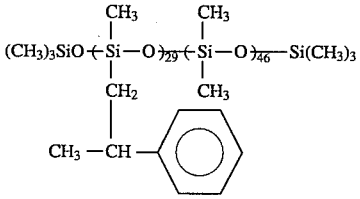
B-4
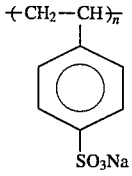
B-5
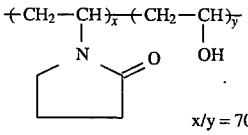
x/y = 70/30
W-1
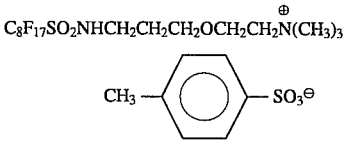
W-2
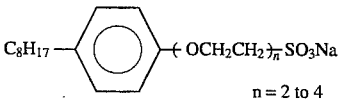
n = 2 to 4
W-3
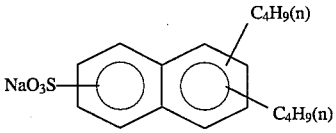
F-1
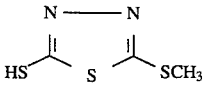
F-2
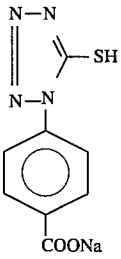
F-3
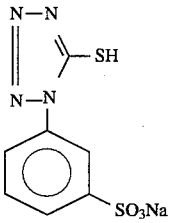
F-4
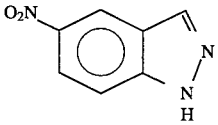
F-6
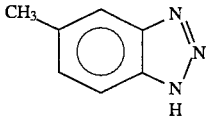
F-6
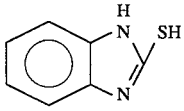

-continued

F-7

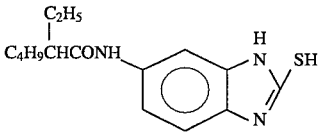

F-8

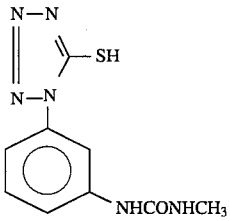

F-9

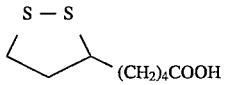

F-10

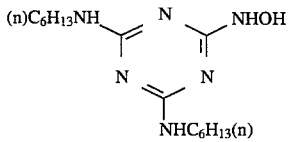

F-11

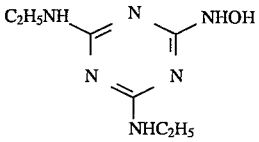

F-12

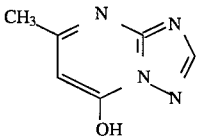

F-13

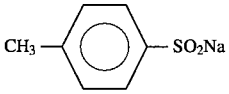

Then, samples shown below were formed.

(Samples 102 to 105)

Samples 102 to 105 were formed which were equal to Sample 101, except that their layers 7 to 9 contained, instead of compound CB-2 of the invention, comparative compounds (a) to (d) specified below, each in the same molar amount as compound CB-2.

Comparative compound (a), i.e., compound 1 desclosed in JP-A-60-218645

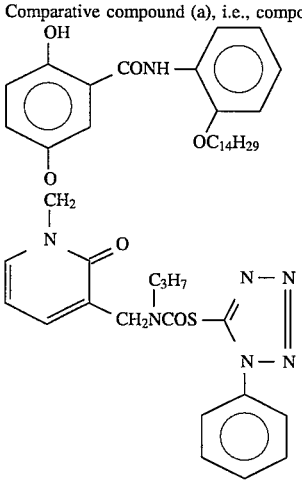

Comparative compound (b), i.e., compound 7 disclosed in JP-A-60-32346

-continued

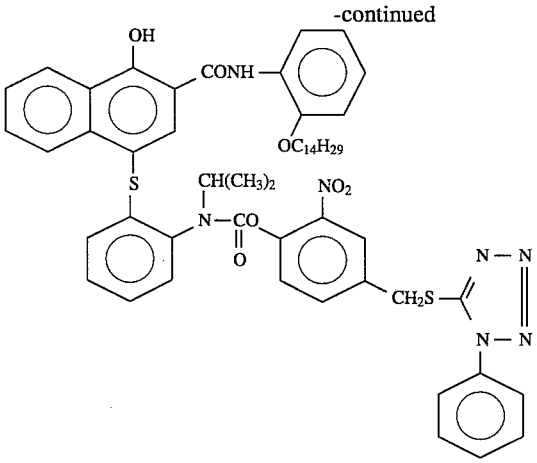

Comparative compound (c), i.e., compound 15 disclosed in JP-A-1-280755

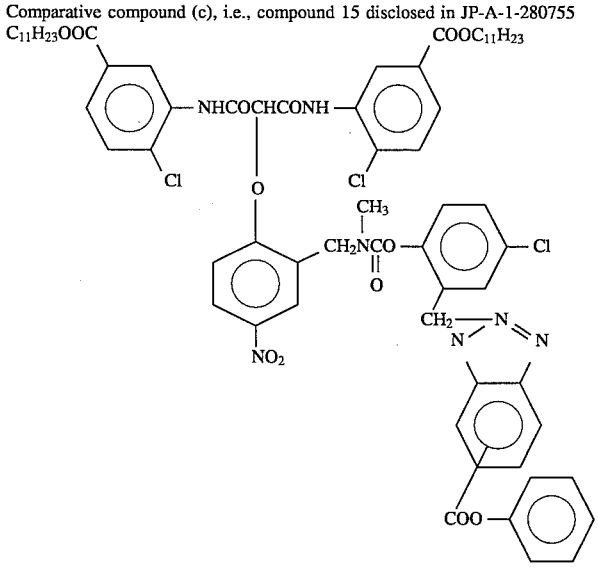

Compound (d), i.e., compound T-31 disclosed in JP-A-2-230139

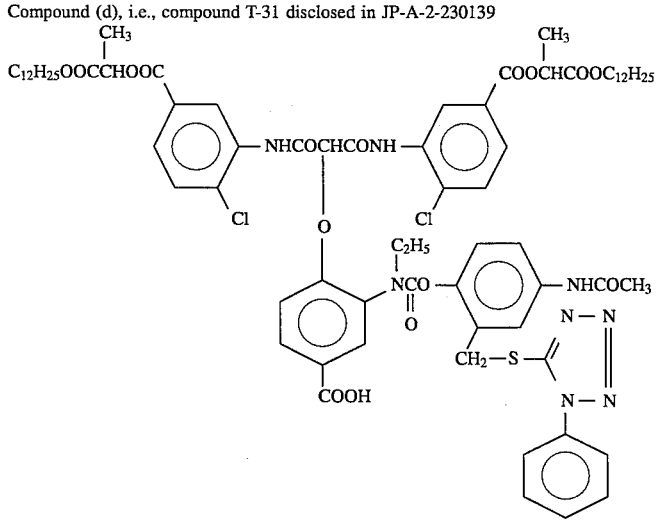

(Samples 106 to 110)

Samples 106 to 110 were formed which were equal to Samples 101 to 105, respectively, except that the layers 5, 9 and 12 contained selenium-sensitized emulsion 1b in place of emulsion la in the same weight as emulsion 1a.

(Samples 111 to 114)

Samples 111 to 114 were formed which were equal to Sample 106, except that their layers 7 to 9 contained compounds CB-3, CB-16, CB-18, and CB-25 respectively, all being of the invention, in place of compounds CB-2, in the same molar amount as compound CB-2.

(Samples 115 and 116)

Samples 115 and 116 were formed which were equal to Sample 106, except that their layers 7 to 9 contained compounds CA-1 and CA-19 respectively, both being of the invention, in place of compound CB-2, in 0.8 times molar amount of compound CB-2.

(Samples 117 to 120)

Samples 117 to 120 were formed which were equal to Samples 106, 111, 113 and 115, respectively except that their layer 5 did not contain compound (11) represented by the formula (A), and their layer 13 did not contain Exemplified compound (18) represented by the formula (A).

During the forming of Samples 101 to 120, the period of ripening and the addition amounts of the sensitizing dyes for preparing the emulsion, were minutely adjusted so that the samples would have the same gradation.

Samples 101 to 120, thus prepared, were exposed to such amounts of light as appropriate for evaluating the properties of each sample, which will be described below in detail, and were subjected to the process which will be specified below, whereby their properties were evaluated.

(1) Photographic Property

Each sample was exposed to white light, forming a magenta image. From the characteristic curve of the magenta image, the logarithmic value for the reciprocal of the exposure amount which imparted the minimum density +0.3 was obtained. The difference (ΔS) between the logarithmic value and that of Sample 101, which was used as reference, was calculated. The greater the difference ΔS, the higher the sensitivity of the sample.

Further, Samples 101 to 120 of the first set were stored for 10 days at 40° C. and RH of 80%. Meanwhile, Samples 101 to 120 of the second set were stored for 10 days, too, at 5° C. Samples 101 to 120 of both sets were exposed to the same amount of light, and were processed at the same time. Blue light was applied to these samples, thereby determining the minimum density of each sample. The difference (ΔDmin) between the minimum density of each sample of the first set (i.e., a sample stored for 10 days at 40° C. and RH of 80%) and that of the equal sample of the second set (i.e., a sample stored for 10 days at 5° C.) was calculated. The less the value of ΔDmin, the less the increase in fog, and the better.

(2) Image Quality (a) Graininess

The term "graininess" means is that one which was obtained by measuring a region which imparts a magenta density of minimum density +1.0 using an aperture having a diameter of 48 pm.

(b) Sharpness

Each sample was exposed to white light, thus forming an MTF-measuring pattern on the sample, and was then processed. The MTF value which imparted the magenta image of minimum density +1.0 was measured by the method described in C. E. Kenneth Mees, "The Theory of the Photographic Process," 3rd Ed., Macmillan. From the MTF value, thus measured, the sharpness of the sample was determined.

(c) Color turbidity

Each of Samples 101 to 120 was exposed to blue light at 1 lux/sec, then subjected to gradation exposure using green light, and finally processed. The value obtained by subtracting the yellow density at the minimum magenta density from the yellow density at the exposure amount wherein the magenta density imparted the minimum density +1.5 was evaluated as the color turbidity. The less this difference, the less the color turbidity, and the better the color reproduction.

The processes to which Samples 101 to 120 were subjected will be described below. It should be noted that sets of Samples were exposed imagewise, subjected to a running process until the quantity of replenisher reached three times the volume of the color developing solution tank, and then processed as follows:

| Processing Method | | | | |
|---|---|---|---|---|
| Process | Time | Temp. | Quantity of replenisher | Tank volume |
| Color development | 3 min. 15 sec. | 38° C. | 15 ml | 4 l |
| Bleaching | 6 min. 30 sec. | 38° C. | 10 ml | 8 l |
| Washing | 2 min. 10 sec. | 35° C. | 10 ml | 4 l |
| Fixing | 4 min. 20 sec. | 38° C. | 20 ml | 8 l |
| Washing (1) | 1 min. 05 sec. | 35° C. | * | 4 l |
| Washing (2) | 1 min. 00 sec. | 35° C. | 20 ml | 4 l |
| Stabilization | 1 min. 05 sec. | 38° C. | 10 ml | 4 l |
| Drying | 4 min. 20 sec. | 55° C. | | |

*The washing (1) was carried out in counter flow, from the step (2) to the step (1).

The quantity of replenisher is per meter of a 35-mm wide sample.

The compositions of the solutions used in the process are as follows:

| | Mother Solution (g) | Replenisher (g) |
|---|---|---|
| (Color Developing Solution) | | |
| Diethylenetriamine-pentaacetate | 1.0 | 1.1 |
| 1-hydroxyethylidine-1,1-diphosphonic acid | 3.0 | 3.2 |
| Sodium sulfite | 4.0 | 4.9 |
| Potassium carbonate | 30.0 | 30.0 |
| Potassium bromide | 1.4 | — |
| Potassium iodide | 1.5 mg | — |
| Hydroxylamine sulfate | 2.4 | 3.6 |
| 4-[N-ethyl-N-β-hydroxyethylamino]-2-methylaniline sulfate | 4.5 | 7.2 |
| Water to make | 1.0 l | 1.0 l |
| pH | 10.50 | 10.10 |
| (Bleaching Solution): | | |
| Sodium ferric ethylenediamine tetraacetate trihydrate | 100.0 | 140.0 |
| Disodium ethylenediamine tetraacetate | 10.0 | 11.0 |
| Ammonium bromide | 140.0 | 180.0 |
| Ammonium nitrate | 30.0 | 40.0 |
| Ammonia water (27%) | 6.5 ml | 2.5 ml |
| Water to make | 1.0 l | 1.0 l |
| pH | 6.0 | 5.5 |
| (Fixing Solution): | | |
| Disodium ethylenediamine tetraacetate | 0.5 | 1.0 |
| Sodium sulfite | 7.0 | 12.0 |
| Sodium bissulfite | 5.0 | 9.5 |
| Ammonium thiosulfate aqueous solution (700 g/liter) | 170.0 ml | 240.0 ml |
| Water to make | 1.0 l | 1.0 l |
| pH | 6.7 | 6.6 |
| (Washing Solution): | The same solution used for mother solution and replenisher | |

First, passing tap water was passed through a mixed-bed column filled with H-type strong-acid cation exchange resin (Amberlite IR-120B)and OH-type strong-base anion exchange resin (Amberlite IR-400), both resins made by manufactured by Rohm and Haas, Inc., whereby the calcium and magnesium ion concentration of the water was reduced to 3 mg/l or less. Next, 20 mg/l of sodium dichloroisocyanurate and 1.5 g/l of sodium sulfate were added to the water thus processed, thereby obtaining the washing solution. The washing solution had pH value ranging from 6.5 to 7.5.

(Stabilizing Solution):

| | Mother Solution (g) | Replenisher (g) |
|---|---|---|
| Formalin (37%) | 2.0 ml | 3.0 ml |
| Polyoxyethylene-p-monononyl phenylether (av. polymerization degree: 10) | 0.3 | 0.45 |
| Disodium ethylenediamine tetraacetate | 0.05 | 0.08 |
| Water to make | 1.0 l | 1.0 l |
| pH | 5.0–8.0 | 5.0–8.0 |

The results obtained were as is shown in the following Tables 4 and 5:

TABLE 4

| Sample | Emulsion in layers 5, 9, 12 | Compounds in layers 7, 8, 9 | Compounds in layers 5, 13 | Photographic properties: Sensitivity (ΔS) | Photographic properties: Change in fog (ΔDmin) | Quality of image: Graininess (× $10^3$) | Quality of image: Sharpness (40 cycles/mm) | Quality of image: Color turbidity |
|---|---|---|---|---|---|---|---|---|
| 101 Invention | 1a | CB-2 | (11), (18) | 0.00 Reference | +0.06 | 25.7 | 0.57 | 0.03 |
| 102 Comparative | | Comparative compound (a) | | −0.03 | +0.10 | 26.1 | 0.57 | 0.07 |
| 103 Comparative | | Comparative compound (b) | | −0.01 | +0.11 | 26.0 | 0.57 | 0.07 |
| 104 Comparative | | Comparative compound (c) | | −0.02 | +0.11 | 26.2 | 0.56 | 0.09 |
| 105 Comparative | | Comparative compound (d) | | −0.03 | +0.10 | 26.2 | 0.56 | 0.10 |
| 106 Invention | 1b | CB-2 | (11), (18) | +0.06 | +0.04 | 25.3 | 0.61 | 0.01 |
| 107 Comparative | | Comparative compound (a) | | −0.01 | +0.09 | 26.0 | 0.60 | 0.07 |
| 108 Comparative | | Comparative compound (b) | | +0.01 | +0.10 | 26.0 | 0.59 | 0.07 |
| 109 Comparative | | Comparative compound (c) | | 0.00 | +0.10 | 26.1 | 0.58 | 0.09 |
| 110 Comparative | | Comparative compound (d) | | −0.01 | +0.09 | 26.2 | 0.59 | 0.10 |

TABLE 5

| Sample | Emulsion in layers 5, 9, 12 | Compounds in layers 7, 8, 9 | Compounds in layers 5, 13 | Photographic properties: Sensitivity (ΔS) | Photographic properties: Change in fog (ΔDmin) | Quality of image: Graininess (× $10^3$) | Quality of image: Sharpness (40 cycles/mm) | Quality of image: Color turbidity |
|---|---|---|---|---|---|---|---|---|
| 111 Invention | 1b | CB-3 | (11), (18) | +0.06 | +0.04 | 25.3 | 0.61 | 0.01 |
| 112 Invention | | CB-16 | | +0.06 | +0.04 | 25.3 | 0.60 | 0.01 |
| 113 Invention | | CB-18 | | +0.06 | +0.04 | 25.2 | 0.61 | 0.01 |
| 114 Invention | | CB-25 | | +0.06 | +0.04 | 25.2 | 0.61 | 0.01 |
| 115 Invention | 1b | CA-1 | (11), (18) | +0.06 | +0.05 | 25.4 | 0.60 | 0.03 |
| 116 Invention | | CA-19 | | +0.06 | +0.04 | 25.4 | 0.60 | 0.02 |

TABLE 5-continued

| Sample | Emulsion in layers 5, 9, 12 | Compounds in layers 7, 8, 9 | Compounds in layers 5, 13 | Photographic properties: Sensitivity (ΔS) | Photographic properties: Change in fog (ΔDmin) | Quality of image: Graininess (× $10^3$) | Quality of image: Sharpness (40 cycles/mm) | Quality of image: Color turbidity |
|---|---|---|---|---|---|---|---|---|
| 117 Invention | 1b | CB-2 | — | +0.04 | +0.06 | 25.6 | 0.60 | 0.02 |
| 118 Invention | | CB-3 | | +0.04 | +0.06 | 25.6 | 0.60 | 0.02 |
| 119 Invention | | CB-18 | | +0.04 | +0.06 | 25.5 | 0.60 | 0.02 |
| 120 Invention | | CA-1 | | +0.04 | +0.07 | 25.7 | 0.59 | 0.03 |

As is evident from Tables 4 and 5, more precisely, from comparison of Sample 101 with Samples 102 to 105, comparison of Sample 106 with Samples 107 to 110, and which Samples 115 to 116, it is clear that the emulsion of the present invention, which are chemically sensitized with at least one of a sulfur compound, a gold compound and a selenium compound, and containing a compound represented by the formula (I) or (II), excelled in photographic property (i.e., sensitivity, change in fog) and high image quality (i.e., graininess, sharpness, and color turbidity). Also, as comparison of Sample 101 with Sample 106 may reveal, the use of a selenium sensitizer is effective.

Obviously, Samples 111 to 114, each using an emulsion chemically sensitized with a selenium compound and containing another compound represented by the formula (I) or (II), instead of CB-2 in Sample 106, particularly excelled in photographic property and image quality, like Sample 106.

Further, as comparison of Samples 106,111, 113 and 115 with Samples 117 to 120 may suggest, it is desirable that a mercapto compound represented by formula (A) be used in a light-sensitive material which contains the emulsion of the invention which has been chemically sensitized with a selenium compound and also containing a compound represented by the formula (I) or (II).

Example 2

Samples 201 to 209 were formed which were equal to Samples 101 to 106, except that their layers 5, 9, and 12 contained, instead of emulsions 1a and 1b, emulsions 2a to 5a, emulsions 2b to 5b and emulsion 5C, each in the same amount by weight as emulsions 1a and 1b.

Also, Samples 210 to 219 were formed which were equal to Sample 207, except that their layers 7, 8 and 9 contained, in place of CB-2, other compounds represented by formula (I) or (II) of the present invention (specified in Tables 7 and 8). The layers 7, 8 and 9 of Samples 210 to 214 and Sample 219 contained the compounds, each in the same molar amount as compound CB-2; the layers 7, 8 and 9 of Samples 215 to 218 contained the compounds, each in a molar amount 0.8 times that of compound CB-2 used in Sample 207.

Furthermore, Samples 220 and 221 were formed which were equal to Sample 207, except that their layers 7, 8 and 9 contained, instead of CB-2, other compounds of formula (I) or (II), each in the same molar amount as compound CB-2, and that their layers 7 and 10 contained compounds of the present invention SA-1, SA-2 and SA-6, each in an amount of 0.02 g/$m^2$.

Samples 201 to 221, thus formed, were processed in substantially the same way as the samples of Example 1, along with Samples 101 and 106, both being of Example 1, for their photographic properties and their image qualities. That is, the samples were processed as specified below, after they had been subjected to such a running process as conducted in Example 1:

| Processing Method: Process | Time | Temp. | Quantity of* replenisher | Tank volume |
|---|---|---|---|---|
| Color development | 3 min. 05 sec. | 38.0° C. | 600 ml | 5 l |
| Bleaching | 50 sec. | 38.0° C. | 140 ml | 3 l |
| Bleach-Fixing | 50 sec. | 38.0° C. | — | 3 l |
| Fixing | 50 sec. | 38.0° C. | 420 ml | 3 l |
| Washing | 30 sec. | 38.0° C. | 980 ml | 2 l |
| Stabilization (1) | 20 sec. | 38.0° C. | — | 2 l |
| Stabilization (2) | 20 sec. | 38.0° C. | 560 ml | 2 l |
| Drying | 1 min. | 60° C. | | |

*The quantity of replenisher is per meter of a 35-mm wide sample.

In the process, the water was fed in counter flow, from the step (2) to the step (1). All overflowing water was introduced into the fixing bath. Regarding to the replenishment to the bleach-fixing bath, all overflowing solution generated by supplement of replenisher to the bleaching tank and the fixing tank was followed into the bleach-fixing bath through the pipe connecting the upper part of the bleaching tank of the automatic developing machine to the bottom of the bleach-fixing tank and also through the pipe connecting the upper part of the fixing tank to the bottom of the bleach-fixing tank. The carry-over amount of developing solution to the bleaching step was 65 ml/$m^2$ of the light-sensitive materials, the carry-over amount of bleaching solution to the bleach-fixing step was 50 ml/$m^2$, the carry-over amount of bleach-fixing solution to the fixing step was 50 ml/$m^2$, and the carry-over amount of fixing solution to the washing step was 50 ml/$m^2$. The cross-over time was 5 seconds for each step, which was included in the process time in the preceding step.

The compositions of the solutions used in the process are as follows:

| | Mother Solution (g) | Replenisher (g) |
|---|---|---|
| (Color Developing Solution) | | |
| Diethylenetriamine-pentaacetate | 2.0 | 2.2 |
| 1-hydroxyethylidene-1,1-diphosphonic acid | 3.3 | 3.3 |
| Sodium sulfite | 3.9 | 5.2 |
| Potassium carbonate | 37.5 | 39.0 |
| Potassium bromide | 1.4 | 0.4 |
| Potassium iodide | 1.3 mg | — |
| Hydroxylamine sulfate | 2.4 | 3.3 |
| 2-methyl-4-[N-ethyl-N-(β-hydroxylethyl)amino] aniline sulfate | 4.5 | 6.0 |
| Water to make | 1.0 l | 1.0 l |
| pH | 10.50 | 10.15 |
| (Bleaching Solution): | | |
| Ammonium ferric propylene diamine tetraacetate monohydrate | 144.0 | 206.0 |
| Ammonium bromide | 84.0 | 120.0 |
| Ammonium nitrate | 17.5 | 25.0 |
| Hydroxyacetic acid | 63.0 | 90.0 |
| Acetic acid | 54.2 | 80.0 |
| Water to make | 1.0 l | 1.0 l |
| pH (adjusted with ammonia water) | 3.80 | 3.6 |
| (Mother Solution for Bleach-Fixing): | | |
| A mixture of the bleaching mother solution specified above and the fixing mother solution specified below (mixing ratio = 15:85) | | |
| (Fixing Solution) | | |
| Ammonium sulfite | 19.0 | 57.0 |
| Ammonium thiosulfate aqueous solution (700 g/liter) | 280 ml | 840 ml |
| Imidazole | 28.5 | 85.5 |
| Ethylenediamine tetraacetate | 12.5 | 37.5 |
| Water to make | 1.0 l | 1.0 l |
| pH (adjusted with ammonia water and acectic acid) | 7.40 | 7.45 |

(Washing Solution): The same solution used for mother solution and replenisher

First, passing tap water was passed through a mixed-bed column filled with H-type strong-acid cation exchange resin (Amberlite IR-120B)and OH-type strong-base anion exchange resin (Amberlite IRA-400), both resins made by manufactured by Rohm and Haas, Inc., whereby the calcium and magnesium ion concentration of the water was reduced to 3 mg/l or less. Next, 20 mg/l of sodium dichloroisocyanurate and 150 mg/l of sodium sulfate were added to the water thus processed, thereby obtaining the washing solution. The washing solution had pH value ranging from 6.5 to 7.5.

(Stabilizing Solution): The same solution used for mother solution and replenisher

| | Mother Solution (g) | Replenisher (g) |
|---|---|---|
| Formalin (37%) | | 1.2 ml |
| Sodium toluenesulfinate | | 0.3 g |
| Polyoxyethylene-p-monononyl phenylether (Av. polymerization degree: 10) | | 0.2 |
| Disodium ethylenediamine tetraacetate | | 0.05 |
| Water to make | | 1.0 l |
| pH | | 7.2 |

The results obtained were as is shown in the following Table 6 to 8:

TABLE 6

| Sample | Emulsion in layers 5, 9, 12 | Compounds in layers 7, 8, 9 | Compounds in layers 7, 10 | Photographic properties: Sensitivity (ΔS) | Photographic properties: Change in fog (ΔDmin) | Quality of image: Graininess RMS value (× $10^3$) | Quality of image: Sharpness (MTF value (40/cycle mm) | Quality of image: Color turbidity |
|---|---|---|---|---|---|---|---|---|
| 101 Invention | 1a | CB-2 | — | 0.00 Reference | +0.06 | 25.7 | 0.57 | 0.03 |
| 201 Invention | 2a | | | 0.00 | +0.05 | 24.8 | 0.59 | 0.02 |
| 202 Invention | 3a | | | +0.01 | +0.05 | 24.3 | 0.61 | 0.02 |
| 203 Invention | 4a | | | +0.01 | +0.05 | 24.2 | 0.61 | 0.02 |
| 204 Invention | 5a | | | +0.02 | +0.05 | 24.2 | 0.61 | 0.02 |
| 106 Invention | 1b | CB-2 | — | +0.06 | +0.04 | 25.3 | 0.61 | 0.01 |
| 205 Invention | 2b | | | +0.06 | +0.04 | 24.2 | 0.63 | −0.01 |
| 206 | 3b | | | +0.07 | +0.03 | 23.7 | 0.65 | −0.01 |

TABLE 6-continued

| Sample | Emulsion in layers 5, 9, 12 | Compounds in layers 7, 8, 9 | Compounds in layers 7, 10 | Photographic properties: Sensitivity (ΔS) | Photographic properties: Change in fog (ΔDmin) | Quality of image: Graininess RMS value (× $10^3$) | Quality of image: Sharpness (MTF value (40/cycle mm) | Quality of image: Color turbidity |
|---|---|---|---|---|---|---|---|---|
| Invention 207 | 4b | | | +0.08 | +0.02 | 23.5 | 0.65 | −0.02 |
| Invention 208 | 5b | | | +0.09 | +0.02 | 23.4 | 0.65 | −0.02 |
| Invention | | | | | | | | |

TABLE 7

| Sample | Emulsion in layers 5, 9, 12 | Compounds in layers 7, 8, 9 | Compounds in layers 7, 10 | Photographic properties: Sensitivity (ΔS) | Photographic properties: Change in fog (ΔDmin) | Quality of image: Graininess (× $10^3$) | Quality of image: Sharpness (40 cycles/mm) | Quality of image: Color turbidity |
|---|---|---|---|---|---|---|---|---|
| 209* Invention | 5c | CB-2 | — | +0.07 | +0.05 | 23.8 | 0.62 | 0.00 |
| 210 Invention | 4b | CB-6 | | +0.07 | +0.03 | 23.5 | 0.65 | −0.05 |
| 211 Invention | | CB-7 | | +0.07 | +0.02 | 23.5 | 0.65 | −0.05 |
| 212 Invention | | CB-19 | | +0.08 | +0.02 | 23.5 | 0.66 | 0.00 |
| 213 Invention | | CB-21 | | +0.08 | +0.02 | 23.7 | 0.64 | −0.02 |
| 214 Invention | | CB-36 | | +0.07 | +0.03 | 23.7 | 0.63 | 0.00 |
| 215 Invention | | CA-3 | | +0.08 | +0.02 | 23.5 | 0.65 | −0.02 |
| 216 Invention | 4b | CA-10 | — | +0.08 | +0.02 | 23.5 | 0.65 | −0.02 |
| 217 Invention | | CA-20 | | +0.08 | +0.02 | 23.5 | 0.65 | −0.02 |
| 218 Invention | | CA-22 | | +0.07 | +0.03 | 23.7 | 0.63 | −0.05 |

TABLE 8

| Sample | Emulsion in layers 5, 9, 12 | Compounds in layers 7, 8, 9 | Compounds in layers 7, 10 | Photographic properties: Sensitivity (ΔS) | Photographic properties: Change in fog (ΔDmin) | Quality of image: Graininess (× $10^3$) | Quality of image: Sharpness (40 cycles/mm) | Quality of image: Color turbidity |
|---|---|---|---|---|---|---|---|---|
| 219 Invention | 4b | Layer 7 CA-13 Layer 8 CB-33 Layer 9 CB-10 | — | +0.08 | +0.03 | 23.5 | 0.65 | −0.04 |
| 220 Invention | 4b | Layer 7 CB-9 Layer 8 CA-4 Layer 9 CB-28 | SA-1 | +0.08 | +0.02 | 23.3 | 0.66 | −0.02 |
| 221 Invention | 4b | Layers 7, 8 CA-14/CB-3 = 1/1 (mol ratio Layer 9 CB-18 | Layer 7 SA-6 Layer 10 SA-2 | +0.08 | +0.02 | 23.3 | 0.67 | −0.02 |

*the compounds (11) and (18) were excluded from the layers 5 and 13 in a sample 209.

As is evident from Tables 6 to 8 and also from comparison of Samples 101 and 201 to 204 with Samples 106 and 205 to 208, any emulsion of this invention that contains tabular grains serves to improve photographic property (i.e., sensitivity and change in fog)and image quality (i.e., graininess, sharpness, and color turbidity) even if it has been chemically sensitized with a selenium compound.

As can be clearly understood from comparison of Sample 208 with Sample 209, it is desirable that a compound represented by the formula (A) be used, even if the emulsion contains tabular grains.

Also, it is clear that Samples 210 to 221 which were formed using various emulsions containing tabular grains and various compounds represented by the formulas (I)and (II), excelled in photographic property and image quality, too.

Example 3

Six emulsions were prepared which contained tabular grains selenium-sensitized and equal to those contained in emulsion 4b. These emulsions were equal to emulsion 4b, except that they contained, instead of diphenylpentafluorophenylphosphine selenide (used as selenium compound), diethyl selenide, tripheylphosphine selenide, tris-2,4,6-trichlorophosphine selenide, phenyl-bis-pentafluorophenylphosphine selenide, exemplified compound S-4, and S-10, respectively, each used in the same molar amount as diphenyl-pentafluorophenylphosphine selenide.

Samples 301 to 306 were formed by using the six emulsions thus prepared respectively in the layers 5, 9 and 12 of sample 207 in Example 2, instead of emulsion 4b, in the same molar amount as emulsion 4b.

Samples 301 to 306 were processed, along with Sample 207, in the same way as in Example 2, so as to be evaluated for their photographic properties and their image qualities. They were found to have substantially the same photographic property and image quality as Sample 207 of Example 2.

Example 4

Samples 101 to 110 of Example 1 and Samples 201 to 209 of Example 2 were processed in the same way as in Example 1 before subjecting to the running process, and their photographic properties (i.e., sensitivities) were measured. Another set of Samples 101 to 110 and another set of Samples 201 to 209 were processed in the same way as in Example 1 after subjecting to the running process, and their photographic properties (i.e., sensitivities) were measured. The running process was carried out on each sample after the sample 101 (20 m long, 35 mm wide) had been processed every other day until the replenisher used reached an amount three times the volume of the color developing solution tank.

The sensitivity of each sample was determined by the method utilized in Example 1, and the change in sensitivity was evaluated in terms of the difference ($\Delta S_1$) between the sensitivity which the sample had before the running process, and the sensitivity which it had after the running process.

The results were as is shown in the following Table 9:

TABLE 9

| Sample | Emulsions in layers 5, 9, 12 | Compounds in layers 7, 8, 9 | Photographic Properties Changes in sensitivity ($\Delta S^1$) |
|---|---|---|---|
| 101 Invention | 1a | CB-2 | 0.07 |
| 102 Comparative | | Comparative compound (a) | 0.09 |
| 103 Comparative | | Comparative compound (b) | 0.09 |
| 104 Comparative | | Comparative compound (c) | 0.08 |
| 105 Comparative | | Comparative compound (d) | 0.08 |
| 106 Invention | 1b | CB-2 | 0.03 |
| 107 Comparative | | Comparative compound (a) | 0.06 |
| 108 Comparative | | Comparative compound (b) | 0.06 |
| 109 Comparative | | Comparative compound (c) | 0.05 |
| 110 Comparative | | Comparative compound (d) | 0.05 |
| 201 Invention | 2a | CB-2 | 0.07 |
| 202 Invention | 3a | | 0.06 |
| 203 Invention | 4a | | 0.05 |
| 204 Invention | 5a | | 0.05 |
| 205 Invention | 2b | CB-2 | 0.03 |
| 206 Invention | 3b | | 0.02 |
| 207 Invention | 4b | | 0.02 |
| 208 Invention | 5b | | 0.02 |
| 209 Invention | 5b | | 0.04 |

As can be clearly understood from Table 9, Samples 101, 106 and 205 to 209, each containing emulsions chemically sensitized with at least one of a sulfur sensitizer, a gold sensitizer and a selenium sensitizer and also containing compound CB-2 of the invention, experienced a smaller change in sensitivity than the comparative samples (Samples 102 to 105, and 107 to 110). Particularly, emulsions (Samples 106, 205 to 209) sensitized with a selenium sensitizer are effective in improving the change due to processing.

As is obvious from Table 9, too, one emulsion containing tabular grains was superior to another emulsion even through both of them had been chemically sensitized with the selenium sensitizer. Also evident from Table 9 is that the emulsion should better contain a mercapto compound represented by the formula (A).

Example 5

Samples 501 to 505 were formed which were equal to Sample 106 of Example 1, except that their layers 5 and 13 contained, instead of compounds (11) and (18), both represented by the formula (A), compounds (12) and (2); compounds (17) and (9); compounds (24) and (4); compounds (25) and (32); and compounds (38) and (40) respectively, each pair of compounds used in the same molar amount as the compounds (11) and (18).

Samples 501 to 505, thus made, were processed in the same method as in Example 1, for their photographic properties and their image qualities. They were found to exhibit almost the same photographic property and image quality as Sample 106.

Example 6

Samples 101 to 120 of another set were processed in the same way as in Example 1, except that use was made of a color developing solution which contained the same molar amount of 4-(N-ethyl-N-δ-hydroxybutyl amino)-2-methylaniline-p-toluenesulfonate, in place of 4-(N-ethyl-N-β-hydroxyethylamino)-2-methylaniline sulfate, and that the color development was performed for 2 minutes and 30 seconds, instead of 3 minutes and 15 seconds. Samples 101 to 120, thus processed were tested for their sensitivities of photographic properties and color turbidities. The results of the test were as is represented in the following Table 10.

The photographic properties were shown on the basis of the value obtained in example 1.

TABLE 10

| Sample | Photographic property (sensitivity: ΔS) | Image quality (color turbidity) |
|---|---|---|
| 101 Invention | +0.02 | 0.01 |
| 102 Comparative | −0.01 | 0.05 |
| 103 Comparative | +0.01 | 0.06 |
| 104 Comparative | 0.00 | 0.07 |
| 105 Comparative | −0.02 | 0.08 |
| 106 Invention | +0.07 | −0.02 |
| 107 Comparative | +0.01 | 0.05 |
| 108 Comparative | +0.03 | 0.06 |
| 109 Comparative | +0.02 | 0.07 |
| 110 Comparative | +0.01 | 0.08 |
| 111 Invention | +0.07 | −0.02 |
| 112 Invention | +0.07 | −0.01 |
| 113 Invention | +0.07 | −0.02 |
| 114 Invention | +0.07 | −0.02 |
| 115 Invention | +0.07 | 0.00 |
| 116 Invention | +0.07 | 0.00 |
| 117 Invention | +0.06 | 0.00 |
| 118 Invention | +0.06 | −0.01 |
| 119 Invention | +0.06 | −0.01 |
| 120 Invention | +0.06 | 0.00 |

As is evident from Table 10, any sample of the present invention had high sensitivity and excelled in color reproduction represented by color turbidity, just as is observed in the results of Example 1.

Also evident from Table 10 is that the developing solution used in Example 6 served to impart the same or higher sensitivity as the solution used in Example 1 even if the development time is shorter, and served to reduce the color turbidity, thus improving the color reproduction.

As has been described, the silver halide color photographic light-sensitive material according to the present invention has high sensitivity, undergoes but a little increase in fog while being stored, excels in image qualities such as graininess, sharpness, and color turbidity, and has good process stability. Further, the emulsions used in the material contain tabular silver halide grains and may also contain a compound represented by the formula (A) to have its photographic property and image quality improved. In other words, the present invention can greatly improve the photographic property, image quality and process stability of a silver halide color photographic light-sensitive material.

What is claimed is:

1. A silver halide color photographic light-sensitive material comprising a support and thereon at least one light-sensitive emulsion layer containing light-sensitive silver halide grains, wherein said light-sensitive grains have been chemically sensitized by at least one of a selenium sensitizer, a gold sensitizer, and a sulfur sensitizer, and at least one of the layers of the photographic light-sensitive material contains at least one compound represented by the formula (III) or (IV):

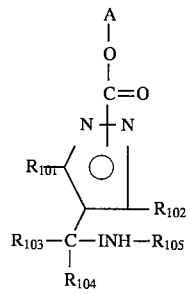

(III)

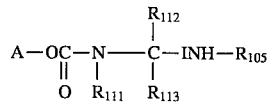

(IV)

wherein A represents a coupler residue or a redox group; INH is a development inhibitor group selected from the group consisting of:

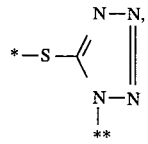

(INH-1)

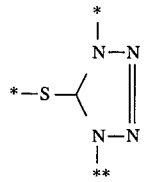

(INH-1A)

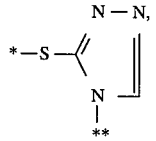

(INH-2)

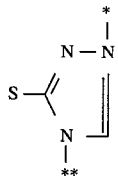

(INH-2A)

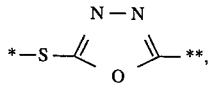

(INH-4)

(INH-4a)

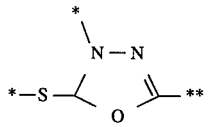

(INH-5)

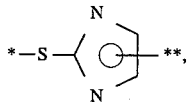

(INH-5a)

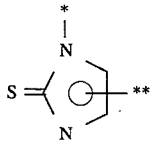

(INH-6)

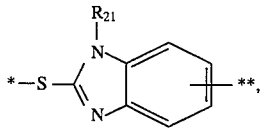

(INH-6a)

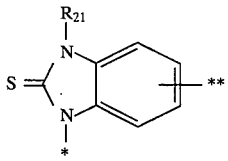

(INH-7)

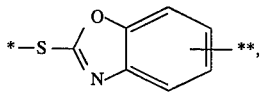

(INH-7a)

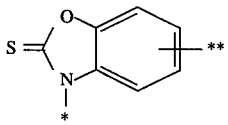

(INH-8)

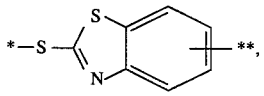

(INH-8a)

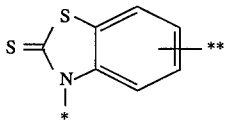

(INH-9)

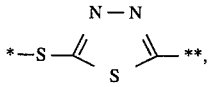

(INH-9a)

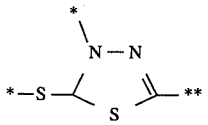

(INH-10)

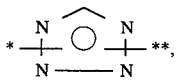

(INH-11)

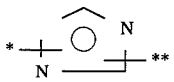

(INH-12)

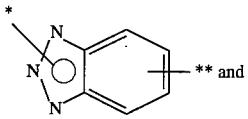

(INH-13)

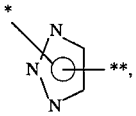

wherein ** indicates a position bonded to $R_{105}$; $R_{101}$ and $R_{102}$ each independently represents a hydrogen atom, an aryl group, an alkyl group, a halogen atom, an alkoxy group, an aryloxy group, an alkylthio group, an arylthio group, an amino group, a carbamoyl group, a sulfamoyl group, an alkoxycarbonyl group, an aryloxycarbonyl group, an acylamino group, a sulfonamido group, an alkoxycarbonylamino group, an aryloxycarbonylamino group, an ureido group, a cyano group, or a nitro group and in formula (III) does not contain an INH group; $R_{103}$ and $R_{104}$ each independently has the same meaning as $R_{101}$ and $R_{102}$; $R_{105}$ represents an unsubstituted phenyl group, an unsubstituted primary alkyl group, an unsubstituted alkylthio group, a primary alkyl group substituted with a halogen atom, an alkoxy group, an alkylthio group, an amino group, a carbamoyl group, a sulfamoyl group, an alkoxycarbonyl group, an acylamino group, a sulfonamido group, an alkoxycarbonylamino group, an ureido group, a cyano group, or a nitro group, or a group represented by the formula $—CO_2C(R_{107})(R_{108})CO_2R_{106}$; $R_{106}$ represents an alkyl group; $R_{107}$ and $R_{108}$ each independently represents a hydrogen atom or an alkyl group; $R_{111}$ represents a hydrogen atom, an alkyl group, an aryl group, a sulfonyl group, a carbamoyl group, a sulfamoyl group, an alkoxycarbonyl group, an aryloxycarbonyl group, an alkoxysulfonyl group, a cyano group, a nitro group, a nitroso group, a thioacyl group, a thiocarbamoyl group, an imidoyl group, an amino group, an acylamino group, an alkoxy group, or an aryloxy group, $R_{112}$ and $R_{113}$ each independently represents a hydrogen atom, an alkyl group, or an aryl group; wherein at least one of $R_{101}$ to $R_{104}$ is other than a hydrogen atom and any two of $R_{111}$, $R_{112}$ and $R_{113}$ can be divalent groups which bond together to form a ring; and $R_{21}$ is a hydrogen atom or an unsubstituted hydrocarbon group.

2. The light-sensitive material according to claim 1, wherein a formula weight of the residual group obtained by removing A and INH-$R_{105}$ from formula (III) is 142 to 240 and from formula (IV) is 81 to 240.

3. The light-sensitive material according to claim 1, wherein said light-sensitive silver halide grains are tabular grains having an aspect ratio of 2:1 or more and occupying at least 50% of total projected area of all grains.

4. The light-sensitive material according to claim 2, wherein said light-sensitive silver halide grains are tabular grains having an aspect ratio of 2:1 or more and occupying at least 50% of total projected area of all grains.

5. The light-sensitive material according to claim 3, wherein at least 50% in number of said light-sensitive silver halide grains have at least 10 dislocation lines each.

6. The light-sensitive material according to claim 4, wherein at least 50% in number of said light-sensitive silver halide grains have at least 10 dislocation lines each.

7. The light-sensitive material according to claim 1, which contains a compound represented by the following formula (A):

Formula (A)

$$Q—SM^3$$

where Q is a heterocyclic group directly or indirectly bonded to a group selected from the group consisting of $—SO_3M^2$, $—COOM^2$, —OH and $—NR^1R^2$, $M^1$ and $M^2$ each independently represents a hydrogen atom, an alkali metal atom, a quaternary ammonium group or a quaternary phosphonium group; and $R^1$ and $R^2$ each independently represents a hydrogen atom or an alkyl group.

8. The light-sensitive material according to claim 2, which contains a compound represented by the following formula (A):

Formula (A)

$$Q—SM^1$$

where Q is a heterocyclic group directly or indirectly bonded to a group selected from the group consisting of $—SO_3M^2$, $—COOM^2$, —OH and $—NR^1R^2$, $M^1$ and $M^2$ each independently represents a hydrogen atom, an alkali metal atom, a quaternary ammonium group or a quaternary phosphonium group; and $R^1$ and $R^2$ each independently represents a hydrogen atom or an alkyl group.

9. The light-sensitive material according to claim 3, which contains a compound represented by the following formula (A):

Formula (A)

$$Q—SM^1$$

where Q is a heterocyclic group directly or indirectly bonded to a group selected from the group consisting of $—SO_3M^2$, $—COOM^2$, —OH and $—NR^1R^2$, $M^1$ and $M^2$ each independently represents a hydrogen atom, an alkali metal atom, a quaternary ammonium group or a quaternary phosphonium group; and $R^1$ and $R^2$ each independently represents a hydrogen atom or an alkyl group.

10. The light-sensitive material according to claim 4, which contains a compound represented by the following formula (A):

Formula (A)

$$Q—SM^1$$

where Q is a heterocyclic group directly or indirectly bonded to a group selected from the group consisting of $—SO_3M^2$, $—COOM^2$, —OH and $—NR^1R^2$, $M^1$ and $M^2$ each independently represents a hydrogen atom, an alkali metal atom, a quaternary ammonium group or a quaternary phosphonium group; and $R^1$ and $R^2$ each independently represents a hydrogen atom or an alkyl group.

11. The light-sensitive material according to claim 5, which contains a compound represented by the following formula (A):

Formula (A)

$$Q—SM^1$$

where Q is a heterocyclic group directly or indirectly bonded to a group selected from the group consisting of $—SO_3M^2$, $—COOM^2$, —OH and $—NR^1R^2$, $M^1$ and $M^2$ each independently represents a hydrogen atom, an alkali metal atom, a quaternary ammonium group or a quaternary phosphonium group; and $R^1$ and $R^2$ each independently represents a hydrogen atom or an alkyl group.

12. The light-sensitive material according to claim 6, which contains a compound represented by the following formula (A):

Formula (A)

$$Q—SM^1$$

where Q is a heterocyclic group directly or indirectly bonded to a group selected from the group consisting of $—SO_3M^2$, $—COOM^2$, —OH and $—NR^1R^2$, $M^1$ and $M^2$ each independently represents a hydrogen atom, an alkali metal atom, a quaternary ammonium group or a quaternary phosphonium group; and $R^1$ and $R^2$ each independently represents a hydrogen atom or an alkyl group.

* * * * *